US008786358B2

(12) United States Patent
Endo et al.

(10) Patent No.: US 8,786,358 B2
(45) Date of Patent: Jul. 22, 2014

(54) REFERENCE VOLTAGE CIRCUIT AND SEMICONDUCTOR INTEGRATED CIRCUIT

(75) Inventors: Yoshiyuki Endo, Yokohama (JP); Kenta Aruga, Yokohama (JP); Suguru Tachibana, Yokohama (JP); Koji Okada, Yokohama (JP)

(73) Assignee: Spansion LLC, Sunnyvale, CA (US)

( * ) Notice: Subject to any disclaimer, the term of this patent is extended or adjusted under 35 U.S.C. 154(b) by 0 days.

(21) Appl. No.: 13/036,956

(22) Filed: Feb. 28, 2011

(65) Prior Publication Data

US 2011/0227636 A1 Sep. 22, 2011

(30) Foreign Application Priority Data

Mar. 19, 2010 (JP) ..... 2010-064668

(51) Int. Cl.
*G05F 1/10* (2006.01)
*G05F 3/24* (2006.01)

(52) U.S. Cl.
CPC ..... *G05F 3/245* (2013.01)
USPC ..... 327/539; 327/513

(58) Field of Classification Search
CPC ..... G05F 3/20; G05F 3/22; G05F 3/30222; G05F 3/225; G05F 3/245
USPC ..... 327/539; 323/313
See application file for complete search history.

(56) References Cited

U.S. PATENT DOCUMENTS 5,325,045 A 6/1994 Sundby
5,396,245 A * 3/1995 Rempfer ..... 341/145
5,471,131 A * 11/1995 King et al. ..... 323/314
5,517,134 A * 5/1996 Yaklin ..... 327/65
5,767,664 A * 6/1998 Price ..... 323/313
5,852,360 A * 12/1998 Levinson ..... 323/316
6,121,824 A * 9/2000 Opris ..... 327/539
6,201,379 B1 * 3/2001 MacQuigg et al. ..... 323/313
6,255,807 B1 * 7/2001 Doorenbos et al. ..... 323/314

(Continued)

FOREIGN PATENT DOCUMENTS

JP 07-111425 A 4/1995
JP 08-018353 A 1/1996
JP 2003-168296 A 6/2003
JP 2005-182113 A 7/2005

OTHER PUBLICATIONS

English-Language Abstract for Japanese Patent Publication No. 07-111425 A, published Apr. 25, 1995; 1 page.

(Continued)

*Primary Examiner* — Thomas J Hiltunen
(74) *Attorney, Agent, or Firm* — Sterne, Kessler, Goldstein & Fox P.L.L.C.

(57) ABSTRACT

A reference voltage circuit includes a first amplifier configured to output a reference voltage, a second amplifier coupled to the first amplifier, an offset adjustment voltage generation circuit, a first load device and a first pn junction device, and second and third load devices and a second pn junction device. The offset adjustment voltage generation circuit is configured to generate a voltage which is input to the third and fourth input terminals of the second amplifier, and reduce an offset voltage between the first and second input terminals of the first amplifier through the second amplifier. The first input terminal is coupled to a coupling node of the first load device and the first pn junction device, and the second input terminal is coupled to a coupling node of the second load device and the third load device.

20 Claims, 29 Drawing Sheets

(56) References Cited

U.S. PATENT DOCUMENTS

| | | | | |
|---|---|---|---|---|
| 6,275,098 | B1 * | 8/2001 | Uehara et al. | 327/539 |
| 6,339,355 | B1 * | 1/2002 | Yamauchi et al. | 327/307 |
| 6,388,521 | B1 * | 5/2002 | Henry | 330/258 |
| 6,529,066 | B1 * | 3/2003 | Guenot et al. | 327/539 |
| 6,538,507 | B2 * | 3/2003 | Prentice et al. | 330/85 |
| 6,642,699 | B1 * | 11/2003 | Gregoire, Jr. | 323/314 |
| 7,142,042 | B1 * | 11/2006 | Henry | 327/538 |
| 7,200,066 | B2 * | 4/2007 | Krenzke et al. | 365/226 |
| 7,342,390 | B2 * | 3/2008 | Tachibana et al. | 323/316 |
| 7,400,195 | B2 * | 7/2008 | Gatti | 330/259 |
| 7,420,359 | B1 * | 9/2008 | Anderson et al. | 323/316 |
| 7,583,135 | B2 * | 9/2009 | Ashburn et al. | 327/539 |
| 7,602,225 | B2 * | 10/2009 | Seo et al. | 327/198 |
| 7,618,186 | B2 * | 11/2009 | Kwon et al. | 374/170 |
| 7,688,054 | B2 * | 3/2010 | Cave | 323/313 |
| 7,728,632 | B1 * | 6/2010 | Bi | 327/65 |
| 7,733,179 | B2 * | 6/2010 | Forejt | 330/258 |
| 7,898,320 | B2 * | 3/2011 | Ashburn et al. | 327/539 |
| 7,911,195 | B2 * | 3/2011 | Draxelmayr | 323/313 |
| 7,948,304 | B2 * | 5/2011 | Aruga et al. | 327/539 |
| 7,952,402 | B2 * | 5/2011 | Illegems | 327/143 |
| 8,098,096 | B2 * | 1/2012 | Traub | 330/253 |
| 8,334,717 | B2 * | 12/2012 | Chen | 327/307 |
| 8,427,204 | B2 * | 4/2013 | Willey | 327/73 |
| 8,493,130 | B2 * | 7/2013 | Fukazawa et al. | 327/513 |
| 8,513,938 | B2 * | 8/2013 | Tachibana et al. | 323/315 |
| 2005/0127987 | A1 | 6/2005 | Sato et al. | |
| 2007/0052473 | A1 * | 3/2007 | McLeod | 327/539 |
| 2009/0322579 | A1 * | 12/2009 | Matsuda | 341/158 |
| 2012/0212194 | A1 * | 8/2012 | Tachibana et al. | 323/268 |
| 2013/0121377 | A1 * | 5/2013 | Furuichi | 374/178 |

OTHER PUBLICATIONS

English-Language Abstract for Japanese Patent Publication No. 2003-168296 A, published Jun. 13, 2003; 1 page.

English-Language Translation of Notice of Reasons for Rejection directed to related Japanese Patent Application No. 2010-064668, mailed Oct. 25, 2013, from the Japanese Patent Office; 4 pages.

* cited by examiner

CLOGIC1

POR

REFERENCE VOLTAGE CIRCUIT AND SEMICONDUCTOR INTEGRATED CIRCUIT

CROSS REFERENCE TO RELATED APPLICATION

This application is based upon and claims the benefit of priority of the prior Japanese Patent Application No. 2010-064668, filed on Mar. 19, 2010, the entire contents of which are incorporated herein by reference.

FIELD

The embodiments discussed herein are related to a reference voltage circuit and a semiconductor integrated circuit.

BACKGROUND

In analog integrated circuits, when a reference voltage not dependent on the temperature and power source voltage was used, a reference voltage circuit called a "bandgap circuit" was used. Mounting together with digital circuits is easy, so even in important CMOS analog integrated circuits, bandgap circuits are being widely used as stable reference voltage circuits.

In a related bandgap circuit, the potential of a forward-biased pn junction and a voltage proportional to the absolute temperature (T) (in general, called PTAT) are added to obtain a reference voltage not dependent on the temperature. Various types of such circuits have been provided.

It is known that the potential of the forward-biased pn junction (if approximating the potential of the pn junction by a linear equation or within the range able to be approximated by a linear equation) is the CTAT (complementary-to-absolute temperature). Further, it is known that by adding a (suitable) PTAT voltage to the potential of this forward-biased pn junction, a reference voltage substantially not dependent on temperature is obtained.

Incidentally, in the past, various techniques have been proposed for adjusting the value of the VBGR.

Patent Document 1: Japanese Laid-open Patent Publication No. H08-018353

Patent Document 2: Japanese Laid-open Patent Publication No. 2005-182113

Patent Document 3: U.S. Pat. No. 5,325,045

SUMMARY

According to an aspect of the embodiment, a reference voltage circuit includes a first amplifier, a second amplifier coupled to the first amplifier, an offset adjustment voltage generation circuit, a first load device and a first pn junction device, and second and third load devices and a second pn junction device.

The first amplifier includes first and second input terminals and provided between a first power source line and a second power source line, and is configured to output a reference voltage. The second amplifier includes third and fourth input terminals and is provided between the first power source line and the second power source line.

The offset adjustment voltage generation circuit is configured to generate a voltage which is input to the third and fourth input terminals of the second amplifier, and reduce an offset voltage between the first and second input terminals of the first amplifier through the second amplifier.

The first load device and the first pn junction device are coupled in series between a reference voltage line to which the reference voltage is applied and the second power source line, and the second and third load devices and the second pn junction device are coupled in series between the reference voltage line and the second power source line.

The first input terminal is coupled to a coupling node of the first load device and the first pn junction device, and the second input terminal is coupled to a coupling node of the second load device and the third load device.

The object and advantages of the embodiments will be realized and attained by means of the elements and combinations particularly pointed out in the claims.

It is to be understood that both the foregoing general description and the following detailed description are exemplary and explanatory and are not restrictive of the embodiments, as claimed.

DESCRIPTION OF EMBODIMENTS

Before describing in detail the embodiments of a reference voltage circuit and a semiconductor integrated circuit, examples of a bandgap circuit (reference voltage circuit) will be described with reference to FIG. 1 to FIG. 6.

Figure 1:
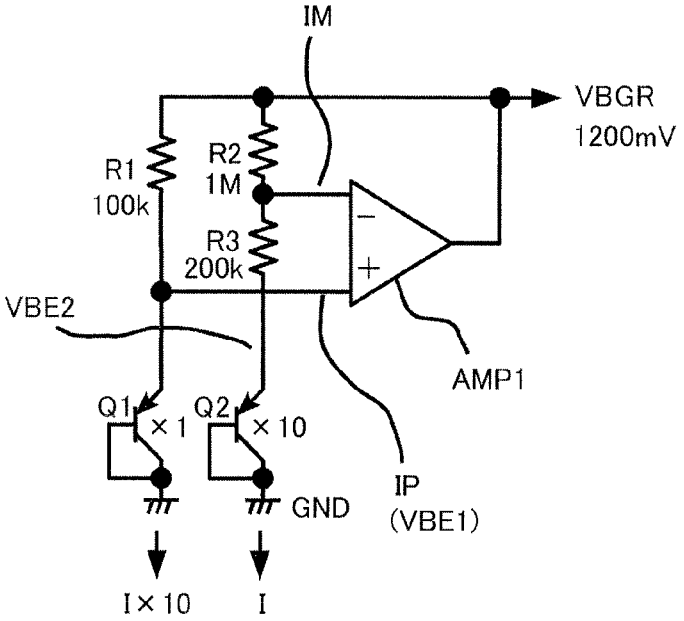
FIG. 1 is a circuit diagram illustrating a first example of a related bandgap circuit.

In FIG. 1, reference notations Q1 and Q2 indicate pnp bipolar transistors (below, also described as pnpBJT), while R1, R2, and R3 indicate resistors. Note that, the resistance values of the resistors R1, R2, and R3 are also shown by R1, R2, and R3. Below, similarly, Rn (where n is an integer) indicates a resistor and also shows the resistance value of the same.

Furthermore, reference notation AMP1 indicates an operating amplifier circuit (CMOS operating amplifier), GND indicates a GND terminal (first power source line: 0V), while VBGR indicates an output reference potential (reference voltage). Further, reference notations VBE2, IM, and IP indicate internal nodes.

In FIG. 1, the values attached to the resistors (for example, 100 k and 200 k) indicate examples of the resistance values, while the numerals attached to BJT (for example, ×1, ×10) indicate the relative ratios of areas of BJT. In the same way, in the other figures as well, the numerals attached to BJT indicate the relative ratios of areas of the BJT.

Furthermore, in FIG. 1, VBE2, at the same time as being the name of the node, also indicates the base-emitter voltage of the transistor Q2. Further, the potential of the node IP is equal to the base-emitter voltage of the transistor Q1, so the potential is expressed by VBE1.

The operation of the bandgap circuit illustrated in FIG. 1 will be simply explained. If expressing the base-emitter voltage of BJT, that is, the forward direction voltage of the pn junction, by VBE, it is known that the relationship of the forward direction voltage of the pn junction and the absolute temperature T becomes generally the following formula (1):

$$VBE=Veg-T \quad \text{formula (1)}$$

Here, VBE indicates the forward direction voltage of the pn junction, Veg indicates the bandgap voltage of silicon (about 1.2V), a indicates the temperature dependency of VBE (about 2 mV/° C.), and T indicates the absolute temperature. Note that, the value of a differs based on the bias current, but in the practical region is known to be about 2 mV/° C. or so.

Further, it is known that the relationship between the emitter current IE and the voltage VBE of BJT generally becomes the following formula (2):

$$IE=I0\exp(qVBE/kT) \quad \text{formula (2)}$$

Here, IE indicates the emitter current of the BJT or the current of the diode, indicates a constant (proportional to the area), q indicates a charge of electrons, and, further, k indicates Boltzmann's constant. When, due to the negative feedback by the operating amplifier AMP1, the voltage gain of the AMP1 is sufficiently large, the potentials of the first input IP and second input IM of the AMP1 become (substantially) equal and the circuit stabilizes.

At this time, as illustrated in FIG. 1, if designing the resistance values of the resistors R1 and R2 to, for example, 1:10 (100 k:1M), the magnitudes of the currents flowing through the transistors Q1 and Q2 become 10:1.

Here, the current flowing through the transistor Q1 is expressed by 10I, while the current flowing through the transistor Q2 is expressed by I. Note that, in FIG. 1, the I×10 and the I attached below Q1 and Q2 show the correspondence of this current. Similarly, in the other drawings as well, the I×10 and I etc. attached to BJT indicate the correspondence of the flowing currents.

Assume that the emitter area of the transistor Q2 is 10 times the emitter area of the transistor Q1. Note that, the ×1 and ×10 attached to the transistors Q1 and Q2 of FIG. 1 show the correspondence of the emitter areas.

Further, if expressing the base-emitter voltage of the transistor Q1 by VBE1 and expressing the base-emitter voltage of the transistor Q2 by VBE2, it is learned, from the formula (2), that there are the relationships of the following formula (3) and formula (4):

$$10\times I=I0\exp(qVBE1/kT) \quad \text{formula (3)}$$

$$I=10\times I0\exp(qVBE2/kT) \quad \text{formula (4)}$$

If calculating the two sides and expressing the result by VBE1−VBE2=ΔVBE, the following formula (5) and formula (6) are obtained:

$$100=\exp(qVBE1/kT-qVBE2/kT) \quad \text{formula (5)}$$

$$\Delta VBE=(kT/q)\ln(100) \quad \text{formula (6)}$$

That is, the difference ΔVBE of the base-emitter voltage of the transistors Q1 and Q2 is expressed by the log of the current density ratio 100 of the transistors Q1 and Q2 (ln(100)) and thermal voltage (kT/q). This ΔVBE is equal to the potential difference across the two ends of the resistor R3, so the resistors R2 and R3 have a current of ΔVBE/R3 flowing through them.

Therefore, the potential difference VR2 of the two ends of the resistor R2 is expressed by the following formula (7):

$$VR2=\Delta VBE(R2/R3) \quad \text{formula (7)}$$

Further, the potential of IP and the potential of IM are equal at VBE1, so the potential of the reference voltage VBGR is expressed by the following formula (8):

$$VBGR=VBE1+\Delta VBE(R2/R3) \quad \text{formula (8)}$$

The forward direction voltage VBE1 has a negative temperature dependency where it falls along with a rise of the temperature (VBE=Veg−aT formula (1)), while ΔVBE, as illustrated in formula (6), increases in proportion to the temperature.

Therefore, by suitably selecting the constants, it is possible to design the circuit so that the value of the reference voltage VBGR is not dependent on temperature. The value of VBGR at this time becomes about 1.2V (1200 mV) corresponding to the bandgap voltage of silicon.

In this way, in the bandgap circuit of FIG. 1, by suitably selecting the circuit constants, it is possible to generate a bandgap voltage not dependent on temperature by a relative simple circuit.

Figure 2:
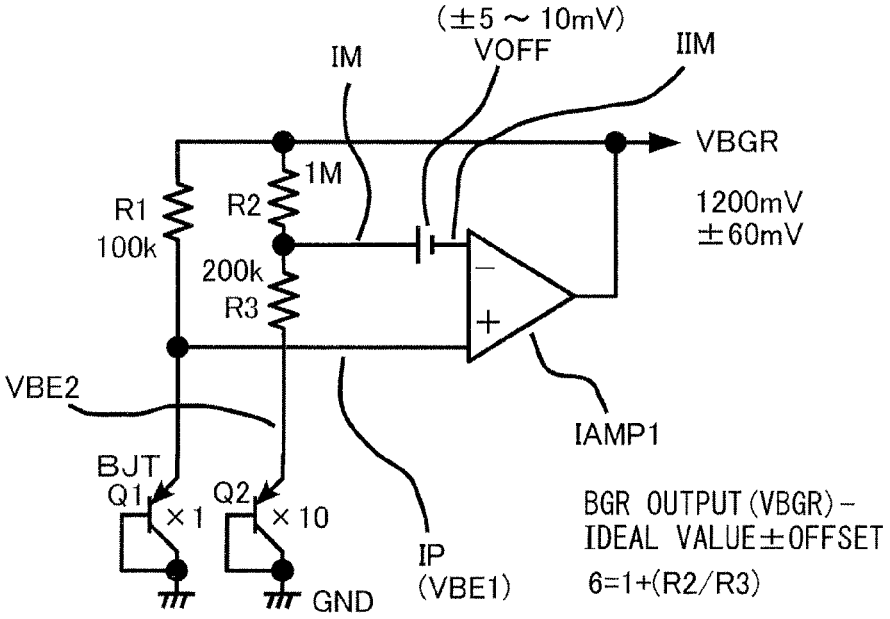
FIG. 2 is a view for explaining points for improvement in the bandgap circuit of FIG. 1.

However, the bandgap circuit of this FIG. 1 also has points for improvement as explained next. FIG. 2 is a view for explaining the points for improvement in the bandgap circuit of FIG. 1.

In FIG. 2, reference notations Q1 and Q2 indicate pnp bipolar transistors (pnpBJT), while R1, R2, and R3 indicate resistors. Note that, the resistance values of the resistors R1, R2, and R3 are indicated by R1, R2, and R3.

Reference notation IAMP1 indicates an ideal operating amplifier circuit, GND indicates a GND terminal, VBGR indicates an output reference potential, and, further, IM and IP indicate internal nodes. Furthermore, VOFF indicates an equivalent voltage source expressing the offset voltage of the operating amplifier, while IIM indicates a minus-side input terminal of the ideal operating amplifier IAMP1.

Note that the values attached to the resistors indicate examples of resistance values, while values attached to the BJT indicate relative ratios of areas of the BJT. Note that, unless otherwise specified, corresponding devices and nodes in the figures are assigned the same names and overlapping explanations are avoided.

To explain the problems in the bandgap circuit of FIG. 1, in FIG. 2, the AMP1 of FIG. 1 is shown by the ideal operating amplifier IAMP1 and equivalent offset voltage VOFF. The basic operation is similar to that explained in FIG. 1, so, in FIG. 2, it is explained what kind of effect the offset voltage VOFF has on the reference voltage VBGR.

At the CMOS circuit, when forming a bandgap circuit (reference voltage circuit), in particular a circuit such as illustrated in FIG. 1, it is not possible to avoid the effect of the offset voltage of the operating amplifier. Ideally, when the input potentials IM and IP of the AMP1 of FIG. 1 are equal, the output potential of the AMP1 becomes, for example, a potential of about ½ of the power source voltage.

However, in an actual integrated circuit (LSI), the characteristics of the devices making up the amplifiers will not completely match, so whether the output potential of the AMP1 becomes, for example, a potential of about ½ of the power source voltage differs depending on the individual amplifiers. Further, the differential potential of the input potential at this time is called the offset voltage (VOFF). It is known that the typical offset voltage is, for example, about ±10 mV.

To explain what kind of effects the actual characteristics of an amplifier have on the output potential of the bandgap circuit, in FIG. 2, the AMP1 of FIG. 1 is illustrated by the ideal operating amplifier IAMP1 and equivalent offset voltage VOFF. Note that, the offset voltage of the ideal operating amplifier IAMP1 is assumed to be 0 mV.

In the ideal circuit of FIG. 1, the potentials of the inputs IM and IP match. However, in an actual circuit, the potentials of the inputs IM and IP of the virtual ideal operating amplifier IAMP1 match, so the potentials of the IM and the IP become offset by exactly a value corresponding to the offset voltage VOFF. For simplification of the explanation, the potential difference VR3 applied across the resistor R3 in the ideal state is expressed by the following formula (9):

$$VR3=\Delta VBE \qquad \text{formula (9)}$$

The potential difference VR3' applied to the resistor R3 of FIG. 2 is generally expressed by the following formula (10). Note that, VOFF indicates the value of the offset voltage VOFF:

$$VR3'=\Delta VBE+VOFF \qquad \text{formula (10)}$$

Further, the potential difference VR2' across the resistor R2 is expressed by the following formula (11):

$$VR2'=(\Delta VBE+VOFF)R2/R3 \qquad \text{formula (11)}$$

Therefore, the reference voltage VBGR is expressed by the following formula (12):

$$VBGR=VBE1+VOFF+(\Delta VBE+VOFF)R2/R3 \qquad \text{formula (12)}$$

As illustrated in FIG. 2, if making R2/R3=1M/200 k=5, the value of VBGR becomes the ideal value plus the offset voltage multiplied by (about) 6. That is, the result becomes BGRoutput=ideal value±6×offset.

The circuits of FIG. 1 and FIG. 2 show the cases of reducing the effect of the offset voltage of the operating amplifier as much as possible by making the area of the transistor Q2 10 times that of the transistor Q1 and, furthermore, making the current flowing through Q1 10 times the current flowing through Q2.

Due to this, for example, the potential difference across R3, as illustrated in the following formula (13), may be made a relatively large value of 120 mV:

$$\Delta VBE=(kT/q)\ln(100)=26\text{ mV}\times 4.6=120\text{ mV formula} \qquad (13)$$

That is, it is possible to keep the effect of the offset voltage VOFF relatively small. However, in this case as well, to obtain a 1200 mV bandgap voltage comprised of the about 600 mV VBE (VBE1) plus the PTAT voltage, it is preferable to increase the value of the formula (13) by 5 and add it to VBE1.

For this reason, when there is the offset voltage VOFF, the effect of the offset voltage VOFF is amplified by {1+(R2/R3)}=(1+5)=6 fold or so. This has a large effect on the reference voltage VBGR. Note that, the formula of the VBGR output illustrated in FIG. 2 shows the effect of this offset voltage.

That is, the circuit of FIG. 1 has the advantage of enabling configuration of a bandgap circuit by a relatively simple circuit configuration, but due to the offset voltage of the operating amplifier circuit (CMOS operating amplifier), there is a limit on the precision of the reference voltage VBGR which is achieved.

In the past, for the purpose of solving the problem of the offset voltage of the CMOS operating amplifier limiting the precision of the output voltage of the CMOS bandgap circuit, a circuit for trimming several output voltages (reference voltages) has been proposed.

Figure 3:
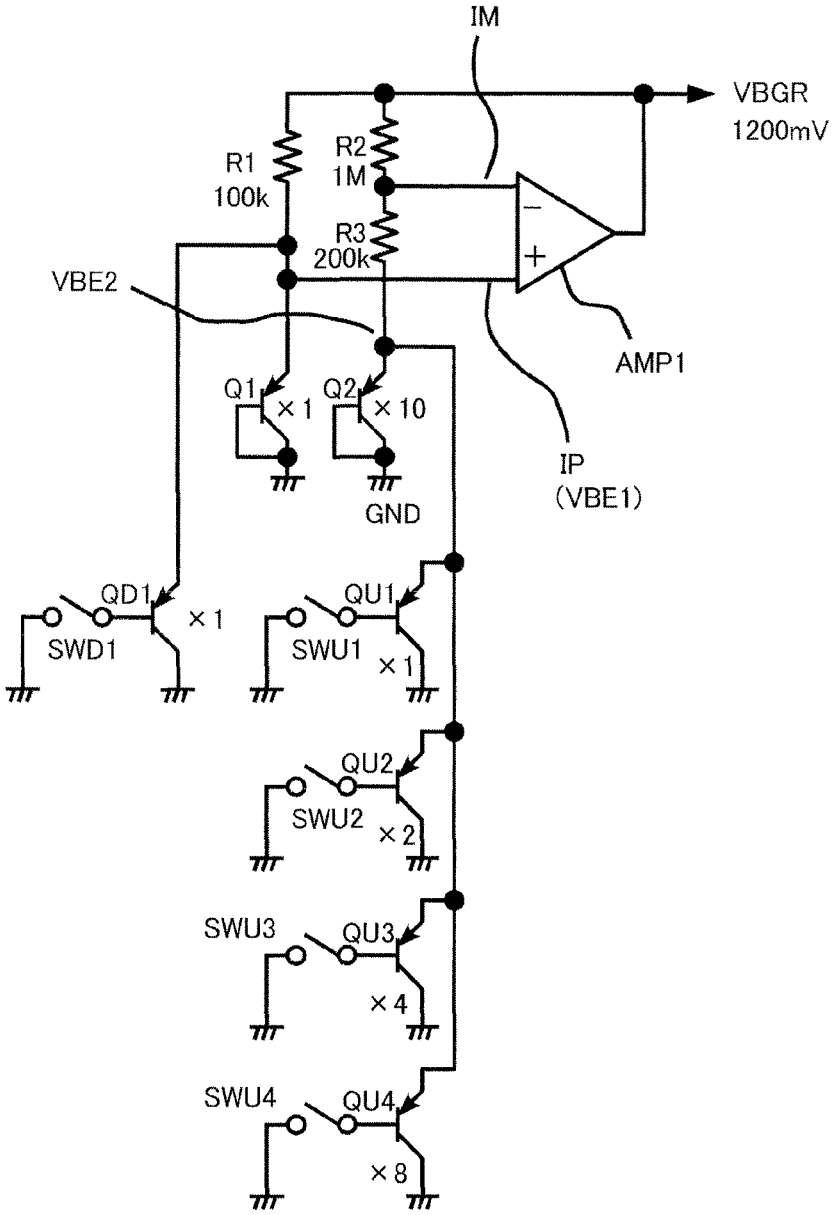
FIG. 3 is a circuit diagram illustrating a second example of a related bandgap circuit.

FIG. 3 is a circuit diagram illustrating a second example of a related bandgap circuit and illustrates application of the technique of changing the number of PNP transistors for trimming.

In FIG. 3, reference notations QD1, QU1, QU2, QU3, and QU4 indicate pnp bipolar transistors, while SWD1, SWU1, SWU2, SWU3, and SWU4 indicate switches. Note that the other notations correspond to those illustrated in FIG. 1, so explanations will be omitted.

In the circuit of FIG. 1, the input conversion offset voltage of the CMOS operating amplifier AMP1 was, for example, amplified about 6-fold and made to change the potential of the output VBGR. As factors behind fluctuation of the value of VBGR, in addition to the offset voltage of the AMP1, fluctuation of the relative values of the values of R1 to R3, fluctuation of the value of VBE1 or VBE2, etc. may be mentioned.

In the circuit of FIG. 3, for example, when the value of VBGR is smaller than the target value, the switches SWU1 to SWU4 may be turned ON so as to increase the effective area of the transistor Q2.

Specifically, if turning the switch SWU1 ON and turning the switches SWU2 to SWU4 OFF, the transistor QU1 turns ON, while the transistors QU2 to QU4 may be turned OFF.

Due to this, the current density of the transistor Q2 becomes smaller, so the VBE difference ΔVBE of Q1 and Q2 becomes larger. Further, if ΔVBE becomes larger, the voltage which is amplified by R2/R3 and added to VBE1 becomes larger, so the potential of VBGR may be increased. This is clear from the above-mentioned formula (8) VBGR=VBE1+ΔVBE(R2/R3).

Here, for example, it is possible to binarily weight the transistors QU1 to QU4 and control the switches SWU1 to SWU4 by 4-bit digital data so as to change the increase in area of the transistor Q2 from an area the same as the transistor Q1 to a value of 15 times the Q1.

Further, for example, when the value of the VBGR in the circuit of FIG. 3 is larger than the target value, by turning the switch SWD1 ON, it is possible to increase the effective area of the transistor Q1. That is, if turning the switch SWD1 ON, the transistor QD1 turns ON.

Due to this, the current density of the transistor Q1 becomes smaller, so the VBE difference ΔVBE between Q1 and Q2 becomes smaller. Further, if ΔVBE becomes smaller, the voltage amplified by R2/R3 and added to VBE1 becomes smaller, so it is possible to reduce the potential of the VBGR.

In this way, the bandgap circuit illustrated in FIG. 3 is made variable in area ratio of the PNP transistors, so the potential of the VBGR may be adjusted.

Figure 4:
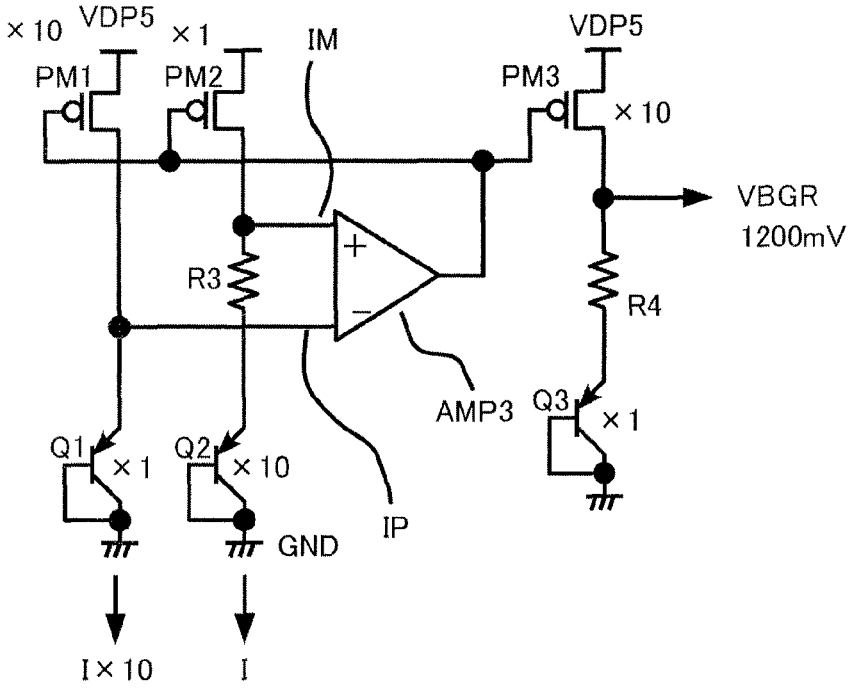
FIG. 4 is a circuit diagram illustrating a third example of a related bandgap circuit.

FIG. 4 is a circuit diagram which illustrates a third example of a related bandgap circuit. In FIG. 4, reference notations Q1, Q2, and Q3 indicate pnp bipolar transistors, R3 and R4 indicate resistors, AMP3 indicates an operating amplifier circuit, and, further, GND indicates a GND terminal (0V).

Furthermore, reference notation VDP5 indicates a 5V power source terminal, VBGR indicates an output reference potential, IM and IP indicate internal nodes, and, further, PM1, PM2, and PM3 indicate pMOS transistors. Note that, in FIG. 4, the nodes and devices corresponding to the circuit of FIG. 1 are assigned the same reference notations to enable the correspondence to be understood.

Further, in FIG. 4, the numerals (×10, ×1) added to the pMOS transistors PM1, PM2, and PM3 indicate the ratios of the complementary gate widths W of the pMOS transistors. Similarly, in the other figures as well, the numerals added to the pMOS transistors indicate the ratios of the complementary gate widths W of the pMOS transistors.

Next, the operation of the bandgap circuit illustrated in FIG. 4 will be briefly explained. First, due to negative feedback by the operating amplifier AMP3, the potentials of the inputs IM and IP of the AMP3 become (almost) equal and the circuit stabilizes.

At this time, as explained with reference to FIG. 3, if setting the values of W of the transistors PM1 and PM2 to, for example, 10:1, the magnitudes of the currents flowing through the transistors Q1 and Q2 become 10:1. Here, the current flowing through the transistor Q1 is indicated by 10I, while the current flowing through the transistor Q2 is indicated by I.

Note that, the I×10 and I added below the transistors Q1 and Q2 indicate the correspondence of the currents. Similarly, in the other figures as well, the I×10 and the I etc. added to the BJT indicate the correspondence of the currents carried.

As one example, the emitter area of the transistor Q2 is made 10 times the emitter area of the transistor Q1. Note that, in FIG. 4, the ×1 and ×10 added to the transistors Q1 and Q2 indicate the correspondence of the emitter areas.

Furthermore, if expressing the base-emitter voltage of the transistor Q1 as VBE1 and, further, expressing the base-emitter voltage of the transistor Q2 as VBE2, it is learned that, from the above-mentioned formula (2), there are the relationships of the formula (3) and formula (4). Note that, the formula (3) to formula (6) shown below are similar to those explained earlier.

$$10\times I=I0\exp(qVBE1/kT) \quad \text{formula (3)}$$

$$I=10\times I0\exp(qVBE2/kT) \quad \text{formula (4)}$$

If dividing the two sides and expressing VBE1−VBE2=ΔVBE, the formula (5) and formula (6) are obtained:

$$100=\exp(qVBE1/kT-qVBE2/kT) \quad \text{formula (5)}$$

$$\Delta VBE=(kT/q)\ln(100) \quad \text{formula (6)}$$

That is, the difference ΔVBE of the base-emitter voltage of the transistors Q1 and Q2 is expressed by the log (ln(100)) of the current density ratio 100 of the transistors Q1 and Q2 and the thermal voltage (kT/q). This ΔVBE is equal to the potential difference across the resistor R3, so the resistor R3 has the current of ΔVBE/R3 running through it.

Further, the transistors PM1, PM2, and PM3 become current mirrors, so the transistor PM1 has a current of 10 times the transistor PM2 running through it and therefore the current flowing through the transistor PM3 and the current flowing through the transistor PM1 become equal.

Furthermore, the emitter area of the transistor Q3 and the emitter area of the transistor Q1 become equal and the currents of the transistors PM1 and PM3 become equal, so the base-emitter voltage VBE of the transistor Q1 and the VBE of the transistor Q3 become equal at VBE1.

Therefore, the potential of the reference voltage VBGR is expressed by the next formula (14):

$$VBGR=VBE1+\Delta VBE(10\times R4/R3) \quad \text{formula (14)}$$

In this way, in the bandgap circuit of FIG. 4 as well, by suitably selecting the circuit constants, it is possible to generate a bandgap voltage (reference voltage) not dependent on the temperature.

Figure 5:
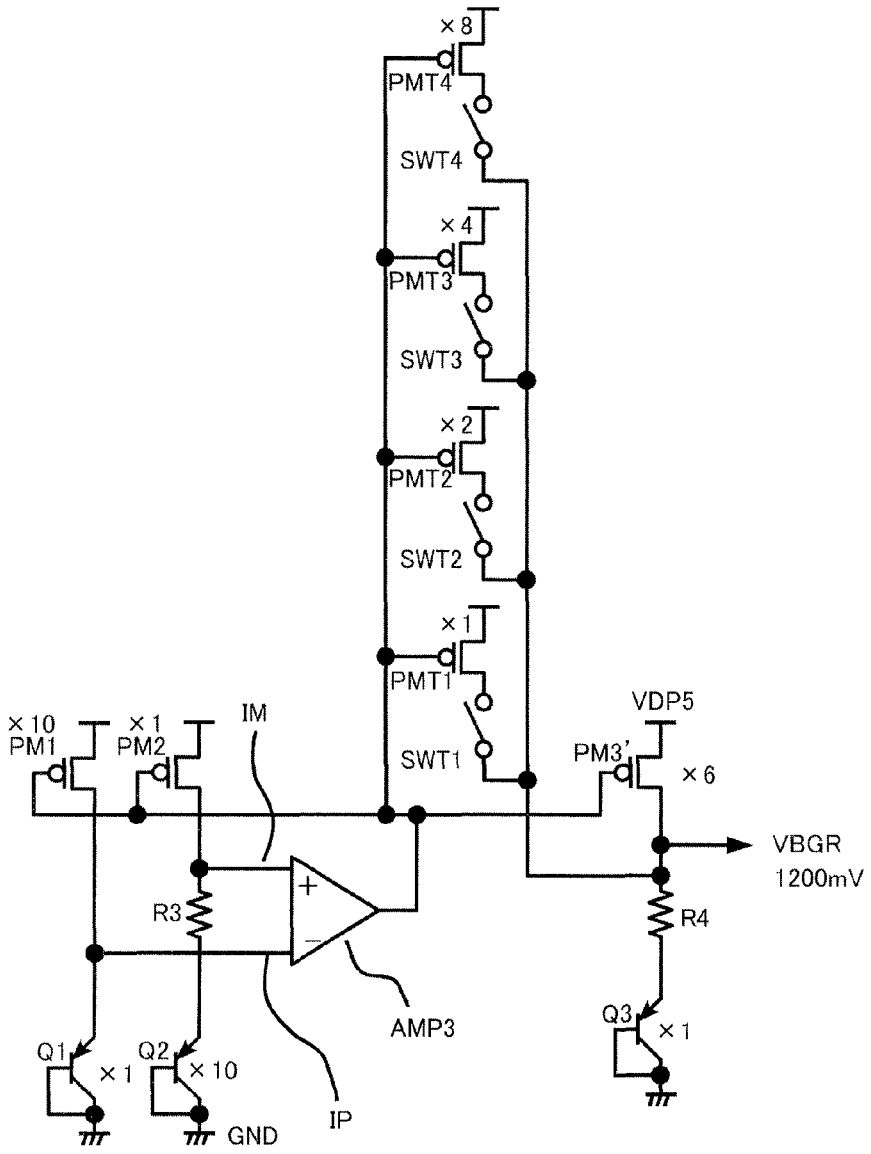
FIG. 5 is a circuit diagram illustrating a fourth example of a related bandgap circuit.

FIG. 5 is a circuit diagram illustrating a fourth example of a related bandgap circuit and illustrates the application of changing the current mirror ratio for trimming.

In FIG. 5, the reference notations Q1, Q2, and Q3 indicate pnp bipolar transistors, R3 and R4 indicate resistors, AMP3 indicates an operating amplifier circuit, GND indicates a GND terminal (0V), and, further, VDP5, for example, indicates a 5V power source terminal.

Further, reference notation VBGR indicates the output reference potential, IM and IP indicate internal nodes, PM1, PM2, PM3', and PMT1 to PMT4 indicate p-channel type MOS transistors (pMOS transistors), and, further, SWT1 to SWT4 indicate switches. Note that, in FIG. 5, nodes and devices corresponding to the circuit of FIG. 4 are assigned the same reference notations to clarify the correspondence.

Further, in FIG. 5, the numerals (×10, ×1, ×6, etc.) attached to the pMOS transistors PM1, PM2, PM3', and PMT1 to PMT4 indicate the relative ratios of gate widths W of the pMOS transistors. Similarly, in the other figures as well, the numerals attached to the pMOS transistors indicate the relative ratios of gate widths W of the pMOS transistors.

The differences between the bandgap circuit of FIG. 5 and the bandgap circuit of FIG. 4 lie in the addition of the transistors PMT1 to PMT4 and switches SWT1 to SWT4 and the change of the gate width W of the transistor PM3' from the ×10 of FIG. 4 to ×6.

Therefore, first, the differences in the circuits of FIG. 4 and FIG. 5 will be explained, then the fact that the potential of the reference voltage VBGR may be adjusted using the switches SWT1 to SWT4 by the configuration of FIG. 5 will be explained.

In the bandgap circuit of FIG. 4, making the gate width W×10 so that the current of the transistor PM3 becomes equal to the current of the transistor PM1 will be explained.

Even in the bandgap circuit of FIG. 5, when the currents flowing through the transistor Q3 and resistor R4 ideally become equal to the current of the transistor PM1, it is assumed that the potential of the VBGR becomes 1200 mV.

In the bandgap circuit of FIG. 5, the transistor PM3' has a gate width W corresponding to ×6. By selectively turning ON the transistors PMT1 to PMT4, the gate width W is adjusted to correspond to ×10.

The transistors PMT1 to PMT4 are binarily weighted. By selectively turning the switches SWT1 to SWT4 ON, it is possible to realize a gate width W corresponding to ×1 to corresponding to ×15. By adding the gate width W of the constantly ON transistor PM3', it is possible to increase or decrease the current flowing through the transistor Q3.

When the potential of the reference voltage VBGR is lower than the target value, the gate width W turned on by the switches SWT1 to SWT4 is increased. On the other hand, when the potential of the reference voltage VBGR is higher than the target value, the gates width W turned ON by the switches SWT1 to SWT4 is decreased. Due to this, it is possible to adjust the reference output potential (reference voltage) of the bandgap circuit.

Figure 6:
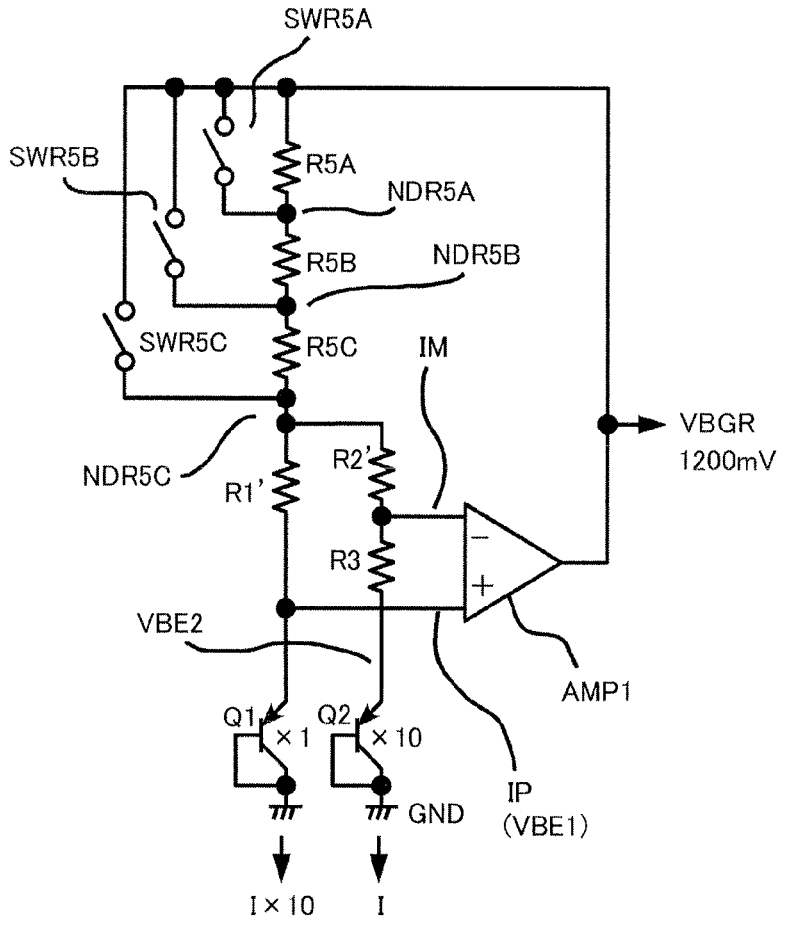
FIG. 6 is a circuit diagram illustrating a fifth example of a related bandgap circuit.

FIG. 6 is a circuit diagram illustrating a fifth example of a related bandgap circuit. The bandgap circuit of FIG. 6 is the same as the circuit of FIG. 1 in terms of the operation of the circuit, so the points of difference of the circuit of FIG. 6 from the circuit of FIG. 1 will be explained.

Furthermore, in the bandgap circuit of FIG. 6, it was explained that the action of the different circuit elements may be used to adjust the potential of the bandgap circuit output (reference voltage) VBGR. Note that, in FIG. 6, the nodes and devices corresponding to the circuit of FIG. 1 are assigned the same notations to facilitate understanding of the correspondence. Further, overlapping explanations will be omitted.

In FIG. 6, reference notations R1', R2', and R3' show resistors which act substantially in the same way as the R1, R2, and R3 of FIG. 1. Note that, in FIG. 6, the resistors R5A, R5B, and R5C are added to FIG. 1, so the resistance values of the resistors R1, R2, and R3 have to be changed.

For this reason, in FIG. 6, the resistors corresponding to the resistors R1 to R3 are shown as R1', R2', and R3'. Further, in the circuit of FIG. 6, the switches SWR5A, SWR5B, and SWR5C are added to the circuit of FIG. 1.

When the switches SWR5A to SWR5C are all OFF, the resistance between the node NDR5C and VBGR becomes the total resistance of R5A, R5B, and R5C. Further, by turning any one of the switches SWR5A to SWR5C ON or turning all of them OFF, the resistance between the node NDR5C and the VBGR may be selected from the total resistance of R5A to R5C, the total resistance of R5B and R5C, the resistance of R5C, and zero.

That is, the bandgap circuit of FIG. 6 enables adjustment of the resistance between the node NDR5C and the VBGR by the switches SWR5A, SWR5B, and SWR5C and the resistors R5A, R5B, and R5C.

That is, when the potential of the VBGR is higher than a target value, it is possible to reduce the resistance between the node NDR5C and the VBGR and lower the potential of the VBGR so as to make the value of the VBGR close to the target value. Further, when the potential of the VBGR is low, it is possible to increase the resistance between the node NDR5C and the VBGR to make the potential of the VBGR close to the target value. In this way, in the bandgap circuit of FIG. 6 as well, it is possible to adjust the potential of the VBGR.

As explained with reference to FIG. 1 to FIG. 6, in the past, various bandgap circuits (reference voltage circuit) able to adjust the output voltage have been proposed.

The circuit of FIG. 1 has the advantages of being simple in circuit configuration and being able to generate a reference voltage (bandgap voltage), but has the problem of a large effect by the offset voltage of the operating amplifier.

The circuit of FIG. 3 may adjust the bandgap voltage by the number of PNP transistors used, so even in the case where the offset voltage of the operating amplifier causes the VBGR potential to deviate from the design value, the bandgap voltage may be made to approach the target value.

However, if trying to increase the amount of adjustment of the bandgap voltage to adjust the bandgap voltage VBGR by the number of PNP transistors used, there are the problems that the number of the PNP transistors becomes greater and the area increases.

Further, by inserting the switches (SWD1 and SWU1 to SWU4) to the bases of the PNP transistors used and turning the switches ON, the number of the PNP transistors is adjusted, so the base current flows to the control switches (SWD1 and SWU1 to SWU4).

The product of the ON resistance of the switch and the flowing current becomes a voltage drop at the switch. The base potential is made to fluctuate. Further, if the base potential fluctuates, the bandgap voltage VBGR also changes. For this reason, to make the error due to the insertion of a switch as small as possible, it is preferable to make the base current smaller or make the ON resistance of the switch smaller.

If the current amplification rate of a PNP transistor is not sufficiently large, the value of the base current is small and, further, the effect of the ON resistance of the switch is small. However, the substrate PNP transistor generally used in the CMOS process (vertical direction transistor using source and drain diffusion layer of pMOS transistor as emitter, N-well as base, and P-substrate as collector) usually has a small current amplification rate.

For this reason, when produced by a standard CMOS process, it is preferable to make the ON resistance of a switch as small as possible. That is, to avoid the output voltage from fluctuating at the switch itself due to adjustment of the VBGR potential, the ON resistance of the switch has to be made smaller. This also invites an increase in the area of the switch.

The circuit of FIG. 5 may change the current mirror ratio to adjust the bandgap voltage. In the same way as the circuit of FIG. 3, there is the advantage that even when the VBGR potential has deviated from the design value due to the offset voltage of the operating amplifier, it is possible to make the bandgap voltage approach the target value.

However, in the circuit of FIG. 5, the accuracy of the magnitude of the current flowing through the transistors Q1 and Q2 is determined by the relative precision of the pMOS transistors determining the current. There is the new issue that the degree of match of devices of pMOS transistors becomes a factor in error of the output voltage VBGR.

Further, to improve the relative precision, it is preferable to produce MOS transistors by a certain size or more. This may also lead to an increase in area of the bandgap circuit.

The circuit of FIG. 6 may adjust the value of the resistance by switches to adjust the potential of the bandgap output VBGR. Due to this, even when the potential of the VBGR has deviated due to the offset voltage of the operating amplifier, it is possible to make the VBGR potential approach the target value.

However, in the circuit of FIG. 6, it is preferable to design the ON resistances of the switches to be sufficiently small. The areas of the switches therefore increase. Further, the ON resistances of the switches fluctuate due to the power source voltage and temperature, so unless the ON resistances of the switches are made smaller than the resistance values of the resistor devices, the potential of the VBGR itself will end up fluctuating due to the effect of fluctuation of the ON resistances of the switches.

That is, in the circuit of FIG. 6 as well, due to the flow of current to the switches, it is preferable to design the ON resistances of the switches sufficiently small. There was therefore the problem of inviting an increase in the area occupied.

Below, embodiments of the reference voltage circuit (bandgap circuit) and semiconductor integrated circuit will be explained in detail with reference to the attached drawings.

Figure 7:
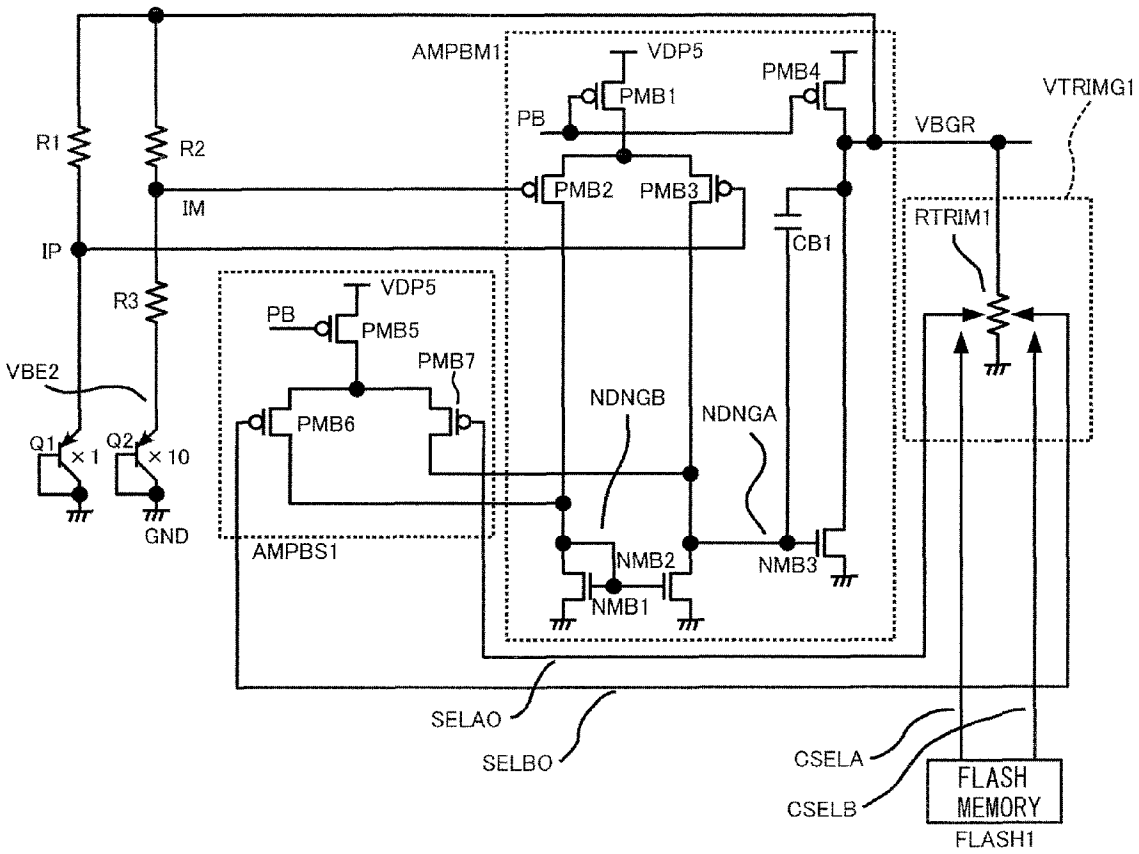
FIG. 7 is a circuit diagram illustrating a bandgap circuit of a first embodiment.

FIG. 7 is a circuit diagram illustrating a bandgap circuit of the first embodiment (BGR circuit). In FIG. 7, reference notation Qn (n is an integer) indicates a pnp bipolar transistor, Rn (n is an integer) indicates a resistor and its resistance value, GND indicates a GND terminal (0V), VDP5 indicates, for example, a 5V power source terminal, and, further, VBGR, for example, indicates a 1.2V output reference potential.

Further, reference notation PMBn (n is an integer) indicates a pMOS transistor, NMBn (n is an integer) indicates an n-channel type MOS transistor (nMOS transistor), while CB1 indicates a capacitor.

Furthermore, reference notation AMPBM1 indicates a main amplifier working the same way as the AMP1 of FIG. 1 (first amplifier), AMPBS1 indicates an offset adjustment-use auxiliary amplifier (second amplifier), and, further, SELAO and SELBO indicate input signals of the auxiliary amplifier.

Further, reference notations CSELA and CSELB indicate control signals of selectors which output SELAO and SELBO, FLASH1 indicates a flash memory on the same chip or on another chip, and, further, RTRIM1 indicates a resistor for trimming. Furthermore, reference notation VTRIMG1 indicates the circuit generating SELAO and SELBO, PB indicates a bias potential, and, further, VBE2, NDNGB, NDNGA, IM, and IP indicate internal nodes.

In the other figures as well, Qn (n is an integer etc.), Rn (n is an integer etc.), etc., unless indicated to the contrary, indicate the same contents. The numerals attached to BJT indicate the relative ratios of areas of the BJT (example of area ratio) and illustrate the same contents in the other figures as well. Note that, circuit devices and nodes etc. corresponding to the related circuit of FIG. 1 etc. are shown assigned the same device names and node names etc. Unless indicated to the contrary, the corresponding devices and nodes in the drawings are assigned the same names and overlapping explanations are avoided.

Next, the operation of the bandgap circuit of the first embodiment shown in FIG. 7 will be explained. In FIG. 7, Q1, Q2, R1, R2, R3, and the main amplifier AMPBM1 act as a bandgap circuit which outputs a 1.2V reference voltage VBGR similar to the related circuit of FIG. 1.

There is no difference between the related circuit of FIG. 1 and the circuit parts which output the 1.2V reference voltage of the circuit of the first embodiment of FIG. 7 (Q1, Q2, R1, R2, R3, and main amplifier AMPBM1). That is, the difference of the circuit of FIG. 1 and the circuit of FIG. 7 lies in the point of the output of the offset adjustment-use auxiliary amplifier AMPBS1 being coupled in parallel to the internal nodes NDNGB and NDNGA of the main amplifier AMPBM1.

While partially overlapping the explanation of FIG. 1, the operations of the transistors Q1 and Q2, resistors R1, R2, and R3, and main amplifier AMPBM1 will be explained. The action of the auxiliary amplifier AMPBS1 will be explained later. Here, the explanation will be given assuming the auxiliary amplifier does not affect the operation of the main amplifier.

Here, the transistors Q1 and Q2 are drawn as PNP transistors, but if pn junction devices having pn junctions (first and second pn junction devices), they may not be PNP transistors. Further, the resistors R1, R2, and R3 are drawn as resistor devices, but the devices may not be resistors so long as they are load devices.

Due to the feedback control of the main amplifier AMPBM1, the potentials of the IM and the IP match, so by designing the value of R1 and the value of R2 to, for example, 1:10, it is possible to design the current flowing through Q1 and the current flowing through Q2 to 10:1.

As explained in the explanation of the circuit of FIG. 1, by making the current flowing through Q1 10 times the current flowing through Q2 and making the emitter area of Q2 10 times the emitter area of Q1, the difference ΔVBE between Q1 and Q2 is expressed by, for example, the formula (13) and becomes about 120 mV or so at 300K:

$$\Delta VBE=(kT/q)\ln(100)=26\text{ mV}\times 4.6=120\text{ mV} \qquad \text{formula (13)}$$

Here, the potential difference across R3 becomes ΔVBE, so by amplifying ΔVBE to (R2/R3) and adding the result to VBE1, it is possible to generate the bandgap voltage VBGR (1.2V) in the same way as with the circuit of FIG. 1.

$$VBGR=VBE1+\Delta VBE(R2/R3) \qquad \text{formula (8)}$$

The main amplifier AMPBM1 is for example comprised of the pMOS transistors PMB1, PMB2, PMB3, and PMB4, the nMOS transistors NMB1, NMB2, and NMB3, and the capacitor CB1.

The main amplifier AMPBM1 illustrated in FIG. 7 forms a general two-stage amplifier. The PMB1 acts as a tail current source of the differential pair, while PMB2 and PMB3 act as differential input transistors.

NMB1 and NMB2 act as first-stage load transistors of the two-stage amplifier AMPBM1. PMB4 acts as a current source operating as a second-stage load of the two-stage amplifier AMPBM1, while NMB3 acts as a second-stage source ground amplification transistor and further CB1 acts as a phase compensation capacitor. Note that, PB is assumed to indicate the bias potential of the current source.

When the input conversion offset voltage of the main amplifier AMPBM1 is zero mV and the potentials of SELAO and SELBO are equal or when the input conversion offset voltage of the main amplifier AMPBM1 is zero mV and there is no auxiliary amplifier AMPBS1, the potentials of IM and IP become equal. However, in an actual integrated circuit, the input conversion offset voltage of the main amplifier AMPBM1, for example, has a value of about +10 mV to −10 mV and becomes a value different for each specimen.

Consider the case where when the offset voltage of the main amplifier AMPBM1 is a potential where the potential of IM is, for example, +10 my higher than the potential of IP, the feedback circuit of the main amplifier AMPBM1 is stable.

Here, first, assume that NMB1 and NMB2 have exactly the same characteristics and (the absolute value of) the threshold voltage Vth of PMB3 is a value 10 mV higher than (the absolute value of) the threshold voltage Vth of the PMB2.

Considered by the main amplifier AMPBM1 alone, when VBGR becomes 1.2V (in potential), the current flowing through the PMB4 minus the current flowing through the PNP transistor flows to the NMB3.

The bias potential PB of the PMB4 is generally set to an extent so that (the absolute value of) the gate-source voltage of the PMB4 slightly exceeds the threshold voltage Vth of the pMOS transistor, so here the explanation will be proceeded with assuming this.

The current flowing through the NMB3 becomes a value of about the same extent as the current flowing through the PMB4, so the potential of the gate voltage NDNGA of the NMB3 also has to be of an extent slightly over the threshold voltage Vth of the nMOS transistor.

Assuming that (the absolute value) of the threshold voltage Vth of PMB3 is a value of 10 mV higher than (the absolute value) of the threshold voltage Vth of PMB2, when the potential of IM is a potential +10 mV higher than the potential of IP, the currents flowing through the PMB2 and PMB3 become equal.

To simplify the explanation, if assuming that NMB1 and NMB2 have exactly the same characteristics, the currents flowing through the NMB1 and NMB2 are the same, so the gate voltages and drain voltages become the same. That is, when the potential of IM is a potential +10 mV higher than the potential of IP, the potential of NDNGA and the potential of NDNGB become the same potential of an extent slightly exceeding the threshold voltage Vth of the nMOS transistor.

Next, the action of the offset adjustment-use auxiliary amplifier AMPBS1 will be explained. The auxiliary amplifier AMPBS1 is comprised of the pMOS transistors PMB5, PMB6, and PMB7. The drains of the PMB6 and PMB7 forming a differential circuit are coupled to the internal nodes NDNGB and NDNGA of the main amplifier AMPBM1.

PMB5 acts as the tail current source of the differential circuits PMB6 and PMB7. To facilitate the explanation, the explanation will be given assuming the threshold voltages Vth of the PMB6 and PMB7 are the same.

The auxiliary amplifier AMPBS1 is provided as a circuit for adjusting the gate voltages SELBO and SELAO of the PMB6 and PMB7 and canceling out the offset voltage of the main amplifier AMPBM1.

When the potentials of SELBO and SELAO are equal, the currents flowing through the PMB6 and PMB7 are equal, so there is no effect on the conditions for making the potential of the NDNGA and the potential of the NDNGB with the main amplifier AMPBM1 alone. That is, if (the absolute value of) the threshold voltage Vth of the PMB3 becomes a value 10 mV higher than (the absolute value of) the threshold voltage Vth of the PMB2, the potential of IM becomes a voltage +10 mV higher than the potential of IP and the main amplifier AMPBM1 operates in that state.

Here, assume that the current of the PMB5 and the current of the PMB1 are equal and further that the sizes (W) of the PMB2, PMB3, PMB6, PMB7 are equal. (The absolute value of) the threshold voltage Vth of the PMB3 is larger than (the absolute value of) the threshold voltage Vth of PMB2 and it is hard for current to flow to the PMB3, so with the main amplifier AMPBM1 alone, in the state where the potential of IP is lower than IM, the potentials of NDNGB and NDNGA become equal.

With the main amplifier AMPBM1 alone, it is hard for the current to flow to the PMB3, so consider making the gate potential SELAO of the PMB7 of the auxiliary amplifier AMPBS1 a potential 10 mW lower than the gate potential SELBO of the PMB6. When the differential voltage of the gate potential of PMB7 and the gate potential of PMB6 is 10 mV, the current flowing through the PMB7 becomes one-half of the tail current IPMB5 of PMB5 plus a certain increase ΔI (IPMB5/2)+ΔI. The current flowing through the PMB6 becomes (IPMB5/2)−ΔI.

If making the gate potential SELAO of the PMB7 of the auxiliary amplifier AMPBS1 a potential 10 mV lower than the gate potential SELBO of the PMB6, the current of the PMB7 increases and the current of PMB6 decreases. Due to this, conditions where the currents flowing through the NMB1 and NMB2 become equal and the potentials of the NDNGB and NDNGA become equal are better than when considered by the main amplifier AMPBM1 alone in that the current flowing through the PMB3 becomes smaller than the current flowing through the PMB2 by ΔI.

When the current of PMB5 and the current of PMB1 are equal and, further, the sizes (W) of the PMB2, PMB3, PMB6, and PMB7 are equal, the condition whereby the current flowing through the PMB3 becomes smaller than the current flowing through the PMB2 by ΔI becomes the point of (the absolute value of (the effective gate voltage of the PMB3 becoming 10 mV larger than (the absolute value of) the effective gate voltage of the PMB2. (The absolute value of) the threshold voltage Vth of the PMB3 becomes a value 10 mV higher than (the absolute value of) the threshold voltage Vth of the PMB2, so the potential of IM and the potential of IP become equal due to the current of ΔI and the potentials of NDNGB and NDNGA become equal. As a result, VBGR becomes 1.2V (or so in potential).

That is, when in a situation where there is an input conversion offset and it is difficult for current to flow to either of the PMB2 or PMB3, it is possible to supply currents for compensating for this from the PMB6 and PMB7 so as to cancel out the offset voltage of the main amplifier AMPBM1 so that the circuit balances when the potential of IM and the potential of IP are equal. To control the currents of the PMB6 and the PMB7 so as to compensate for the unbalance of currents of PMB2 and PMB3, it is sufficient to make the gate potentials of the PMB6 and PMB7 different potentials and to make the gate potential of the transistor for carrying more current a potential lower than the other.

By this framework, it is possible to use the auxiliary amplifier AMPBS1 to cancel out the offset voltage of the main amplifier AMPBM1.

In the above explanation, the operation of the circuit was explained assuming that there is a difference of the threshold voltages Vth at just PMB2 and PMB3 and that the threshold voltages Vth of NMB1 and NMB2 completely match, but in an actual circuit, the causes of offset voltage include mismatch of NMB1 and NMB2 in addition to mismatch of PMB2 and PMB3.

The case where the threshold voltages Vth of the PMB2 and PMB3 match and the threshold voltage Vth of the NMB1 is larger than the threshold voltage Vth of the NMB2 will be explained.

By just the main amplifier AMPBM1, when the potential of the IM and the potential of the IP are equal, the currents which PMB2 and PMB3 try to carry are equal. If the threshold voltage Vth of the NMB2 is smaller, the current which the NMB2 tries to carry is larger than the current which the NMB1 tries to carry. For this reason, the potential of the node NDNGA becomes lower. The current of the NMB3 becomes smaller, so the potential of VBGR rises. If the potential of the VBGR rises, the change of the potential of IP is small, so the potential of IM becomes higher than the potential of IP. In this way, even if the threshold voltages Vth of NMB1 and NMB2 do not match, an input conversion offset occurs. A current easily runs through the NMB2, so it is preferable to run a larger current to the PMB3. The potential of IP becomes lower than the potential of IM in the operation. In such a case as well, in the final analysis, it is possible to increase the current of PMB7 to supply a current which excessively flows to the NMB2 and thereby cancel out the input conversion offset as seen from the IP and IM nodes.

As explained above, there are various factors causing offset of the main amplifier AMPBM1, but it is possible to supply currents which correct the unbalance occurring at NDNGB and NDNGA from the PMB6 and PMB7 of the auxiliary amplifier AMPBS1 so as to make the input conversion offset of the main amplifier AMPBM1 approach zero. Due to this, the advantageous effect is obtained of enabling improvement of the precision of the potential of the VBGR.

In the above explanation, to facilitate understanding, the current of PMB1 and the current of PMB5 are assumed to be equal and the gate widths W of PMB6, PMB7, PMB2, and PMB3 are deemed equal. However, if making the current of the PMB5 smaller than the current of the PMB1, it is preferable to increase the difference in the gate voltages given to the PMB6 and PMB7. That is, by giving a potential difference of, for example, 20 mV to cancel out the 10 mV offset voltage of the main amplifier, similar advantageous effects may be obtained.

Further, even if making the sizes of the PMB6 and PMB7 smaller than the PMB2 and PMB3, the gate potential difference of the AMPBS1 larger than the offset voltage of AMPBM1 is used for canceling out the offset. That is, when it is preferable to cancel out or adjust to zero the offset voltage by a higher resolution, it is also possible to make the current or size of the AMPBS1 smaller than the main amplifier.

Furthermore, the current of the AMPBS1 and the size of the W may be made larger than the current of the main amplifier and the size of the W. In this way, the size and current of the main amplifier AMPBM1 and the current and size of the auxiliary amplifier AMPBS1 clearly may be freely designed in a range.

Next, the method of generation of the gate voltage of the auxiliary amplifier AMPBS1 will be explained. First, the offset voltage of the main amplifier AMPBM1 is hopefully a value of from +10 mV to −10 mV or so as already explained.

In this regard, it is learned from the circuit configuration that there is an offset voltage in the auxiliary amplifier AMPBS1 itself. If the PMB6 and PMB7 are mismatched in threshold voltages Vth, even if the gate potentials SELBO and SELAO of the PMB6 and PMB7 are the same potentials, the currents flowing through the PMB6 and PMB7 become different values.

Therefore, it is sufficient to give the SELBO and SELAO a potential difference so that the input conversion offset of the main amplifier AMPBPM1, as seen from the IP and IM nodes, including the offset voltage of the auxiliary amplifier AMPBS1 generated at PMB6 and PMB7, becomes zero.

For example, if configuring the circuit so as to enable the potential difference of SELBO and SELAO to be adjusted by 1 mV increments from −20 mV to +20 mV, it is possible to adjust the offset voltage of the main amplifier AMPBM1 to about zero. However, if making the increments for voltage adjustment and resolution 1 mV, residual offset of about 1 mV remains.

The temperature dependency and power source voltage dependency of the offset voltage are hard to predict and further may take various forms. For example, there are cases where the offset voltage becomes larger if the temperature rises and cases where the offset voltage becomes smaller if the temperature rises.

Furthermore, the relationship between the power source voltage and the offset voltage may also be positive or negative. Under such conditions, to effectively cancel out the offset voltage as much as possible, it is preferable to assume an intermediate case of positive and negative dependency where the offset is not dependent on the temperature or power source voltage and generate the gate voltages SELBO and SELAO for canceling out the offset voltage.

As a method of generation of a gate voltage not dependent much on the power source voltage or temperature along with this object, the method of dividing the bandgap circuit output VBGR for use is employed.

That is, the potentials of IP and IM are about 0.6V, so to match the operating conditions of PMB2, PMB3, PMB6, and PMB7 as much as possible, the potential of VBGR is divided into about ½ for use as the potential. The VTRIMG1 of FIG. 7 works as a circuit for generating gate voltages SELAO and SELBO for adjusting the offset voltage of the main amplifier AMPBM1 to zero.

It is possible to divide the potential of VBGR by the resistor RTRIM1 and use selectors to select the desired divided voltage from the plurality of divided voltages obtained. The selected outputs SELAO and SELBO are supplied as gate potentials of the PMB6 and PMB7 of the auxiliary amplifier AMPBS1. CSELA and CSELB indicate control signals of selectors for outputting SELAO and SELBO. These CSELA and CSELB are used to determine the selected potential.

The circuit of the configuration such as VTRIMG1 of FIG. 7 generates gate voltages SELAO and SELBO for adjusting the offset voltage to zero. Due to this, it is possible to realize characteristics where the potential difference of the gate voltages SELBO and SELAO for canceling out the above-mentioned offset voltage is not dependent on the temperature or power source voltage.

The relationship between the flash memory FLASH1 and the potentials of the control signals CSELA and CSELB and gate voltages SELAO and SELBO will be briefly explained. The operations of these parts will be explained in detail later.

The bandgap circuit is, for example, used as a circuit for generating the reference voltage of the regulator circuit, so may operate from right after turning on the 5V power source VDP5.

In this regard, when starting the bandgap circuit of FIG. 7, the internal voltage VDD generated by the regulator circuit still will not become the given potential (for example, 1.8V) but will be 0V. Note that, assume that the settings of the gate voltages SELBO and SELAO for canceling out the offset voltage of the main amplifier AMPBM1 are stored in the nonvolatile memory FLASH1 on the chip.

Right after turning on the power source VDP5, the internal voltage VDD is 0V, so the logic circuit which operates by the internal voltage also operates as a memory FLASH1. For this reason, right after turning on the power source, the offset adjustment-use auxiliary amplifier AMPBS1 may be given a gate voltage for canceling out the offset voltage of the main amplifier AMPBM1.

Even under this state, for example, if configuring the circuit so that the potentials of SELBO and SELAO right after input of VDP5, the potential includes error due to the offset voltage, but it is possible to design the potential of VBGR to become a potential of about 1.2V.

In the state including error due to the offset voltage of the main amplifier AMPBM1, the potential of VBGR stabilizes. If the potential of the internal voltage VDD becomes a voltage of about 1.8V due to the regulator circuit, the state becomes one in which the flash memory FLASH1 may be accessed.

When reading out the flash memory FLASH1, the settings of the gate voltages SELBO and SELAO for canceling out the offset voltage of the main amplifier are read out from the FLASH1 and the offset voltage of the main amplifier AMPBM1 is cancelled. Due to this, the potential of the VBGR changes to a potential closer to the ideal value. Furthermore, the potential of the VDD also changes to a value closer to the given design value.

As illustrated in FIG. 7, the nonvolatile memory FLASH1 stores settings of the gate voltages SELBO and SELAO for canceling out the offset voltage of the main amplifier AMPBM1. Further, after the power is turned on, it is possible to set the potentials of SELBO and SELAO at certain fixed values, generate the potential of the VBGR, and operate the regulator circuit so as to generate the internal voltage VDD.

After this, by reading out the gate voltage settings for canceling the prestored offset voltage from the nonvolatile memory and by canceling the offset voltage of the main amplifier, it becomes possible to request operation right after turning on the power and improve the precision of the bandgap voltage after startup.

Figure 8:
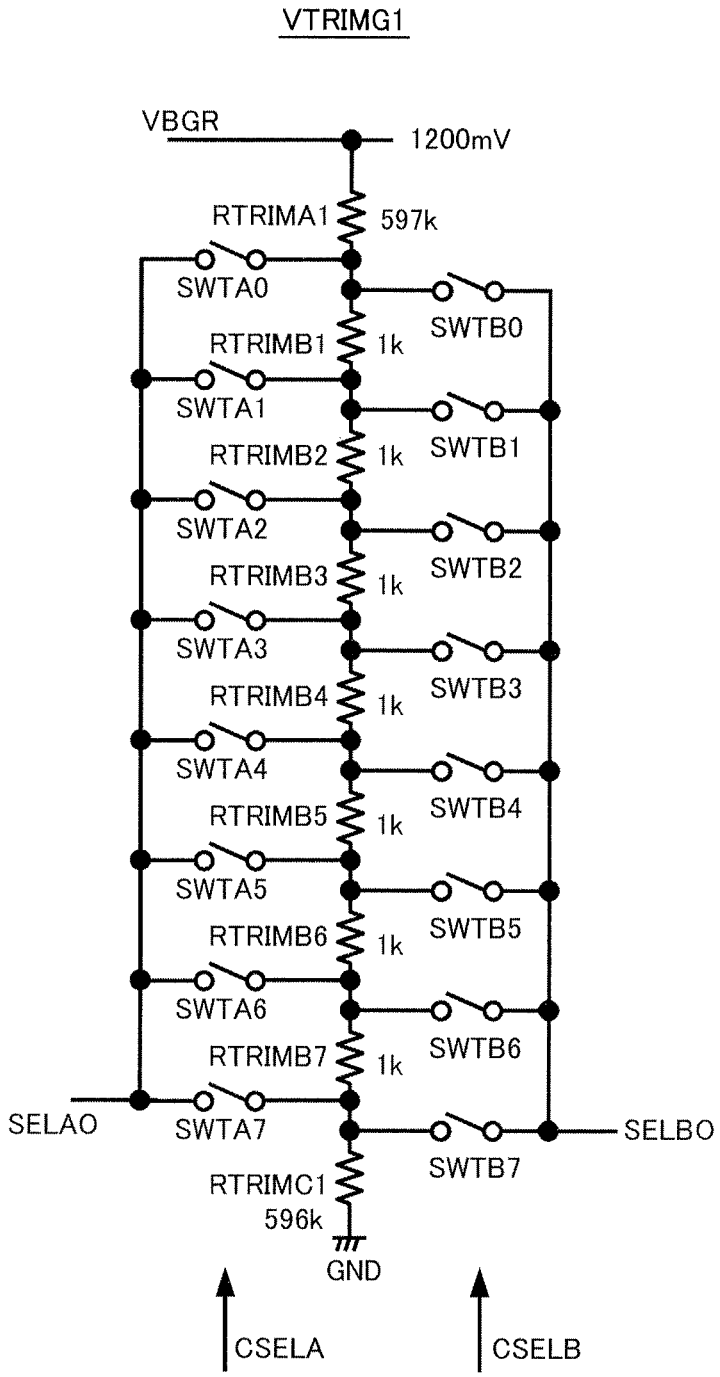
FIG. 8 is a circuit diagram illustrating one example of the offset adjustment voltage generation circuit in the bandgap circuit of FIG. 7.

FIG. 8 is a circuit diagram illustrating an example of the offset adjustment voltage generation circuit (VTRIMG1) in the bandgap circuit of FIG. 7.

In FIG. 8, reference notation VBGR indicates the bandgap output potential, RTRIMA1, RTRIMB1 to RTRIMB7, and RTRIMC1 indicate resistors, and, further, SWTA0 to SWTA7 and SWTB0 to SWTB7 indicate switches.

Furthermore, reference notations SELAO and SELBO indicate the voltage outputs for adjusting the offset voltage of the main amplifier to zero, GND indicates the GND terminal (0V), and CSELA and CSELB indicate control signals for selectors for outputting the gate voltages SELAO and SELBO.

The numerals attached to the resistors indicate examples of the resistance values of the resistors. The circuit devices and nodes etc. corresponding to the circuit of FIG. 7 are assigned the same device names and node names. Unless indicated otherwise, corresponding devices and nodes in the figures will be assigned the same names to avoid overlapping explanations.

Next, the operation of the circuit of FIG. 8 will be explained. As explained in the explanation of FIG. 7, the potential of the VBGR of FIG. 7 is divided by the resistors and the desired divided voltage is selected from the plurality of divided voltages by the selectors. The switches SWTA0 to SWTA7 (first switch group) act as selectors for obtaining the output SELAO, while the switches SWTB0 to SWTB7 (second switch group) act as selectors for obtaining SELBO.

The selected output voltages SELAO and SELBO are supplied as the gate potentials of the transistors PMB6 and PMB7 of the auxiliary amplifier AMPBS1 of FIG. 7. Here, reference notations CSELA and CSELB indicate control signals of selectors for outputting SELAO and SELBO. The control signals CSELA and CSELB determine the potentials selected.

FIG. 8 illustrates an example where the total of the resistors RTRIMA1, RTRIMB1 to RTRIMB7, and RTRIMC1 (resistor group) becomes 1200 kohm. That is, the resistance value of RTRIMA1 is, for example, 597 kohm, the resistance values of RTRIMB1 to RTRIMB7 are 1 kohm, and the resistance value of RTRIMC1 is 696 kohm.

The 1200 mV (or so) VBGR voltage is divided by the total 1200 kohm resistor ladder. At this time, the potential difference across the 1 kohm resistors becomes 1 mV. Further, the point where a 600 mV potential is obtained becomes the potential of the node selected by SWTA3 and SWTB3.

That is, the potential which is selected at SWTA7 becomes 596 mV or a potential 1 mV higher toward SWTA0. Further, for example, due to the 3-bit signal CSELA, by turning on just one switch among SWTA0 to SWTA7, it is possible to generate a potential from 596 mV to 603 mV at 1 mV increments. Note that, the same is also true for the potential which is selected by SWTB0 to SWTB7.

In this way, by using a circuit such as illustrated in FIG. 8, it is possible to realize the function of the offset adjustment voltage generation circuit VTRIMG1 of FIG. 7. Note that, in FIG. 8, for simplification, the example of use of a 3-bit signal CSELA for generation of SELAO was illustrated, but when the range of adjustment may be broad, it is clear that it is possible to use a similar idea to realize a 4-bit or 5-bit configuration. Further, in FIG. 8, resistance values were illustrated as simple examples, but when 0.5 mV increment adjustment signals SELAO and SELBO are used, a similar idea may be used to set the resistance values.

By employing the configuration such as in FIG. 8, it is possible to prevent DC current from flowing to the SWTA0 to SWTA7 or SWTB0 to SWTB7. The reason is that SELAO and SELBO are input to the gate electrodes of the transistors. These are insulated in terms of direct current.

From this, the ON resistances of SWTA0 to SWTA7 and SWTB0 to SWTB7 do not affect the adjustment operation of the offset voltage of the main amplifier. It is therefore possible to avoid the undesirable phenomenon, such as seen in related circuits, of the ON resistances of the switches affecting the output voltage.

As explained above, by combining an offset adjustment-use auxiliary amplifier having a gate electrode of a MOS transistor as an input with an offset adjustment-use voltage generation circuit using a resistance division circuit as FIG. 8, it is possible to avoid the ON resistances of the switches affecting the output voltage.

The method of generation of the input potential of the auxiliary amplifier will be explained in detail using FIG. 8. The advantageous effect of improvement of the precision when using the circuit of FIG. 8 and the circuit of FIG. 7 will be studied in detail while compared with the related circuit.

As explained with reference to FIG. 2, in the related circuit of FIG. 1, for example, the value of VBGR was the ideal value plus the offset voltage multiplied by (about) 6. If assuming a 10 mV offset voltage, the value of VBGR became a value of about 1200 mV±60 mV.

On the other hand, in the circuit of the first embodiment of FIG. 7, for example, if configuring the circuit so as to enable the potential difference of SELBO and SELAO to be adjusted in 1 mV increments from −20 mV to +20 mV, the residual offset becomes about 1 mV. Therefore, the value of VBGR may be improved to a value of about 1200 mV±6 mV. For example, it is possible to make the error due to offset 1/10th that of the related circuit of FIG. 1.

In the related circuit of FIG. 3, the number of the PNP transistors carrying current are controlled to change the current which flows per individual PNP transistor and adjust the bandgap voltage. However, since the number of PNP transistors carrying current is controlled, the following inconveniences occur depending on the number of the PNP transistors provided.

To change the ratio of the current densities, the number of PNP transistors is increased by just one as a test. The current ratio of the PNP transistors is 10:1 (Q1:Q2), the area ratio of the PNP transistors is 1:10 (Q1:Q2), and, further, R2/R3=5 times. As a result, $$\Delta VBE=(kT/q)\ln(10\times10)=26\text{ mV}\times4.605=119.7\text{ mV and}$$

$$VBGR=VBE1+\Delta VBE\times(R2/R3)=600\text{ mV}+119.7\text{ mV}\times5=1198.6\text{ mV}$$

Here, if making the current ratio 10:1 (Q1:Q2), making the area ratio of the PNP transistors 1:11, further making R2/R3=5 times, and increasing the number of PNP transistors by just one, the result is $$\Delta VBE=(kT/q)\ln(10\times 11)=26\text{ mV}\times 4.700=122.2\text{ mV and}$$

$$VBGR=VBE1+\Delta VBE\times(R2/R3)=600\text{ mV}+122.2\text{ mV}\times 5=1211\text{ mV}$$

In this way, by just increasing the number of PNP transistors carrying a current, the bandgap voltage ends up increasing by as much as 13 mV. On the other hand, if trying to finely adjust the ratio of the PNP transistors, the number of PNP transistors prepared in advance ends up becoming greater, so the area of the bandgap circuit increases.

As opposed to this, in the circuit of the first embodiment of FIG. 7, if the input offset is reduced to ±1 mV by the offset adjustment-use auxiliary amplifier, the bandgap voltage is improved to ±6 mV. Furthermore, the amount of increment of the adjustment-use input signals is the bandgap voltage divided by the resistors, so if making the amount of increment of the voltage division finer, it is possible to change the output voltage by finer increments. Further, the total value of the resistance is determined by the branch currents supplied, so if considering the current as fixed, even if generating adjustment-use input signals in finer increments, the area will not increase.

Further, in the related circuit of FIG. 5, the devices supplying currents to the transistors Q1 and Q2 are made pMOS current mirrors. The ratio of the currents depends on the extent of match of the characteristics of the MOS transistors, so there is an increase of new error factors of the extent of match of the characteristics of the pMOS transistors.

To improve the relative precision, it is preferable to produce the MOS transistors by a certain size or larger. This leads to an increase of area of the bandgap circuit.

Here, when comparing resistor devices and pMOS transistors, transistors have more parameters to be controlled. In terms of matching (degree of match of characteristics of devices to be matched), transistors are disadvantageous compared with resistors in many cases.

The extent of match of characteristics of resistors is usually better than the extent of match of MOS transistors, so the related circuit of FIG. 5 is disadvantageous compared with the circuit of the first embodiment of FIG. 7 in terms of precision to the extent of the error of the current mirror circuit.

That is, the circuit of FIG. 5 uses match of the pMOS current mirrors, while the circuit of the first embodiment of FIG. 7 has the current determined by just the ratio of resistances, so there is the advantageous effect that the precision of the output voltage may be improved.

The related circuit of FIG. 6 trims (changes) the resistance values of the resistors used for the BGR circuit by the switches and makes the VBGR potential approach the ideal value 1.2V. The On resistances of the switches (ON resistances) also affect the VBGR potential, so under conditions where the process conditions (production conditions) and the temperature, voltage, and other operating conditions cause the ON resistances of the switches (ON resistances) to increase, the precision of the VBGR potential also depends on the ON resistances of the switches. To avoid this, it is preferable to lower the ON resistances of the switches. The sizes (areas) of the switches therefore increases.

In the circuit of the first embodiment of FIG. 7, a switch for control for trimming is coupled to the gate input of the MOS transistor of the offset adjustment-use auxiliary amplifier, so almost no current flows. Due to this, the gate voltage which is input to the auxiliary amplifier almost does not shift due to the ON resistance of the switch.

Figure 9:
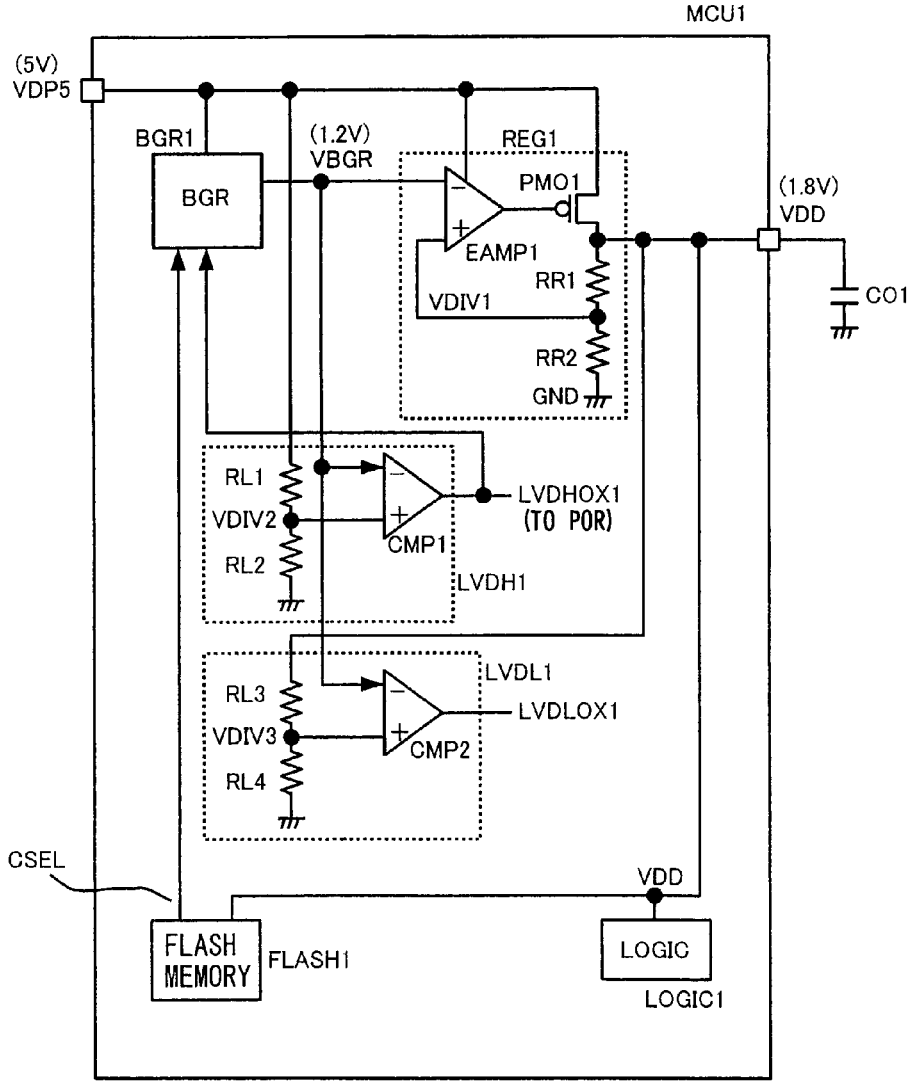
FIG. 9 is a block diagram illustrating one example of a microcontroller mounting a bandgap circuit.

FIG. 9 is a block diagram illustrating one example of a microcontroller (MCU) mounting a bandgap circuit (BGR).

In FIG. 9, reference notation BGR1 indicates a bandgap circuit, VDP5 indicates, for example, a 5V plus power source, GND indicates a 0V potential, REG1 indicates a regulator circuit, and, further, LVDH1 indicates a low voltage detection circuit for monitoring the voltage of the 5V power source.

Further, reference notation VDD indicates, for example, a 1.8V power source voltage generated at the regulator circuit, LVDL1 indicates a low voltage detection circuit for monitoring the potential of VDD, LOGIC1 indicates a logic circuit which operates using VDD as the power source, and, further, MCU1 indicates a microcontroller.

Furthermore, reference notation PMO1 indicates a pMOS output transistor, EAMP1 indicates an error amplifier of the regulator circuit, RR1 and RR2 indicate resistors, VDIV1 indicates the output of a voltage division circuit for dividing the voltage by RR1 and RR2, and, further, CO1 indicates a stabilization capacitor.

Further, reference notations RL1 and RL2 indicate resistors forming a voltage division circuit for dividing the voltage of VDP5, VDIV2 indicate divided outputs obtained by voltage division by the RL1 and RL2, and, further, RL3 and RL4 indicate resistors forming a voltage division circuit for dividing the voltage of VDD.

Furthermore, VDIV3 indicates a divided output obtained by voltage division by the RL3 and the RL4, CMP1 and CMP2 indicate comparator circuits, LVDHOX1 indicates an output of LVDH1, LVDLOX1 indicates an output of the LVDL1, and, further, FLASH1 indicates a flash memory. Further, CSEL indicates setting data for offset adjustment which is read from the flash memory.

Note that, unless specifically indicated to the contrary, device names starting with R (R*) indicate resistors, device names starting with PM (PM*) indicate pMOS transistors, and, further, device names starting with C (C*) indicate capacitors.

In FIG. 9, the bandgap circuit BGR1 is controlled by the output LVDHOX1 of the LVDH1. This, for example, as explained later with reference to FIG. 14, uses LVDHOX1 as the power on reset (POR) signal for controlling the potentials of SELBO and SELAO to certain fixed values (for example, equal potentials) when turning on the power.

FIG. 9 illustrates an example of the circuit in the case of using the 1.2V bandgap output VBGR of the circuit of the first embodiment of FIG. 7 to form the regulator circuit and low voltage detection circuit. By making the BGR1 of FIG. 9 the circuit of the first embodiment of FIG. 7, it is possible to use a high precision bandgap voltage. As a result, the precision of the output voltage of the regulator circuit rises and the precision of the detection voltage of the low voltage detection circuit may be raised.

Below, the operations of the different parts of the circuit will be briefly explained. The regulator circuit REG1 supplies the logic circuit LOGIC1 inside of the microcontroller MCU1 with, for example, a 1.8V power source voltage. The error amplifier EAMP1, the PMO1, and the voltage division circuits RR1 and RR2 act as a feedback circuit so that the potentials of the VBGR and VDIV1 match.

Further, the potential of VDIV1 and the potential of VBGR match, so if designing the ratio of RR1 and RR2 to, for example, 1:2, the potential of VDD is held at a constant value of 1.8V (more precisely, the potential of VBGR×1.5). Note that, CO1 acts as a capacitor provided outside of the chip for stabilization of the potential of VDD. If the precision of the potential of the VBGR is improved, the precision of the output potential VDD of the regulator circuit is also improved.

The LVDL1 of FIG. 9 acts as a low voltage detection circuit for monitoring the power source voltage of the VDD. RL3 and RL4 divide the potential of VDD. The divided voltage is compared with the reference voltage VBGR to detect if VDD is lower or higher than the given voltage.

When, due to some sort of situation, the potential of the VDD becomes smaller than a prescribed value, this is detected and, for example, this is often used for an interrupt or reset.

For example, if designing RL3 and RL4 to 1:3, the potential of the VDIV3 becomes ¾ of the VDD, so by making the VBGR the reference potential and determining the level of the potential of the VDIV3, it is possible to determine if the VDD is higher or lower than 1.6V.

That is, for example, when the potential of the VDIV3 is lower than VBGR, LVDLOX1 becomes "L". This is used as a signal meaning that VDD is lower than 1.6V. If the precision of the potential of the VBGR is improved, the precision of the potential which is judged at LVDLOX1 is also improved.

The LVDH1 of FIG. 9 acts as a low voltage detection circuit for monitoring the voltage of the 5V power source VDP5. For example, when mounting an AD conversion circuit which preferably operates by a 3.6V or more power source voltage and monitoring a power source voltage of a 5V power source by an LVDH1 for this purpose, sometimes a circuit such as the LVDH1 is used.

The RL1 and RL2 are used to divide the potential of the VDP5, the divided voltage is compared with the reference voltage VBGR, and it is detected if the VDP5 is lower than or higher than a given voltage.

When, due to some sort of situation, the potential of the VDP5 becomes smaller than a prescribed value, this is detected and, for example, an interrupt or reset becomes possible.

For example, if designing RL1 and RL2 to 2:1, the potential of the VDIV2 becomes ⅓ of the potential of VDP5, so by assuming the VBGR as the reference potential and determining the level of the potential of the VDIV2, it is possible to learn if the VDP5 is higher or lower than 3.6V.

That is, for example, when the potential of VDIV2 is lower than VBGR, LVDHOX1 becomes "L". This may be used as a signal meaning that the VDP5 is lower than 3.6V.

When judging whether the potential of VDP5 is higher or lower than 3.6V, a higher precision of the reference voltage is often desired in the reference voltage for judging 3.6V.

For example, 5% of 3V becomes 150 mV and 5% of 4V becomes 200 mV. When the absolute value of the voltage to be judged is large, if the error of the reference voltage is large, the absolute value of the error may become an unavoidably large value.

The precision of the voltage division of the voltage division circuits RL1 and RL2 is assumed to be sufficiently good (this may actually be assumed in many cases). At this time, the precision of judgment of the voltage of VDP5 is mainly determined by the precision of the reference voltage.

When dividing the potential of VDP5 into ⅓ and judging the potential of VDP5 compared with VBGR, for example, when the error of VBGR is 1.2V±5%, that is, 1.2V±60 mV, the precision in the case of judging 3.6V becomes 3.6V±5%, that is, 3.6V±180 mV.

Due to such reasons, in a low voltage detection circuit, by adopting the configuration such as in FIG. 9, the advantageous effect is obtained that it is possible to improve the precision of the low voltage detection circuit. That is, by configuring the microcontroller such as in FIG. 9, it is possible to realize a regulator circuit and low voltage detection circuit making use of the advantages of the BGR circuit of FIG. 7 and the improvement of precision.

To use the BGR circuit (bandgap circuit) of FIG. 1 to judge, for example, a 3.6V voltage, the range of detection of 3.6V actually becomes 3.6V-180 mV to 3.6V+180 mV. Furthermore, for example, it is possible to reliably make the operation of the AD conversion circuit stop at 3.42V. Further, the voltage at which the AD circuit may be reliably used becomes a voltage higher than 3.78V.

Assume that the error of the BGR circuit of the first embodiment of FIG. 7 explained above is 1.2V±2%. If trying to control the operation and stopping of the AD conversion circuit by LDVH1 by the configuration of the circuit of FIG. 9, the precision of LVDH1 is improved, so, for example, to judge a voltage of 3.6V, the range of detection of 3.6V actually becomes 3.6V-72 mV to 3.6V+72 mV. That is, for example, it is to reliably make the operation of the AD conversion circuit stop at 3.528V. The voltage at which the AD circuit may be reliably used becomes a voltage higher than 3.672V.

That is, when the precision of the low voltage detection circuit is poor and using the BGR circuit of FIG. 1 to judge the voltage, even if trying to judge 3.6V, the minimum voltage of judgment becomes 3.42V and the maximum becomes 3.78V. For this reason, when using the AD conversion circuit for control, the AD conversion circuit has to operate by the minimum voltage 3.42V. Further, if the power source voltage does not exceed 3.78V, use may not be possible.

By using the VBGR of the first embodiment of FIG. 7 and improving the voltage detection precision of LVDH1, for example, the minimum voltage for judgment becomes 3.528V and, further, the maximum becomes 3.672V. For this reason, there is no longer to design the AD conversion circuit to operate at a lower voltage than used and, further, use becomes possible from a voltage closer to the minimum operable voltage.

As explained above, it is possible to use the VBGR of the first embodiment of FIG. 7 to improve the voltage detection precision of the low voltage detection circuit which detects a high potential. Due to this, the advantageous effect is also obtained that it is possible to ease the demands on the operating voltage to the circuit covered which is attempted to be control.

In this way, the bandgap circuit of the first embodiment provides an auxiliary amplifier AMPBS1 in addition to the operating amplifier present in a bandgap circuit (main amplifier AMPBM1). Due to this, it is possible to reduce the offset voltage of the operating amplifier and achieve a higher precision of the output voltage.

The auxiliary amplifier AMPBS1 has a tail current source PMB5 and a differential pair PMB6 and PMB7. The load transistors NMB1 and NMB2 are shared with the main amplifier AMPBM1. Note that, unless specifically indicated otherwise, device names starting with NM (NM*) indicate nMOS transistors.

As illustrated in FIG. 7, the input signals SELAO and SELBO of the auxiliary amplifier AMPBS1 are made potentials obtained by dividing the output voltage VBGR of the bandgap circuit by resistor devices. Right after turning on the power, the plus side and minus side potentials SELAO and SELBO of the auxiliary amplifier are made the same potential.

In this state, the low voltage detection circuit (FIG. 9, LVDH1) and regulator circuit (FIG. 9, REG1) are operated and the core power (FIG. 9, VDD) for supply to the internal logic circuit (FIG. 9, LOGIC1) and nonvolatile memory (FIG. 9, FLASH1: FLASH macro) is raised.

After the core power source (FIG. 9, VDD) becomes a given value, for example, about 1.8V, the settings for canceling the offset of the operating amplifier written in advance are read out from the nonvolatile memory. The settings are used to adjust the plus side and minus side potentials (FIG. 7, SELAO and SELBO) to the auxiliary amplifier and change the potential of the VBGR to a value closer than the ideal value.

That is, the reference voltage circuit of the first embodiment provides an auxiliary amplifier in addition to the main amplifier and may cancel the offset voltage of the main amplifier by adjusting the input voltage of the auxiliary amplifier.

Further, the input signals SELAO and SELBO of the auxiliary amplifier are made the output voltage VBGR of the bandgap circuit divided by the resistor devices, so it becomes possible to generate auxiliary amplifier input signals not very dependent on temperature. Furthermore, since it is possible to make the potential of the input signal of the auxiliary amplifier and the potential of the input signal of the main amplifier close potentials, it is also possible to reduce the effects of the difference of the operating point of the auxiliary amplifier and operating point of the main amplifier.

Here, when storing the settings of the auxiliary amplifier inputs for canceling the offset voltage in a nonvolatile memory etc., it is not possible to read out the settings right after turning on the power or when turning on the power (except when using fuses etc. to store the information).

For this reason, right after turning on the power, by making the plus side and minus side potentials SELAO and SELBO of the auxiliary amplifier the same potential (corresponding to settings with no offset adjustment), it is possible to avoid the inputs of the auxiliary amplifier from being set to unpredictable values.

Due to this, from right after turning on the power, it becomes possible to obtain a bandgap output potential by a precision of voltage of about the same extent as the bandgap circuit of FIG. 1 to FIG. 6 not adjusting offset.

Further, the bandgap output is obtained by a time delay, from right after turning on the power, of the same extent as a related circuit. Due to this, the wait time until stabilization of the output potential VDD of the regulator circuit will also not increase.

Furthermore, after the VDD stabilizes and the nonvolatile memory may be read out from, the settings for adjusting the VBGR stored in advance are read out from the nonvolatile memory to set the auxiliary amplifier inputs.

Due to this, it is possible to cancel the offset of the operating amplifier (main amplifier) and improve the precision of the voltage of VBGR. Note that, it is also possible to similarly improve the precision of the output voltage of the regulator circuit and the precision of the detection voltage of the low voltage detection circuit.

Further, by storing the setting information for the adjustment of the VBGR in a flash memory or other nonvolatile memory, it is possible to obtain the effect of enabling the user to later readjust the potential of the VBGR in the state closer to the usage conditions.

Figure 10:
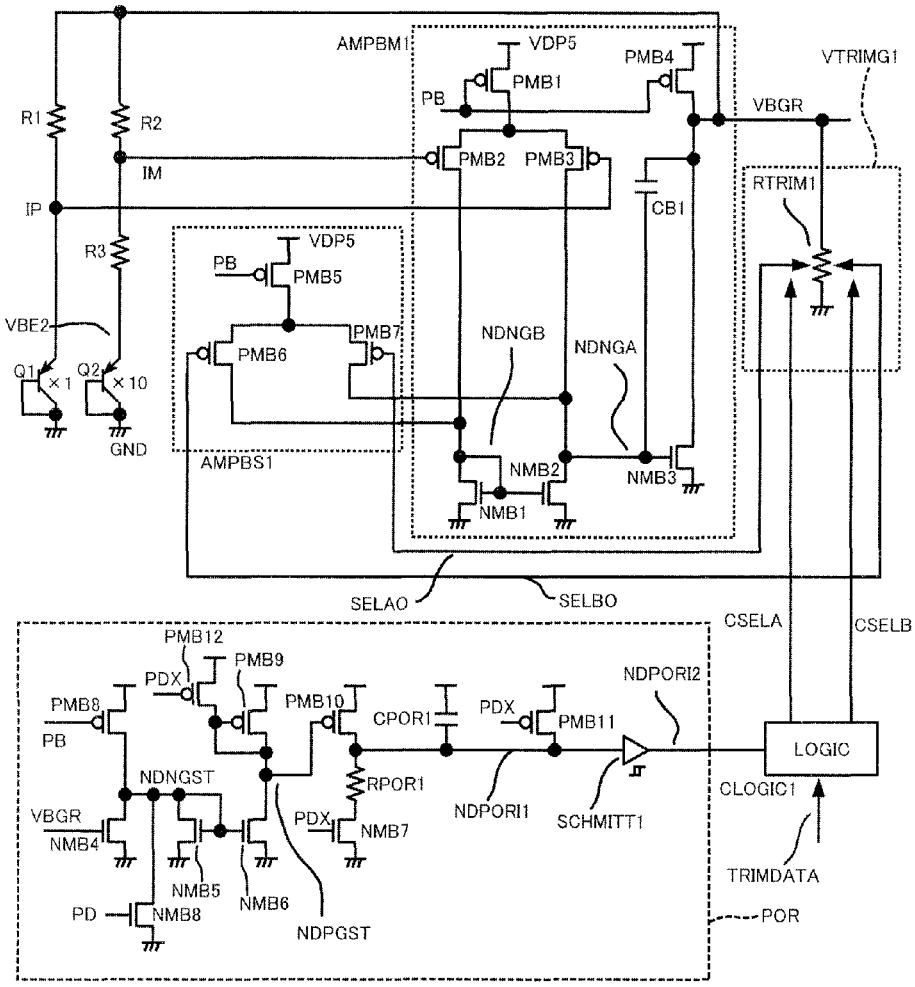
FIG. 10 is a circuit diagram illustrating a bandgap circuit of a second embodiment.

FIG. 10 is a circuit diagram illustrating a bandgap circuit of a second embodiment. This combines a dedicated power on reset circuit with the circuit of the first embodiment of FIG. 7. Further, this power on reset circuit is used to control the control circuit CLOGIC1 for selecting SELBO and SELAO. In FIG. 10, reference notation POR indicates the power on reset circuit.

Parts where the circuits of FIG. 7 and FIG. 10 differ will be explained. Circuit devices and nodes etc. corresponding to FIG. 7 are shown assigned the same device names and node names. The functions and operations of the parts given the same names were explained as parts corresponding to FIG. 7, so explanations will be omitted.

In FIG. 10, reference notation PMBn (n is an integer) indicates a pMOS transistor, NMBn (n is an integer) indicates an nMOS transistor, and PD indicates a power down signal which reduces the power when "H (high level)".

Further, reference notations NDNGST, NDPGST, and NDPORI1 indicate nodes inside the power on reset circuit POR, NDPORI2 indicates the output of the POR, RPOR1 indicates a resistor, and CPOR1 indicates a capacitor.

Furthermore, reference notation PDX indicates a power down signal which reduces the power at the "L (low level)", while SCHMITT1 indicates the Schmitt trigger circuit of the non-inverted output. Further, TRIMDATA indicates data for zero adjustment of the offset voltage which is read out from the flash memory etc.

The power on reset circuit POR has transistors PMB8 to PMB12 and NMB4 to NMB8 and the Schmitt trigger circuit SCHMITT1. Right after the rise of the power source VDP5, NDPORI2 is made the "H (high)" level, then when the potential of VBGR rises, NDPORI2 is made the "L (low)" level.

The control circuit CLOGIC1, when turning on the 5V power source VDP5, utilizes the output NDPORI2 of the POR to, for example, initialize the CSELA and CSELB so that the potentials of the gate voltages SELAO and SELBO of the transistors PMB7 and PMB6 become equal potentials.

The CLOGIC1 has to operate at a time before the above-mentioned regulator circuit REG1 of FIG. 9, so is made a circuit which operates by a 5V power source VDP5. After the regulator circuit REG1 generates VDD and the value of VDD stabilizes, for example, how to set the CSELA and CSELB is set in accordance with the data TRIMDATA read out from the flash memory (not shown).

Note that, in FIG. 10, the flash memory is not illustrated, but the control signals CSELA and CSELB for offset adjustment of the main amplifier are initialized when turning on the power by the POR, then the nonvolatile memory is utilized to adjust the offset as explained above.

The operation of the POR (power on reset circuit) illustrated in FIG. 10 will be explained in brief. The power down signal PD is made "L" and PDX is made "H".

Right after the power source VDP5 is turned on, VBGR is 0V. When the bias circuit for generating PB etc. operates and the bias potential PB becomes a potential lower than VDP5 by Vth or more, current flows to the PMB8.

Here, VBGR is 0V, so the potential of the node NDNGST rises by the current flowing from PMB8, and current flows to the NMB6 and PMB9. The potential of the node NDPGST becomes a potential about Vth lower than VDP5 whereby current flows to the PMB9, so the PMB10 also turns ON.

The potential of the node NDPORI1 is coupled with VDP5 at the capacitor CPOR1 at the time when VDP5 rises, so becomes "H". Until the potential of VBGR exceeds the Vth of the NMB4, the PMB10 holds the ON state and the NDPORI1 holds "H".

Here, PDX is "H", so NMB7 turns ON, but PMB10 is ON, so the charge flowing out from the RPOR1 is corrected by the PMB10. Further, the potential of the node NDPORI1 is "H", so the output NDPORI2 of the Schmitt trigger circuit SCHMITT1 also becomes "H".

If the bias circuit for generating PB etc. operates, the bandgap circuit starts to operate, and the potential of the VBGR rises, the NMB4 turns ON. The potential of the node NDNGST becomes 0V, while the NMB6 turns OFF. The PMB9 also turns OFF, so the PMB10 also turns OFF.

When the PMB10 turns OFF, the resistor RPOR1 is used to start the discharge of the capacitor CPOR1. Due to this, the potential of NDPORI1 starts to fall and finally reaches 0V. When the potential of the node NDPORI1 becomes "L", the output NDPORI2 of the Schmitt trigger circuit SCHMITT1 also becomes "L".

For example, when using the power on reset circuit POR illustrated in FIG. 10 to turn on the power source VDP5, it is possible to make the POR signal NDPORI2 "H" right after turning on the power and make the POR signal NDPORI2 "L" after the VBGR potential rises. By utilizing such a POR signal, it becomes possible to perform the control right after turning on the power explained previously with reference to FIG. 7 or explained subsequently with reference to FIG. 14.

Figure 11:
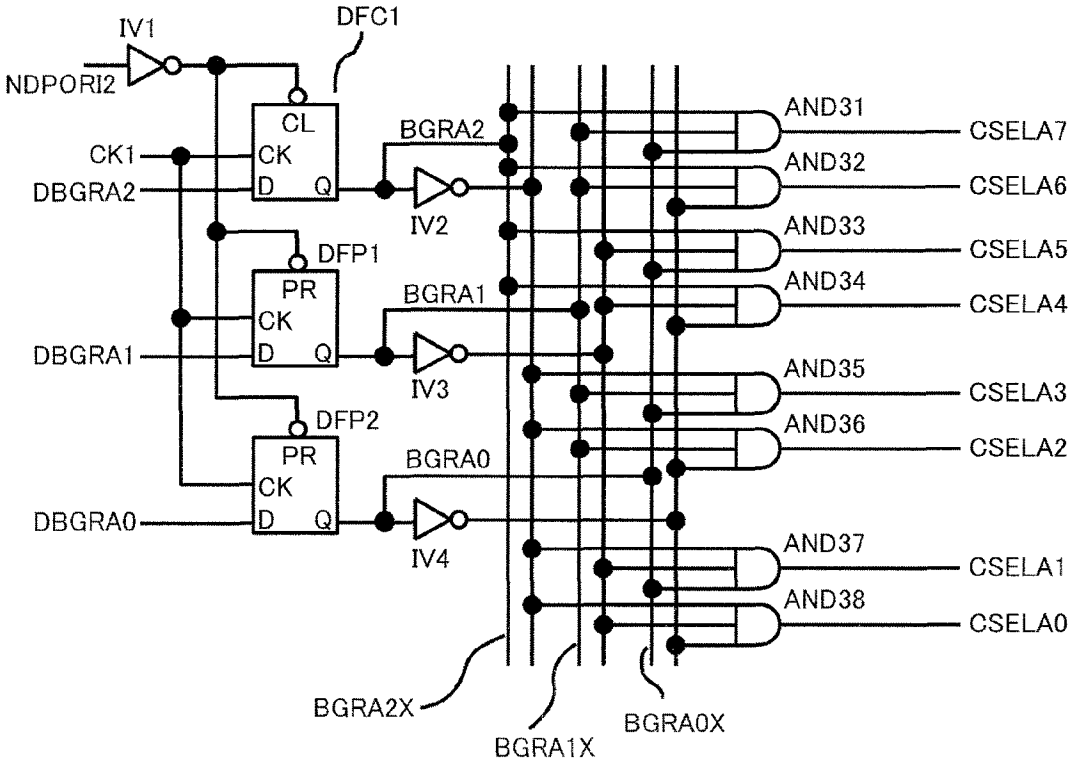
FIG. 11 is a circuit diagram illustrating one example of a switch control circuit which is used in the bandgap circuit of FIG. 7 or FIG. 10.

FIG. 11 is a circuit diagram illustrating one example of a switch control circuit which is used in the bandgap circuit of FIG. 7 or FIG. 10 and illustrates the circuit CLOGIC1 which generates the control signals CSELA and CSELB.

In FIG. 11, reference notation DFC1 indicates a DFF (D-flipflop) with a clear function, DFP1 and DFP2 indicate DFFs with a preset function, IVn (n is an integer) indicates an inverter circuit, and, further, AND3*n* (n is an integer) indicate a three-input AND circuit.

Further, reference notation NDPORI2 indicates, for example, a POR signal which is generated by the circuit of FIG. 10, CK1 indicates a clock signal, and, further, DBGRA2, DBGRA1, and DBGRA0 indicates a terminal which receives as input data which is read out from the flash memory.

Furthermore, reference notations BGRA2, BGRA1, BGRA0, BGRA2X, BGRA1X, and BGRA0X indicate internal nodes, while CSELA7 to CSELA0 indicate outputs used as control signals of switches.

Note that, the circuit of FIG. 11 corresponds to the CLOGIC1 of FIG. 10 and is assumed to operate by the power source VDP5. When the clear terminal CL is L, the DFC1 initializes the output Q to L asynchronously with the clock signal which is input to the clock terminal CK. When the CL terminal becomes "H", it operates as a DFF and stores the value of the data input D at the rising edge of CK. Note that it is assumed that DFP1 and DFP2 similarly initialize Q to H asynchronously with CK when the preset terminal PR is L and operate as ordinary DFFs when PR becomes "H".

The POR signal NDPORI2 is "H" right after turning on the power, is inverted at the inverter circuit IV1, then is supplied to the clear terminal CL of the DFC1 and the preset terminals PR of the DFP1 and DFP2.

That is, by the POR signal becoming "H", the output of the DFC1 becomes "L". Further, the outputs of the DFP1 and DFP2 are initialized to "H". The IV2 to IV4 and the AND31 to AND38 work as a decoder circuit which decodes the output BGRA2 of the DFC1, the output BGRA1 of the DFP1, and the output of the DFP2.

That is, one of the eight signals of the 3-bit data having BGRA2 as the higher bit and BGRA0 as the lower bit becomes "H" and the remainder become "L". CSELA0 becomes "H" when BGRA2, BGRA1, and BGRA0 are "000", while CSELA7 becomes "H" when "111". CSELA0 to CSELA7 are selected in ascending order from 0 to 7.

For example, right after turning on the power, due to the POR signal, BGRA2, BGRA1, and BGRA0 become "011", so CSELA3 becomes "H" and the remainder become "L". This signal is used to control, for example, the switches SWTA0 to SWTA7 of FIG. 8. Specifically, when CSELA0 is "H", SWTA0 is selected and the remainder are not selected. When CSELA3 is "H", SWTA3 is selected.

FIG. 11 illustrates an example of a circuit which generates the control signals CSELA0 to CSELA7, but it is also possible to provide another circuit of FIG. 11 and use this as the circuit which generates the control signals CSELB0 to CSELB7. Further, by controlling the switches SWTB0 to SWTB7 of FIG. 8 by CSELB0 to CSELB7, it becomes possible to generate CSELA and CSELB.

The CSELA of FIG. 10 corresponds to the CSELA0 to CSELA7 of FIG. 11, but for the CSELB as well, similarly, CSELB0 to CSELB7 correspond to the control signal CSELB of FIG. 10.

Here, if setting the potentials of the switches of FIG. 8 which are initialized and selected by the POR signal to the same potentials at the SWTA0 to SWTA7 and SWTB0 to SWTB7, it becomes possible to use the POR circuit for control so that the potential of the SELAO and the potential of the SELBO become the same potential. In the example of FIG. 11, the potential becomes one selected by CSELA3 and CSELB3.

After the POR signal NDPORI2 becomes "L", the flipflops DFC1, DFP1, and DFP2 are ordinary DFFs, so it is possible to use the clock CK1 and the DBGRA2, DBGRA1, and DBGRA0 and freely set values from the flash memory.

Note that, DBGRA2, DBGRA1, and DBGRA0 correspond to the TRIMDATA of FIG. 10. Therefore, it is enough to set values for adjusting the offset of the main amplifier of FIG. 7 to zero in the DFFs and generate SELAO and SELBO.

The setting data stored in the flash memory in advance for zero adjustment of the offset adjustment of the main amplifier AMPBM1 may be written at the time of testing after manufacture. Furthermore, it is also possible to store this in a separate nonvolatile memory or have the final user of the MCU set a value from a program to adjust the offset voltage.

Figure 12:
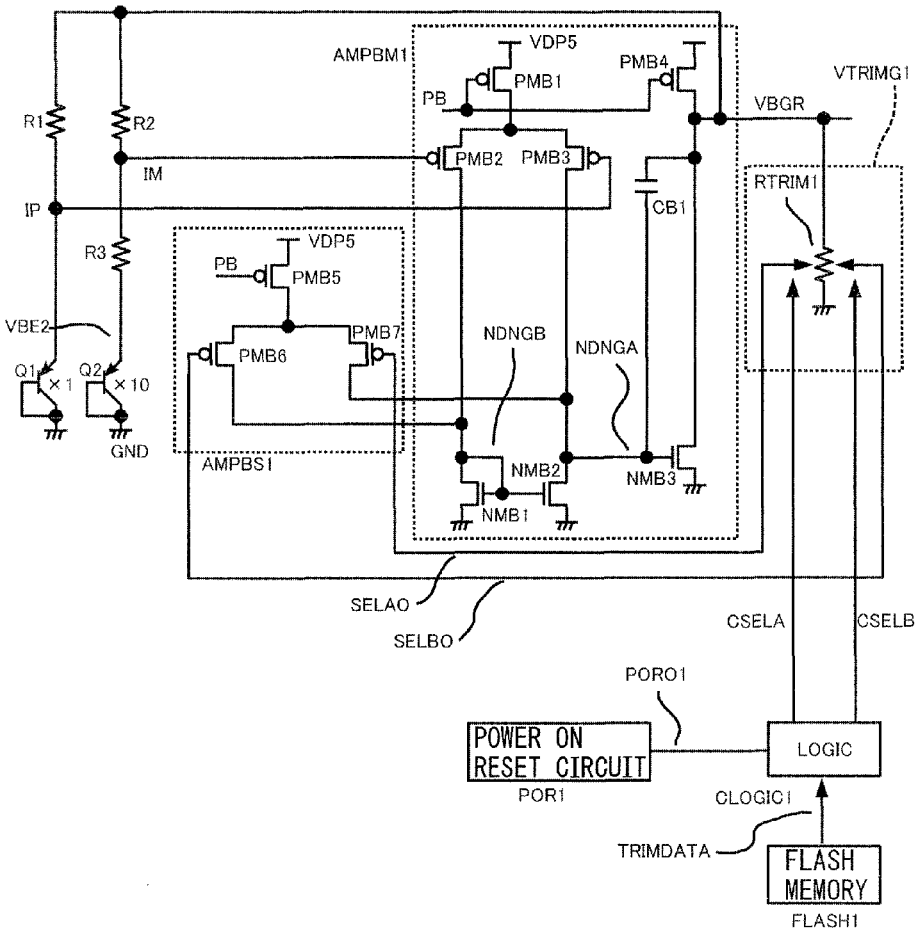
FIG. 12 is a circuit diagram illustrating a bandgap circuit of a third embodiment.

FIG. 12 is a circuit diagram illustrating a bandgap circuit of a third embodiment. This corresponds to the bandgap circuit of FIG. 10 where the power on reset circuit is shown by a block and a flash memory is added.

The parts which differ from the bandgap circuit of the second embodiment of FIG. 10 will be explained. In FIG. 12, reference notation POR1 indicates a power on reset circuit, PORO1 indicates the output of a power on reset circuit, and, further, FLASH1 indicates a flash memory.

The bandgap circuit of the second embodiment of FIG. 10 is an example of a circuit where the potential of the VBGR rises and thereby the level of the output PORO1 of the power on reset circuit POR1 changes. However, as clear from the explanation of FIG. 10 and FIG. 11, the thing preferable as the function of a POR circuit is the initialization of the CSELA and CSELB right after turning on the power.

That is, it is also possible to use a general power on reset circuit POR1 or a circuit in line with the object of generating a signal at the time the power rises so as to initialize a control circuit CLOGIC1 (for example, circuit of FIG. 11).

Figure 13:
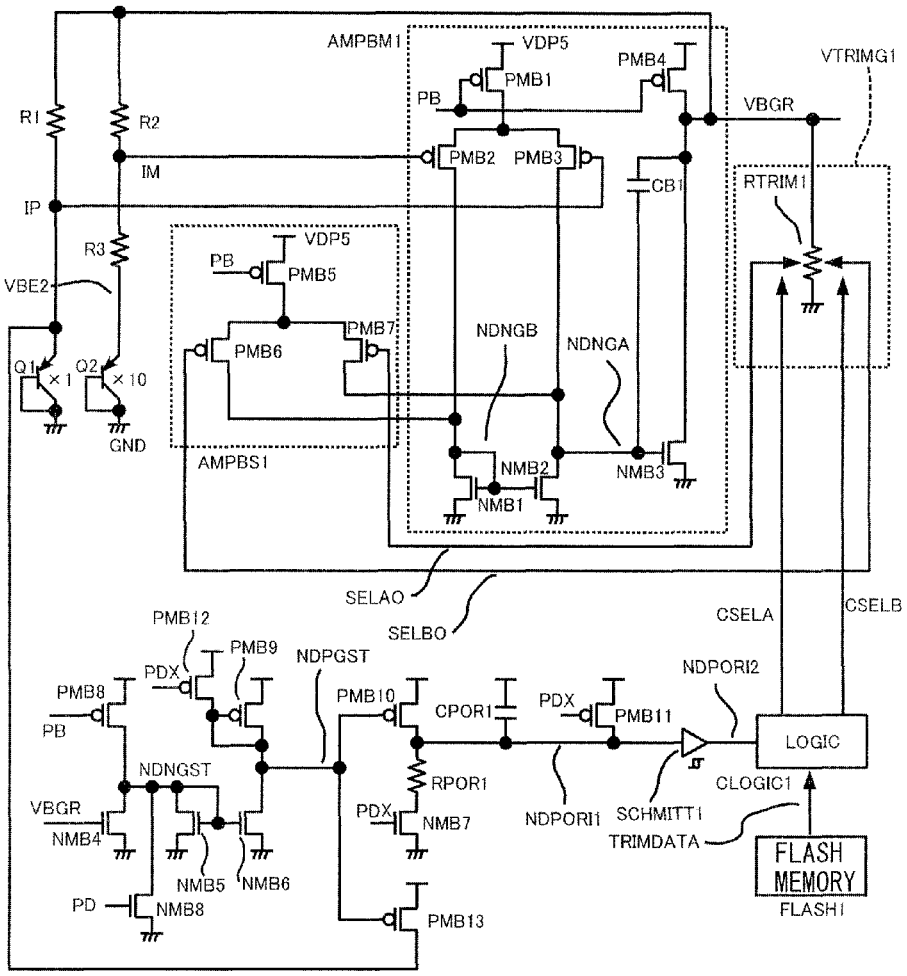
FIG. 13 is a circuit diagram illustrating a bandgap circuit of a fourth embodiment.

FIG. 13 is a circuit diagram illustrating a bandgap circuit of a fourth embodiment and illustrates also a startup circuit preferable for actual operation. In this regard, the BGR circuit has two points where the circuit operates stably. These are when the VBGR becomes 1.2V and 0V.

When the operating amplifier used for the feedback control is ideal, the potential of IP and the potential of IM become equal under all conditions. To avoid an undesirable balancing point, use of a startup circuit is general.

The bandgap circuit of the fourth embodiment of FIG. 13 is almost the same as the bandgap circuit of the second embodiment of FIG. 10. Further, the names of the devices and nodes also correspond. The parts of the startup circuit differing between the two will be explained.

The circuit of FIG. 13 comprises the circuit of FIG. 10 plus the transistor PMB13. The gate of the transistor PMB13 is coupled to the node NDPGST together with the gate of the transistor PMB10, while the drain of the PMB13 is coupled to the node IP. Here, the PMB13 and the part of the circuit which generates the gate potential NDPGST of the PMB13 function as a startup circuit of the bandgap circuit.

Next, the operation will be simply explained assuming the power down signal PD to be "L" and PDX to be "H". Right after turning on the power source VDP5, VBGR is 0V. When the bias circuit for generating the PB etc. operates and the bias potential PB becomes a potential lower than the VDP5 by the Vth or more, current flows to the PMB8.

Here, VBGR is 0V, so the potential of the node NDNGST rises by the current flowing from the PMB8 and current also flows to the NMB6 and PMB9. The potential of the node NDPGST becomes a potential lower than the VDP5 by about Vth whereby current flows through the PMB9, so the PMB13 also turns ON. When the PMB13 turns ON, the potential of the IP rises. Due to the main amplifier AMPBM, the potentials of the IP and the IM match at a potential of about 0.6V. The potential of VBGR becomes about 1.2V.

If the potential of the VBGR rises, the NMB4 turns ON, the potential of the node NDNGST becomes 0V, and the NMB6 turns OFF. The PMB9 also turns OFF, so the PMB13 also turns OFF and the PMB13 no longer affects the potential of the VBGR.

In this way, the startup circuit may be realized, for example, as a circuit configuration which supplies current to the IP so that the potential of the IP rises when the potential of the VBGR is at a potential near the GND.

The startup circuit may be realized by the example of the circuit explained above. In FIG. 13, as one example, an example of a circuit including a startup circuit will be illustrated, but the circuit configuration at the transistor level may be modified in various ways including the main amplifier, auxiliary amplifier, startup circuit, POR circuit, and control circuit.

Further, the main amplifier circuit and the auxiliary amplifier circuit may also be realized in various ways so long as serving the purposes of the main amplifier circuit and auxiliary amplifier circuit. Furthermore, in FIG. 7, the explanation was given making the ratio of the currents of the transistors Q1 and Q2 etc. 10:1 as an example, but the ratio may be freely designed. That is, the explanation was given making the ratio of the transistor areas of Q1 and Q2 1:10 as an example, but any ratio is possible. In this way, the above embodiments may be modified in various ways.

Figure 14:
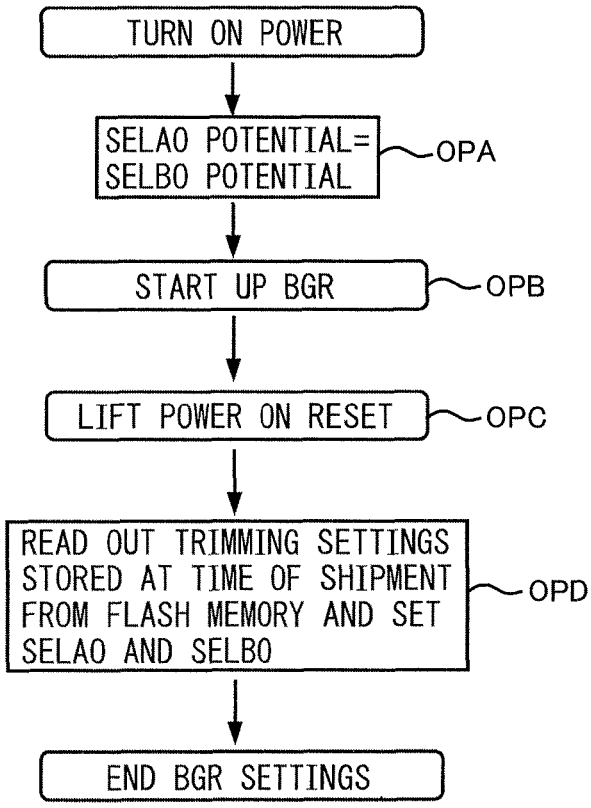
FIG. 14 is a view for explaining the operation at the time of turning on the power in the bandgap circuit of FIG. 13.

FIG. 14 is a view for explaining the operation of the bandgap circuit of FIG. 13 when turning on the power and illustrates the control of the microcontroller MCU when turning on the power. Note that, the bandgap circuit of FIG. 13, in the same way as the bandgap circuit of FIG. 7, mounts a microcontroller such as illustrated in for example FIG. 9.

As illustrated in FIG. 14, first, when the power source is turned on, at the operation OPA, the gate voltages SELBO and SELAO of the pMOS transistors PMB6 and PMB7 are assumed to be equal (SELAO=SELBO), then the routine proceeds to the operation OPB. That is, at the operation OPA right after turning on the power, the potentials of the SELBO and SELAO are set to certain fixed values.

Next, at the operation OPB, the bandgap circuit BGR is started up, then the routine proceeds to operation OPC where the power on reset is lifted. That is, the bandgap circuit is started up at SELBO=SELAO and power on reset by the above-mentioned power on reset circuit POR is awaited. Due to this power on reset, it is possible to start up the potential of the VBGR to make the regulator circuit operate and start up the internal voltage VDD.

Furthermore, the routine proceeds to the operation OPD where, for example, the trimming settings stored at the time of shipment are read out from the flash memory FLASH1, SELAO and SELBO are set, and the setting of BGR is ended. That is, after startup of the internal voltage VDD enables readout of the flash memory FLASH1, the gate voltage settings for canceling the offset voltage, which are stored in advance, are read out from the FLASH1.

By canceling the offset voltage of the main amplifier AMPBM1 by the settings of SELBO and SELAO which are read out from this FLASH1, the precision of the VBGR may be improved. That is, by using the VBGR which is generated by canceling the offset voltage of this main amplifier, it is possible to improve the voltage precision of the low voltage detection circuit and regulator circuit. Note that, in the above explanation, the operations may be processing steps.

Figure 15:
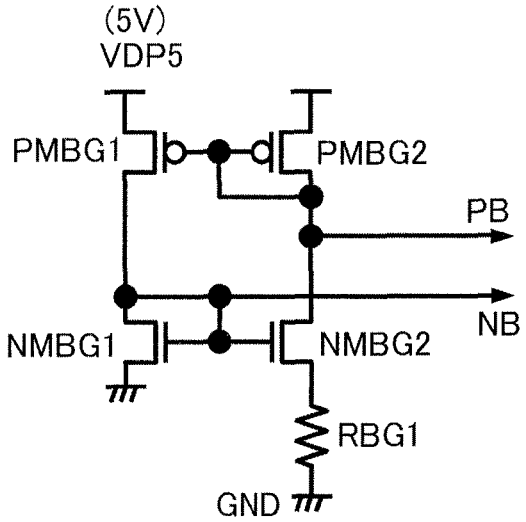
FIG. 15 is a circuit diagram illustrating one example of a bias potential generation circuit.

FIG. 15 is a circuit diagram illustrating one example of the bias potential generation circuit. For example, it illustrates an example of a bias potential generation circuit which supplies a bias potential in the bandgap circuits illustrated in FIG. 7, FIG. 10, FIG. 12, and FIG. 13.

In FIG. 15, reference notations PMBG1 and PMBG2 indicate pMOS transistors, NMBG1 and NMBG2 indicate nMOS transistors, and, further, RBG1 indicates a resistor. The circuit of FIG. 15 functions as a bias potential generation circuit which generates bias potentials NB and PB. Note that, the bias potential generation circuit of FIG. 15 is just an example. It is also possible to apply a bias potential generation circuit of various other circuit configurations.

Figure 16:
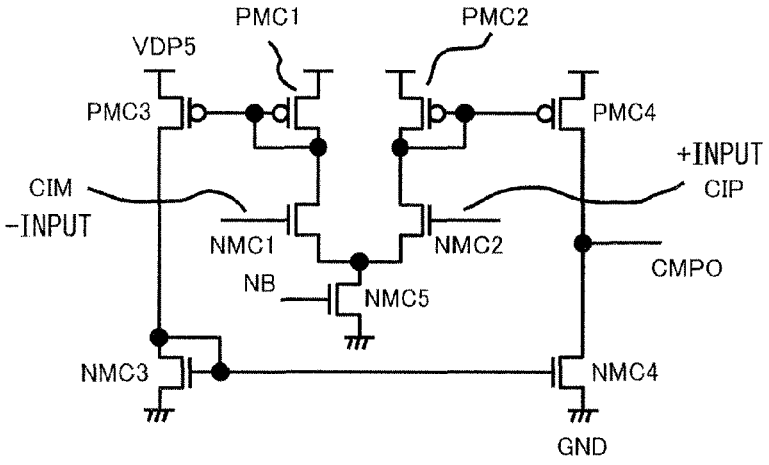
FIG. 16 is a circuit diagram illustrating one example of a comparator circuit.

FIG. 16 is a circuit diagram illustrating one example of a comparator circuit and illustrates, for example, an example of the circuit at the transistor level of the comparator circuits CMP1 and CMP2 in the above-mentioned FIG. 9. Note that, the error amplifier EAMP1 in FIG. 9 may also be realized by a similar configuration.

In FIG. 16, PMn (n is an integer etc.) indicates a pMOS transistor, NMn (n is an integer etc.) indicates an nMOS transistor, and, further, GND indicates a GND terminal. Further, reference notation VDP5, for example, indicates a 5V plus power source, CIM and CIP indicate inputs of the comparator circuits, CMPO indicates an output, and, further, NB indicates a bias potential.

Note that, as the bias potential NB in FIG. 16, for example, it is possible to utilize the bias NB which is generated by the above-mentioned bias potential generation circuit of FIG. 15. Note that, the configuration of the comparator circuit itself is well known, so an explanation of the detailed operation will be omitted. For example, by using the circuit of FIG. 16 in combination with the circuit of FIG. 15, it is possible to realize the comparator circuits CMP1 and CMP2 and the error amplifier EAMP1 of FIG. 9.

Figure 17A:
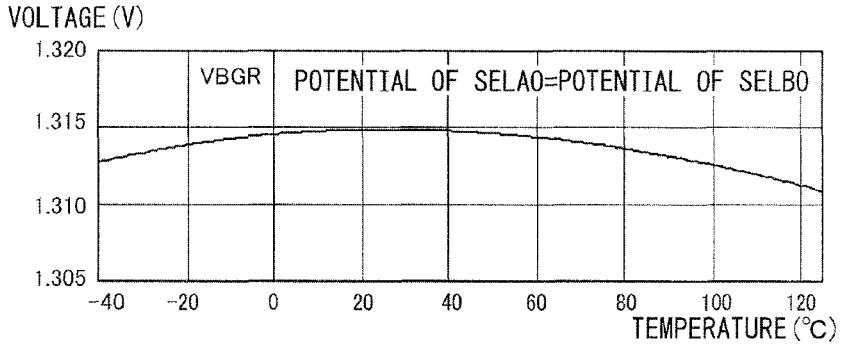
FIG. 17A, FIG. 17B and FIG. 17C are views for explaining the relationship between a trimming setting in a bandgap circuit and an output voltage and temperature.
Figure 17B:
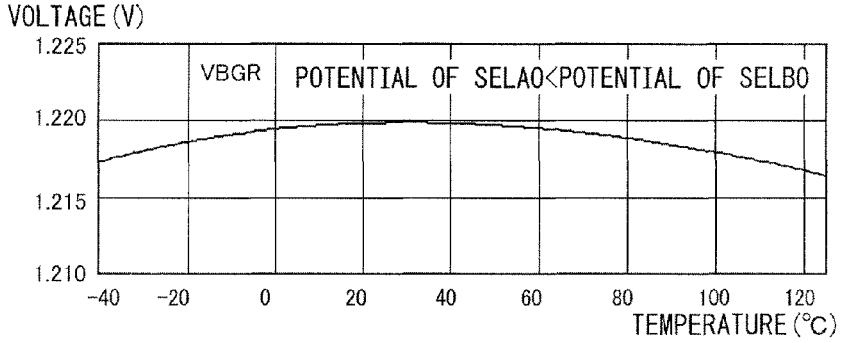
Figure 17C:
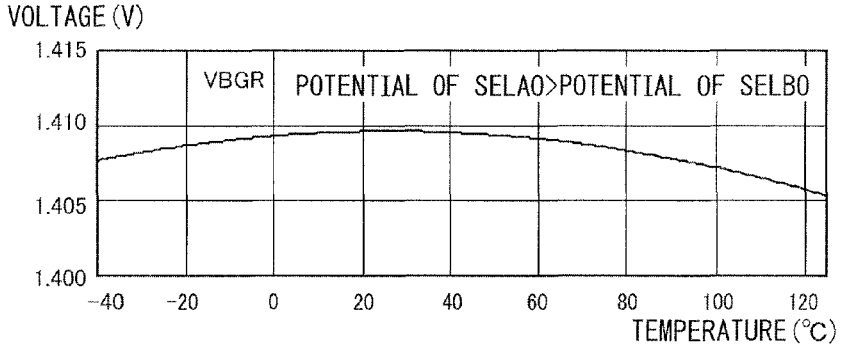
Figure 18:
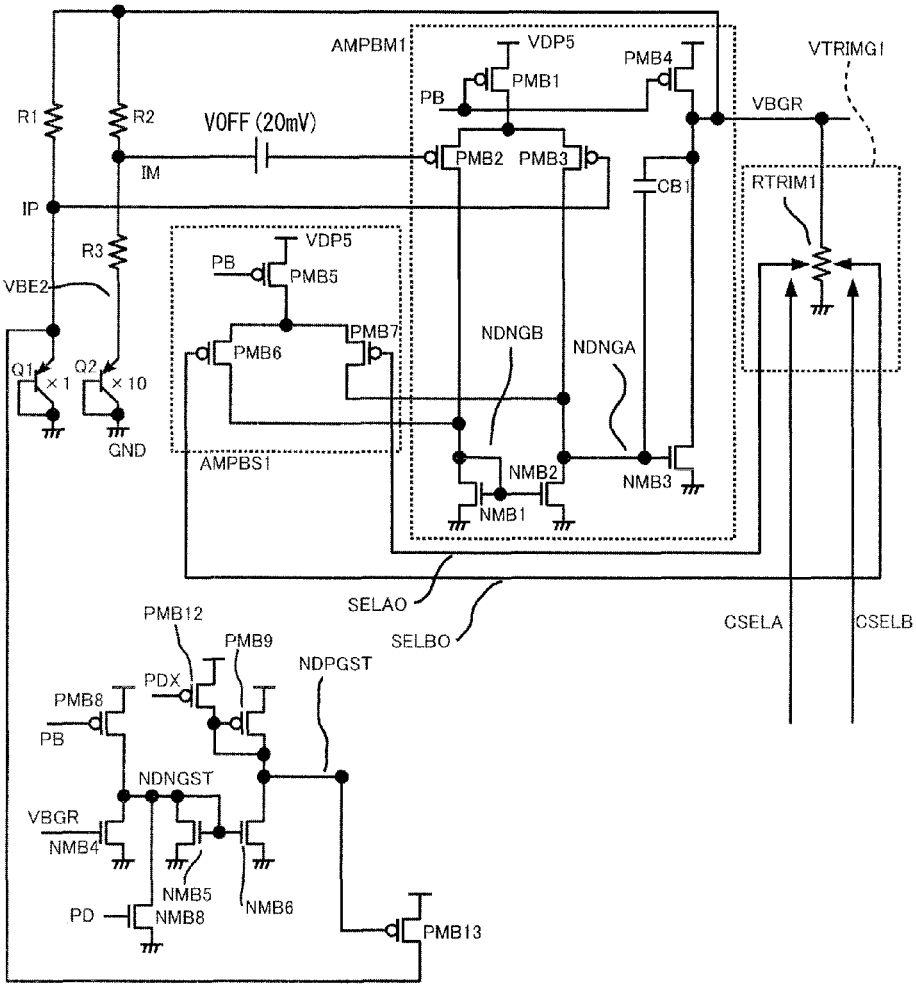
FIG. 18 is a view illustrating a bandgap circuit performing a simulation of FIG. 17A to FIG. 17C.

FIG. 17A, FIG. 17B and FIG. 17C are views for explaining the relationship between the trimming settings in the bandgap circuit and the output voltage and temperature, while FIG. 18 indicates a bandgap circuit of the simulation of FIG. 17A to FIG. 17C. Note that, FIG. 18 corresponds to the bandgap circuit of the above-mentioned FIG. 13 wherein the offset voltage VOFF of the main amplifier AMPBM1 is made 20 mV.

In FIG. 17A to FIG. 17C, the ordinates indicate the voltage of VBGR of the bandgap circuit which is illustrated in FIG. 18, while the abscissas indicate the temperature (° C.).

Here, FIG. 17A illustrates the case where the potential of SELAO is equal to the potential of SELBO (SELAO=SELBO), while FIG. 17B indicates the case where the potential of SELAO is smaller than the potential of SELBO (SELAO<SELBO). Furthermore, FIG. 17C illustrates the case where the potential of SELAO is larger than the potential of SELBO (SELAO>SELBO).

Further, in the above-mentioned FIG. 8, the example was illustrated of selecting the output of the voltage division circuit, which divides the potential of VBGR, by 3-bit data. In the circuit used in the simulation illustrated in FIG. 18, the setting data for this offset adjustment is made 4-bit data.

That is, in the circuit of FIG. 18, when the setting data is "0000", the potential of SELAO becomes the lowest value, while conversely when "1111", the potential of SELAO becomes the highest value (relationship between settings and potential of circuit of FIG. 8 become reversed). Note that, the potential of SELBO is generated by a circuit similar to SELAO. The setting data is fixed to "1000".

First, as illustrated in FIG. 17A, when SELAO=SELBO (setting data of SELAO is same "1000" as setting data of SELBO), a 1.31V or so voltage is obtained due to the effect of the offset voltage VOFF of the main amplifier AMPBM1. That is, a voltage larger than the ideal bandgap output 1.2V is output.

Next, as illustrated in FIG. 17B, when SELAO<SELBO (setting data of SELAO is lowest value of "0000"), the effect of the offset voltage of the AMPBM1 is canceled, and the VBGR output becomes 1.21V, that is, the ideal bandgap voltage.

Furthermore, as illustrated in FIG. 17C, when SELAO>SELBO (setting data of SELAO is highest value of "1111"), the input conversion offset voltage of the AMPBM1 becomes larger, so the VBGR output further increases and becomes 1.41V.

From these results, by selecting the input to the offset adjustment-use auxiliary amplifier AMPBS1 (gate potentials SELAO and SELBO of PMB7 and PMB6), it may be confirmed that the effect of the offset voltage VOFF of the main amplifier AMPBM1 may be reduced.

Further, even if the direction of the input offset voltage VOFF of the main amplifier AMPBM1 becomes opposite, it is clear that by making the settings of the switches the SELAO>SELBO of FIG. 17C, it is possible to obtain the ideal bandgap voltage (1.2V).

Figure 19:
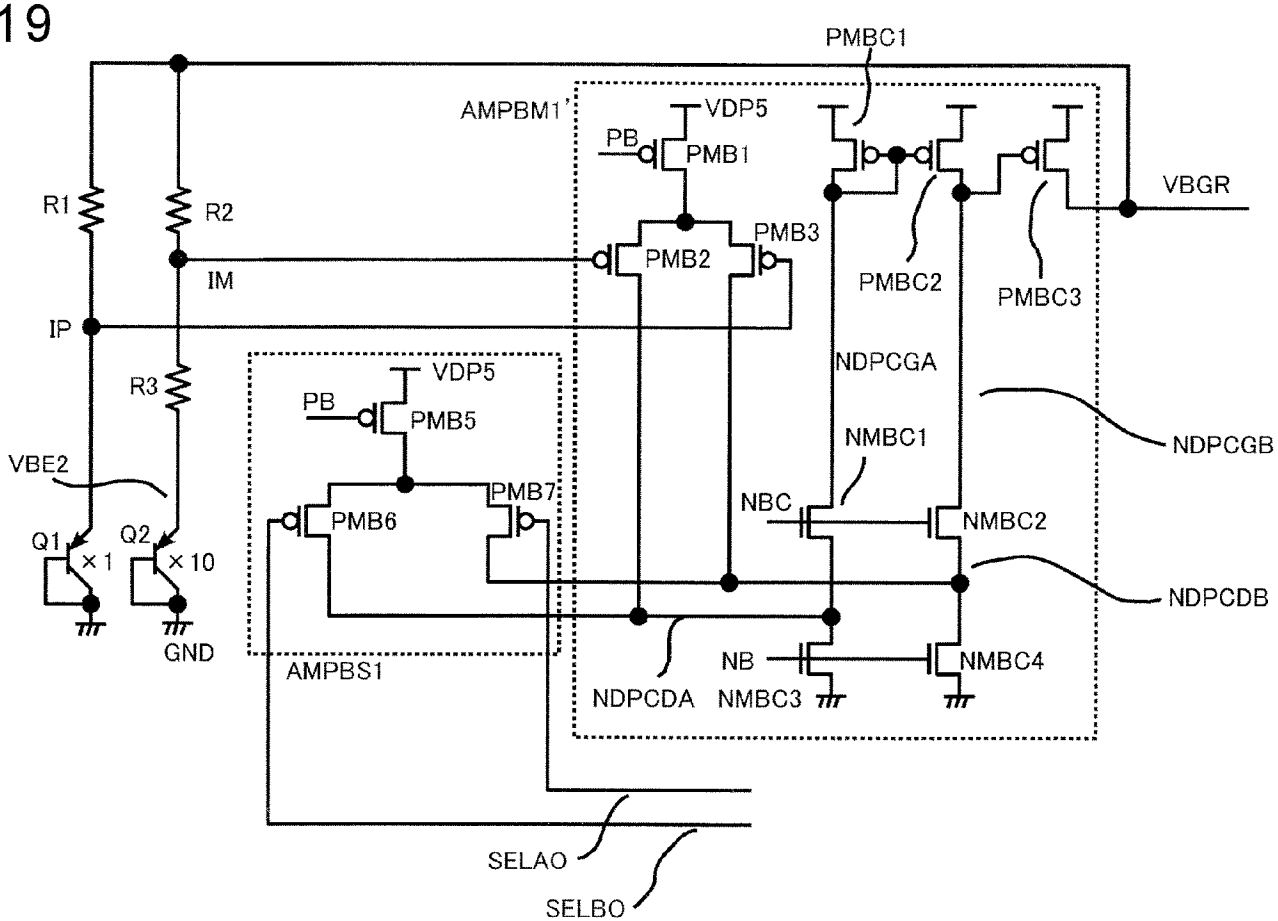
FIG. 19 is a circuit diagram illustrating a bandgap circuit of a fifth embodiment.

FIG. 19 is a circuit diagram illustrating a bandgap circuit of a fifth embodiment and illustrates the main amplifier AMPBS1' as a folded cascode circuit.

In the bandgap circuits of the first to fourth embodiments explained with reference to FIG. 7, FIG. 10, and FIG. 12 and FIG. 13, the main amplifier AMPBM1 was configured the same, but various modifications are possible.

That is, in the first to fourth embodiments, the main amplifier AMPBM1 was made a two-stage amplifier. The first stage circuit was made a circuit of a pMOS differential input and nMOS load configuration, while the second stage circuit was made a circuit of a pMOS source load by nMOS source ground amplification.

Further, the offset adjustment-use auxiliary amplifier AMPBS1 was made an pMOS differential input circuit. The drains of the pMOS differential pair were coupled to the drains of the load nMOS transistors of the first-stage circuit of the main amplifier.

As opposed to this, in the fifth embodiment of FIG. 19, the main amplifier AMPBM1' is made a folded cascode circuit. Note that, in FIG. 19, the gate potential generation circuit of the auxiliary amplifier AMPBS1 and the power on reset circuit, the startup circuit, etc. are omitted, but this may be made a configuration similar to the above-mentioned FIG. 7, FIG. 10, FIG. 12, and FIG. 13. Here, just the fact that the configuration of the circuit of the main amplifier may, for example, be a folded cascade circuit such as illustrated in FIG. 19 and the parts related to this will be explained.

In FIG. 19, circuit devices and nodes etc. corresponding to figures of other circuits are shown assigned the same device names and node names. The functions and operations of the parts given the same names are already explained, so explanations will be omitted.

In FIG. 19, reference notation PMBn (n is an integer etc.) indicates a pMOS transistor, NMBn (n is an integer etc.) indicates an nMOS transistor, AMPBM1' indicates a main amplifier, and, further, AMPBS1 indicates an auxiliary amplifier for offset adjustment.

Further, reference notation NB indicates the bias potential of the nMOS transistor, NDPCDA and NDPCDB indicate nodes adding the drain output current of the auxiliary amplifier to the main amplifier, and, further, NBC indicates the bias potential of the nMOS transistor of the folded cascode circuit of the figure.

Furthermore, reference notations NDPCGA and NDPCGB indicate drain nodes of NMBC1 and NMBC2, and, further, PMBC3 indicates a second-stage pMOS transistor working as the source ground amplification circuit.

As illustrated in FIG. 19, the main amplifier AMPBM1' is made a pMOS differential input circuit comprised of the transistors PMB1, PMB2, and PMB3. Further, the drain current difference of the transistors PMB2 and PMB3 is folded back by the transistors NMBC3, NMBC4, NMBC1, and NMBC2 at the nodes NDPCGA and NDPCGB. Further, this may also be made a folded cascode circuit making the transistors PMBC1 and PMBC2 pMOS load transistors.

Note that, the circuit comprised of the transistors PMB1, PMB2, PMB3, NMBC3, NMBC4, NMBC1, NMBC2, PMBC1, and PMBC2 form a general folded cascode circuit. The output NDPCGB of this first-stage folded cascode circuit may be amplified by the second-stage source ground amplification circuit PMBC3 so as to generate the VBGR.

Even when making the main amplifier a circuit like AMPBM1', by adding the output drain currents of the PMB6 and PMB7 to the output drain currents of the first-stage differential circuits PMB2 and PMB3, it is possible to adjust the offset voltage of the AMPBM1' by AMPBS1.

For example, it is possible to change the relationship of the drain currents of PMB2 and PMB3 equivalently by the currents of PMB6 and PMB7, so it will be understood that offset adjustment is possible. Note that, the potential of NBC also may be generated by a general bias circuit.

In this way, the main amplifier of the differential circuit may be used to generate the bandgap voltage VBGR, the auxiliary amplifier of the differential circuit may be used to adjust the offset voltage of the main amplifier to zero, and the auxiliary amplifier inputs may be generated by dividing VBGR. This is possible even when the main amplifier is a folded cascode circuit.

As shown in FIG. 19, by making the first stage of the main amplifier a folded cascade circuit of the pMOS differential circuit input and making the second-stage circuit a pMOS source ground amplification circuit PMBC3, it is possible to eliminate the current source of the second-stage amplification circuit (for example, NMB3 of FIG. 13) and obtain the effect of reduction of the power consumption.

Figure 20:
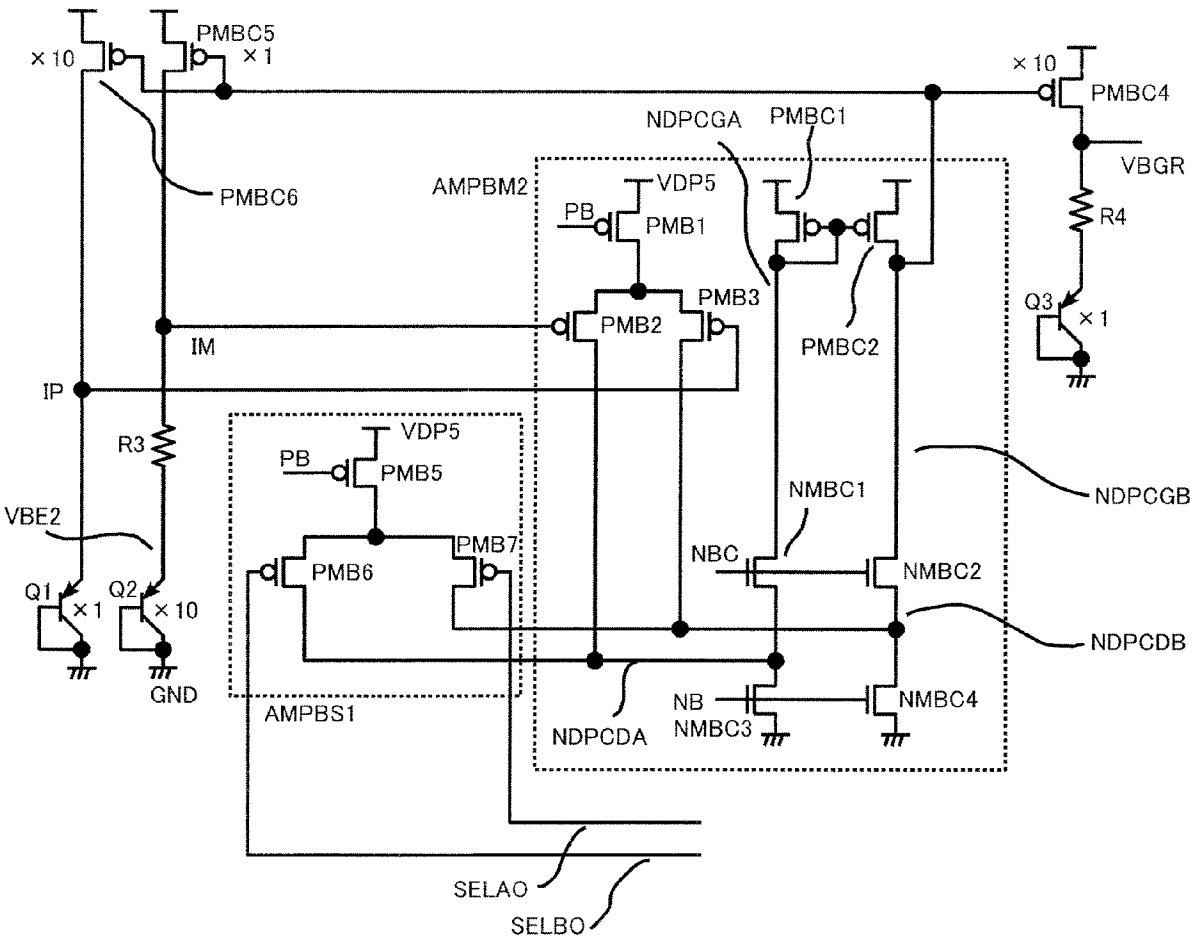
FIG. 20 is a circuit diagram illustrating a bandgap circuit of a sixth embodiment.

FIG. 20 is a circuit diagram illustrating a bandgap circuit of a sixth embodiment. The fifth embodiment of FIG. 19 illustrated an example of a circuit which made the first-stage circuit of the main amplifier AMPBM1' a folded cascade circuit of a pMOS differential circuit input, made the second-stage amplification circuit a pMOS source ground amplification circuit, and determined the current ratio of Q1 and Q2 by the resistors R1 and R2.

In FIG. 20, the circuit is configured to make the main amplifier AMPBM2 the one-stage configuration of the folded cascade circuit of the pMOS differential circuit input and to determine the current ratio of Q1 and Q2 by the pMOS current mirror ratio of the current mirrors PMBC6 and PMBC5.

Furthermore, the bandgap voltage VBGR is generated by the separately provided current mirror PMBC4 and resistor R4 and PNP transistor Q3. In the configuration of FIG. 20 as well, the main amplifier generates the bandgap voltage (reference voltage) VBGR, the auxiliary amplifier adjusts the offset voltage of the main amplifier, and the auxiliary amplifier input may be generated by dividing VBGR. Note that, the method of generation of the bandgap voltage of FIG. 20 is basically similar to the circuit of the above-mentioned FIG. 4.

Figure 21:
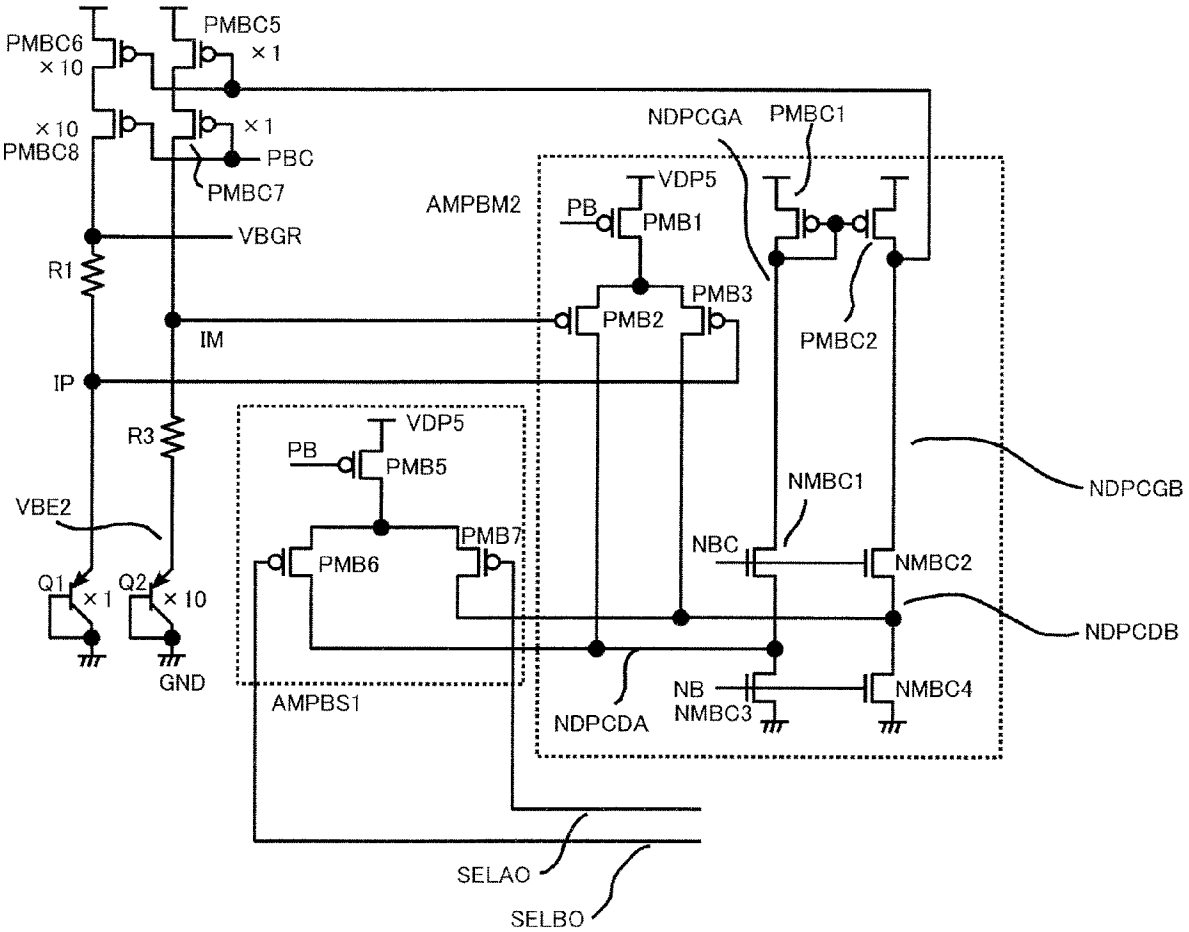
FIG. 21 is a circuit diagram illustrating a bandgap circuit of a seventh embodiment.

In FIG. 20, circuit devices and nodes etc. corresponding to figures of other circuits, for example, FIG. 4 or FIG. 21, are shown assigned the same device names and node names. The functions and operations of the parts given the same names are already explained, so explanations will be omitted.

As clear from a comparison of FIG. 20 and FIG. 19, the main amplifier AMPBM2 of the sixth embodiment is comprised of the main amplifier AMPBM1' of the fifth embodiment of the FIG. 19 minus the second stage source ground amplification circuit PMBC3.

The output NDPCGB of the folded cascode circuit of the first-stage pMOS differential circuit input is supplied as the gate potential of the current mirrors PMBC5, PMBC6, and PMBC4. PMBC6, PMBC5, and PMBC4 correspond to PM1, PM2, and PM3 of FIG. 4, so it will be understood that the circuit of FIG. 20 operates as a bandgap circuit.

Furthermore, the relationship between the AMPBM2 and AMPBS1 is substantially the same as the circuit of FIG. 19, so it may also be clear that the offset voltage of the main amplifier AMPBM2 may be adjusted by the auxiliary amplifier AMPBS1.

As illustrated in FIG. 20, not a circuit which determines the current ratio of the transistors Q1 and Q2 by the resistors R1 and R2, but also a circuit which determines the current ratio of Q1 and Q2 by pMOS current mirrors may be used.

That is, the main amplifier comprised of the differential circuit may be used to generate the BGR voltage VBGR, the auxiliary amplifier comprised of the differential circuit may be used to adjust the offset voltage of the main amplifier to zero, and the auxiliary amplifier inputs may be generated by dividing the VBGR.

According to the circuit of the sixth embodiment such as in FIG. 20, since the circuit does not use R1 and R2, the advantageous effect is obtained that the area may be reduced by this amount.

FIG. 21 is a circuit diagram illustrating a bandgap circuit of a seventh embodiment. In the circuit of the sixth embodiment of FIG. 20 explained above, VBGR was generated by the PMBC4 and R4 and Q3, but a configuration like the seventh embodiment of FIG. 21 is also possible.

In FIG. 21, circuit devices and nodes etc. corresponding to figures of other circuits, for example, FIG. 20, are shown assigned the same device names and node names. The functions and operations of the parts given the same names are already explained, so explanations will be omitted.

The emitter potential of Q1 and the emitter potential of Q3 of FIG. 20 match (the current of PMBC6 and the current of PMBC4 are equal), so it is possible to convert the current of PMBC6 to voltage by the R1 of FIG. 21 and add this to the emitter potential IP of Q1 (VBE1) to obtain VBGR.

The current ratio of Q1 and Q2 may be set to, for example, 10:1 by the ratio of PMBC6 and PMBC5. The bandgap circuit of the seventh embodiment, compared with, for example, the configuration of FIG. 7 etc., has the additional pMOS current mirrors PMBC6, PMBC5, PMBC7, and PMBC8, but enables R2 to be eliminated, so there are the conditions enabling reduction of the area.

The drain potentials of the pMOS transistor which supplies current to R1 and the pMOS transistor which supplies current to R3 greatly differ, so to improve the precision of the ratio of currents supplied by the current mirrors, the PMBC6 and the PMBC5 are made cascode current mirror circuits.

Note that, PMBC7 and PMBC8 are additional devices for making the current mirrors a cascode circuit. The gate potential PBC of the PMBC7 and PMBC8 is the bias potential for the cascode circuit. Note that, PBC may also be supplied by a general bias circuit.

Here, the main amplifier AMPBM2 and the auxiliary amplifier AMPBS1 are configured the same as in the circuit of the sixth embodiment of FIG. 20, so the operation is also the same as that of FIG. 20.

Figure 22:
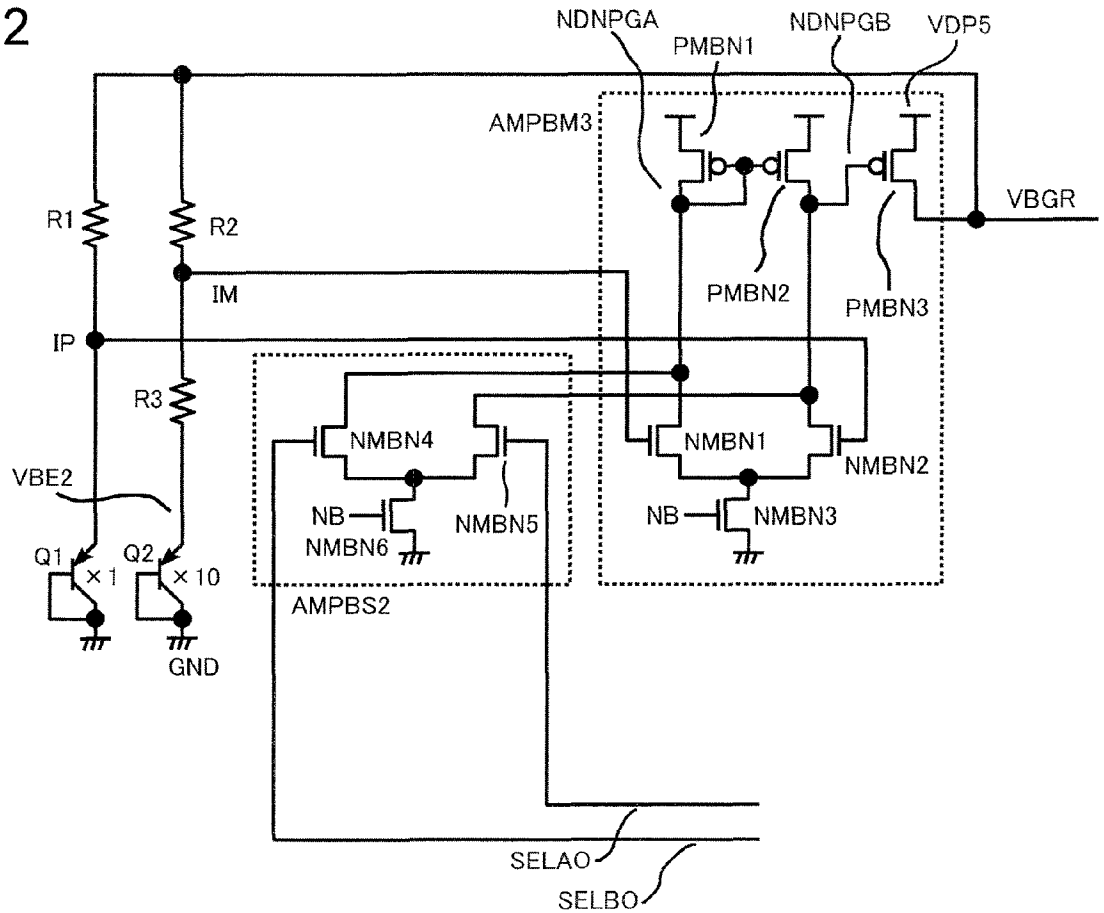
FIG. 22 is a circuit diagram illustrating a bandgap circuit of a eighth embodiment.

FIG. 22 is a circuit diagram illustrating a bandgap circuit of an eighth embodiment. In this regard, in the circuit of the fourth embodiment of FIG. 13 explained above, the main amplifier AMPBM1 was made a two-stage configuration amplification circuit of a pMOS differential circuit input. Further, the potentials of IP and IM are about 0.6V or potentials close to the GND potential 0V, so the result is a pMOS differential circuit input.

This is because when the threshold voltage Vth of the nMOS transistor is over 0.6V, it will not operate with a nMOS differential circuit input. Conversely, when the Vth of the nMOS transistor is sufficiently low, it is possible to form the main amplifier by a circuit having nMOS transistors as input transistors.

That is, the eighth embodiment of FIG. 22 is an example of a circuit which may be used even when the Vth of the nMOS transistors is sufficiently low. As illustrated in FIG. 22, the main amplifier AMPBM3 makes a differential circuit having nMOS transistors as the input transistors the first-stage amplification circuit, makes load transistors of the first-stage amplification circuit pMOS transistors, and makes the second stage amplification circuit a pMOS source ground amplification circuit.

In FIG. 22, circuit devices and nodes etc. corresponding to figures of other circuits, for example, FIG. 13, are shown assigned the same device names and node names. The functions and operations of the parts given the same names are already explained, so explanations will be omitted. In FIG. 22, the gate potential generation circuit of the auxiliary amplifier, the power on reset circuit, the startup circuit, etc. are omitted, but the configuration may be made similar to FIG. 7 or to FIG. 12 and FIG. 13.

The transistors NMBN1 and NMBN2 become an nMOS differential input circuit, while the transistors PMBN1 and PMBN2 become load transistors of the first-stage circuit. The transistor NMBN3 acts as the tail current source of an nMOS differential pair. Note that, NDNPGA and NDNPGB indicate drain nodes of a first-stage nMOS differential pair.

The transistor PMBN3 acts as a second-stage source ground amplification circuit. The configuration itself of the amplification circuit of the main amplifier AMPBM3 is a general one. A detailed explanation will be omitted, but this works to make the IP and IM match in the same way as the other examples of the circuits.

In FIG. 22, the main amplifier was made an nMOS transistor input differential circuit, so the auxiliary amplifier AMPBS2 is also made an nMOS differential circuit. The transistors NMBN4 and NMBN5 act as an nMOS differential circuit. The transistor NMBN6 acts as the tail current source of NMBN4 and NMBN5. The bias potential NB, for example, may be generated by a general circuit such as FIG. 15 in the same way as the other circuits.

If adding the output drain current of the differential nMOS circuit of the auxiliary amplifier to the drain current of the first-stage differential circuit of the main amplifier by NDNPGA and NDNPGB, in the same way as explained with the other circuits, it becomes possible to adjust the offset of the main amplifier AMPBM3 by SELAO and SELBO. This is because it is possible to correct the unbalance of drain currents of for example NMBN1 and NMBN2 by the drain currents of NMBN4 and NMBN5.

As illustrated in FIG. 22, even if the main amplifier is an nMOS differential circuit input type, the main amplifier of the differential circuit may be used to generate the BGR voltage VBGR, the auxiliary amplifier of the differential circuit may be used to adjust the offset voltage of the main amplifier to zero, and the auxiliary amplifier input may be generated by dividing VBGR.

In this way, for example, when the Vth of the nMOS transistor is small, configuration like in the eighth embodiment of FIG. 22 is possible and a much simpler circuit is possible.

Figure 23:
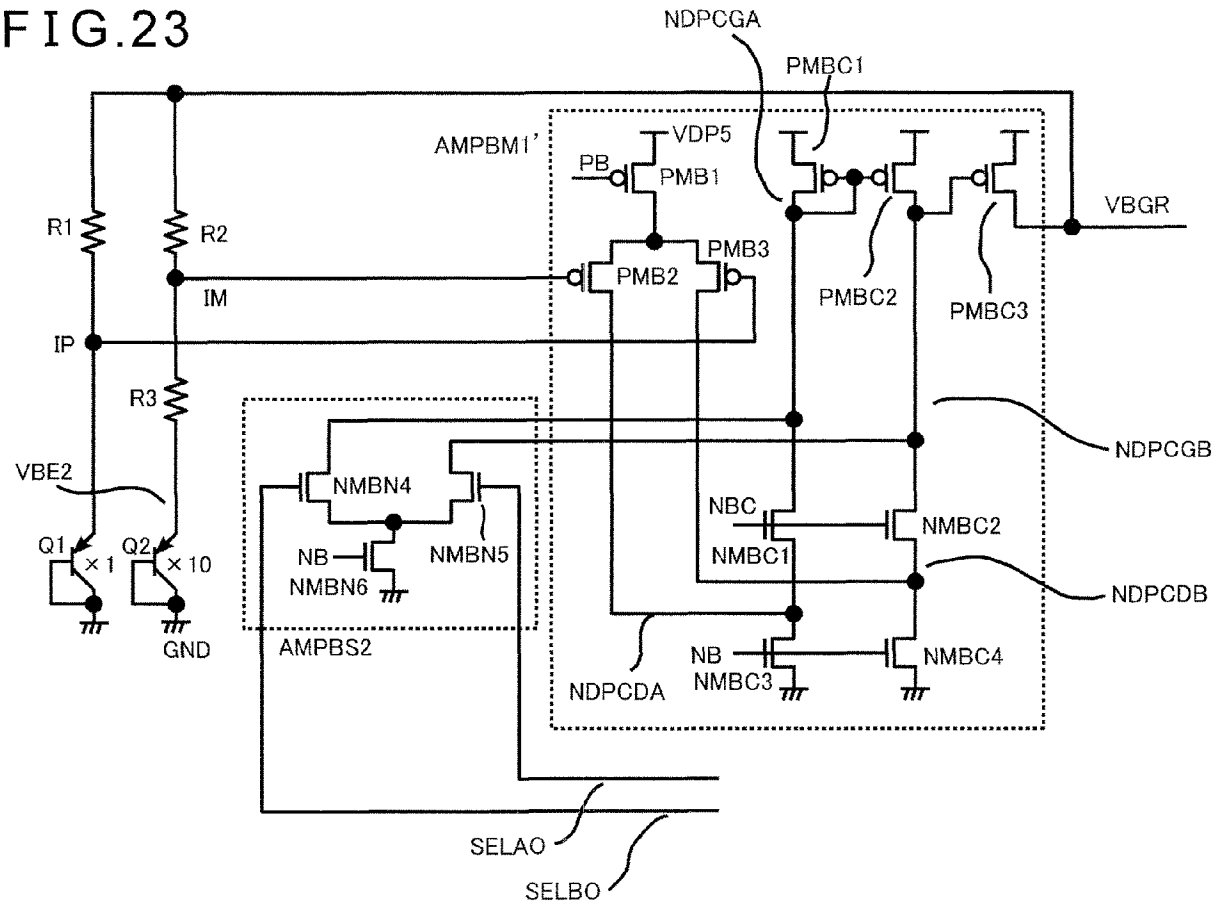
FIG. 23 is a circuit diagram illustrating a bandgap circuit of a ninth embodiment.

FIG. 23 is a circuit diagram illustrating a bandgap circuit of a ninth embodiment. In the circuit of the fifth embodiment of the above-mentioned FIG. 19, the main amplifier AMPBM1' was made a first-stage amplification circuit of a folded cascode circuit of a pMOS differential circuit input and a second-stage circuit of a pMOS source ground amplification circuit, while the auxiliary amplifier AMPBS1 was also made a pMOS differential circuit.

Like in the fifth embodiment, when making the main amplifier a two-stage configuration, making the first stage a folded cascode circuit of a pMOS differential circuit input, and making the second stage a pMOS source ground amplification circuit (PMBC3), it is possible to make the auxiliary amplifier not a pMOS differential circuit, but an nMOS differential circuit. The circuit of the ninth embodiment of FIG. 23 makes the main amplifier the AMPBM1' the same as in FIG. 19 and makes the auxiliary amplifier the AMPBS2 the same as in FIG. 22.

As illustrated in FIG. 23, when making just the auxiliary amplifier an nMOS differential circuit, it is possible to add the output drain current of the auxiliary amplifier to the main amplifier at NDPCGA and NDPCGB. The folded cascode circuit operates to send the difference of the drain currents of PMB2 and PMB3 from the currents of the current sources NMBC3 and NMBC4 carrying constant currents to the PMBC1 and PMBC2. For this reason, offset adjustment becomes possible even if adding the drain currents of the output currents NMBN4 and NMBN5 of the auxiliary amplifier at the drains of NMBC1 and NMBC2.

Compared with the fifth embodiment of FIG. 19, the circuit of the ninth embodiment of FIG. 23 does not fold back the drain current of the auxiliary amplifier (drain currents of NMBN4 and NMBN5), so there is the advantage that it is possible to reduce the overall current.

Further, in the circuit of the fifth embodiment of FIG. 19, the currents of NMBC1 and NMBC2 become the currents of the fixed-current current sources NMBC3 and NMBC4 minus the currents of PMB2 and PMB3 and currents of PMB6 and PMB7. For stable operation, it is preferable to design the currents of NMBC3 and NMBC4 to be sufficiently larger than the sum of the current of PMB5 and the current of PMB1.

On the other hand, in the circuit of the ninth embodiment of FIG. 23, the currents folded are the drain currents of PMB2 and PMB3, so the currents of NMBC3 and NMBC4 may be designed sufficiently large compared with the current of PMB1.

Note that there are also design conditions where the "current of NMBN6+current of NMBC3+current of NMBC4" of FIG. 23 becomes smaller than the "current of NMBC3+current of NMBC4" of FIG. 19. In such a case, the circuit configuration of the ninth embodiment of FIG. 23 becomes advantageous from the viewpoint of the current.

Conversely, when the "current of NMBN6+current of NMBC3+current of NMBC4" of FIG. 23 becomes larger, when it is desired to match the configurations of the main amplifier and auxiliary amplifier as a pMOS differential pair input, etc., the circuit configuration of the fifth embodiment of FIG. 19 may be employed. In this way, the configuration of the bandgap circuit may be changed in various way as used.

Figure 24:
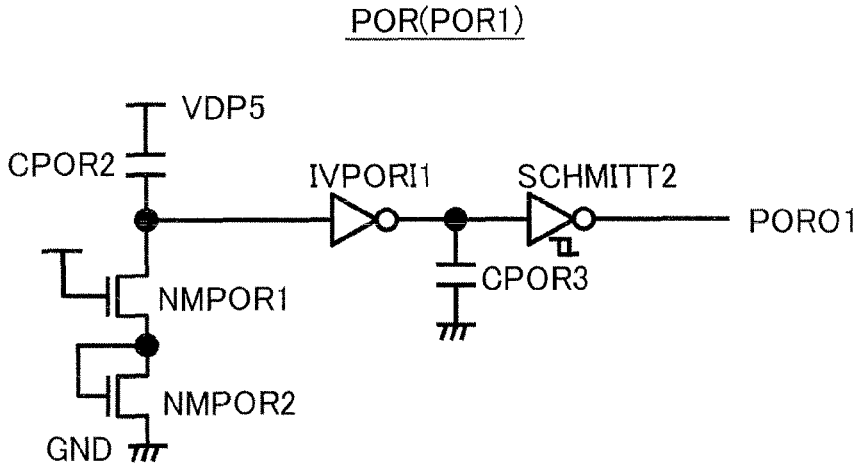
FIG. 24 is a circuit diagram illustrating an example of a power on reset circuit.

FIG. 24 is a circuit diagram illustrating an example of a power on reset circuit POR (POR1). In FIG. 24, reference notation VDP5 indicates a 5V power source, CPOR2 and CPOR3 indicate capacitors, NMPOR1 and NMPOR2 indicate nMOS transistors, and, further, GND indicates a 0V power source.

Further, reference notation IVPORI1 indicates an inverter circuit, SCHMITT2 indicates an inverted output Schmitt trigger circuit, and, further, PORO1 indicates a power on reset circuit output corresponding to PORO1 of FIG. 12.

First, right after VDP5 rises, due to the CPOR2, the output of the IVPORI1 becomes "L", so PORO1 becomes "H". CPOR2 is slowly discharged and, furthermore, CPOR3 is slowly charged, so PORO1 changes to "L" a given time after the rise of the power source.

Note that, the general power on reset circuit in the bandgap circuit of the 11th embodiment illustrated in the later explained FIG. 27 may be used as the circuit of the third embodiment shown in FIG. 12 or the power on reset circuit of another circuit.

Figure 25:
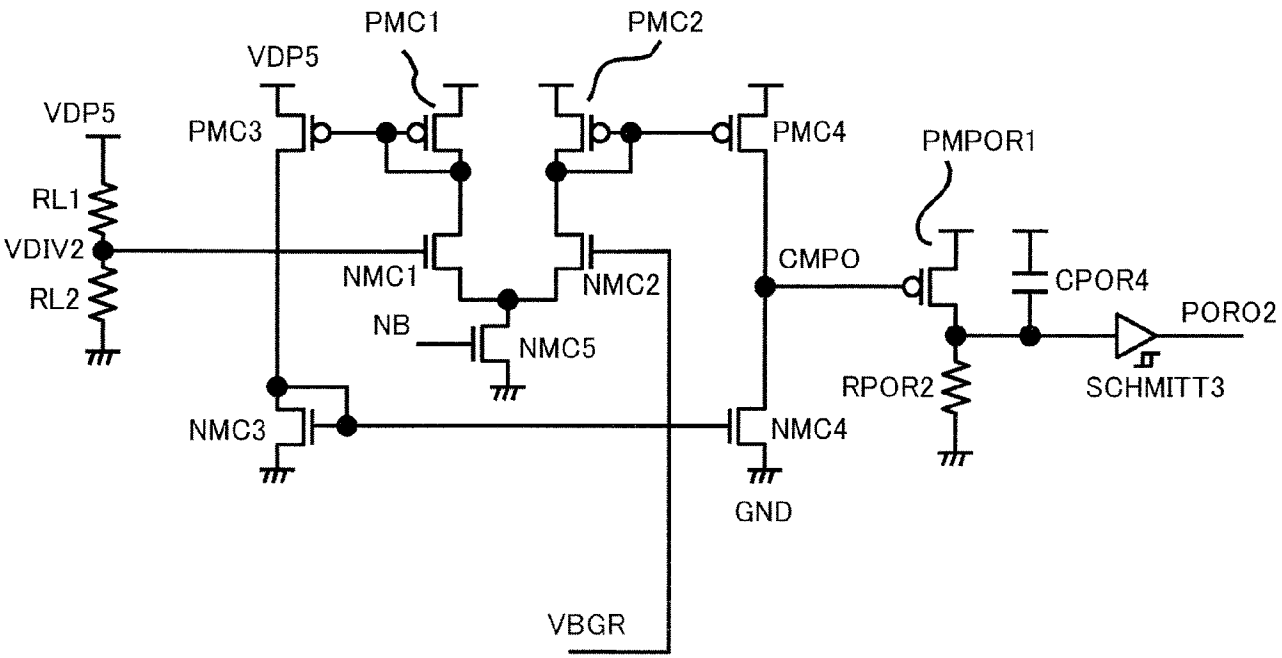
FIG. 25 is a circuit diagram illustrating another example of a power on reset circuit.

FIG. 25 is a circuit diagram illustrating another example of a power on reset circuit POR. Here, the power on reset circuit may be configured, for example, by adding a capacitor etc. to the low voltage detection circuit LVDH1 in the microcontroller of FIG. 9.

In the circuit of FIG. 25, the corresponding parts and corresponding nodes of other circuits are shown assigned the same reference notations. Note that, the resistors RL1 and RL2 show the same elements as the voltage division resistors RL1 and RL2 of FIG. 9. Further, the transistors PMC1, PMC2, PMC3, and PMC4 and NMC1, NMC2, NMC3, NMC4, and NMC5 operate in substantially the same way as the comparator CMP1 of FIG. 9. The expressions of this part given at the transistor level are similar to those of the circuit of FIG. 16.

Next, the operation of the circuit of FIG. 25 will be explained. First, the potential of VBGR and the potential VDIV2 obtained by dividing VDP5 are compared. If the divided voltage VDIV2 is higher, CMPO becomes "L". When CMPO becomes "L", the pMOS transistor PMPOR1 turns ON, so the POR output POR2 becomes "H". When the power source voltage VDP5 is low, the potential of the VBGR is higher than the potential of the VDIV2, so the potential of CMPO becomes "H". Due to this, PMPOR1 becomes OFF and PORO2 becomes "L".

Right after the power is turned on, the VBGR does not rise, but due to the capacitor CPOR4, the input of the non-inverted Schmitt trigger circuit SCHMITT3 becomes "H", so PORO2 becomes "H".

Note that it is also possible to use the power on reset circuit integrated with the low voltage detection circuit such as in the later mentioned FIG. 28 as the power on reset circuit of the circuit of the third embodiment of FIG. 12. Even in the microcontroller of FIG. 9, the BGR1 is controlled by the LVDH1 output since if some sort of load device is used, the low voltage detection circuit output may be used as the POR signal (power on reset signal).

As illustrated in FIG. 9 and FIG. 25, by adding the capacitor and resistor (RPOR2) etc. to the low voltage detection circuit to generate the POR signal and use this for control of the BGR circuit of the embodiment, when there is a low voltage detection circuit on the chip, the advantageous effect is obtained that it is possible to reduce the additional devices and reduce the occupied area.

Figure 26:
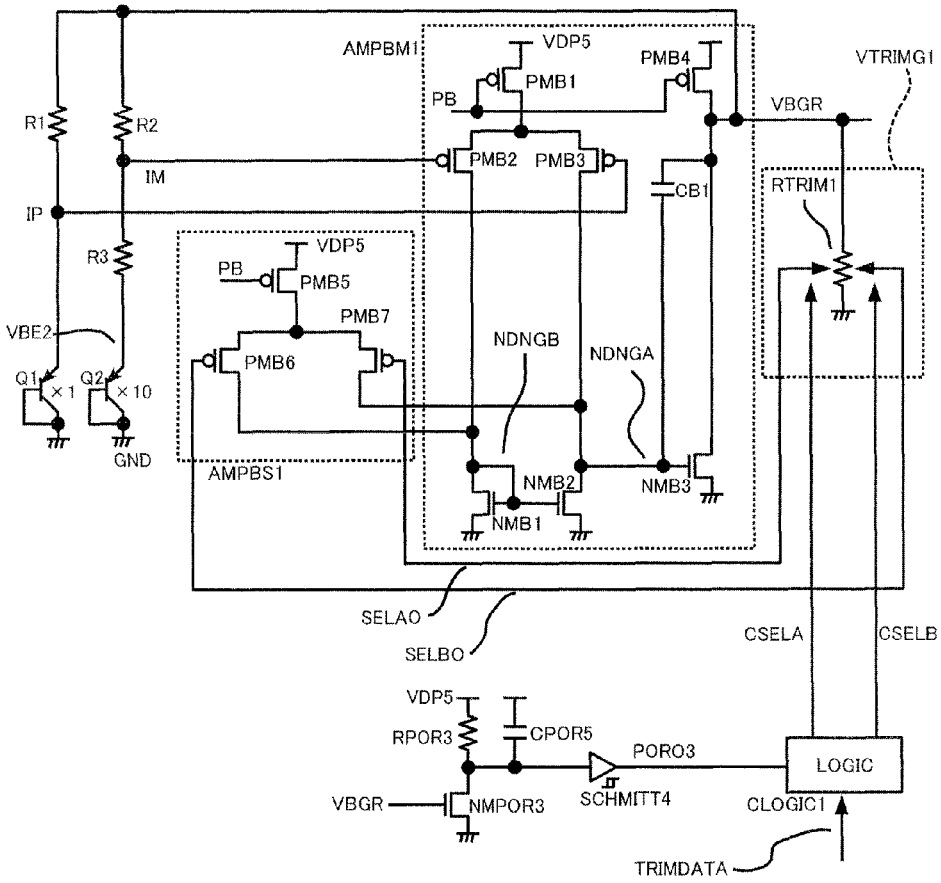
FIG. 26 is a circuit diagram illustrating a bandgap circuit of a 10th embodiment.

FIG. 26 is a illustrating a bandgap circuit of a 10th embodiment and illustrates another example of the circuitry of a POR circuit.

The circuit of the 10th embodiment of FIG. 26 realizes the power on reset circuit POR1 in the circuit of the third embodiment of FIG. 12 by the resistor RPOR3, nMOS transistor NMPOR3, capacitor CPOR5, and non-inverted Schmitt trigger circuit SCHMITT4.

Other than using the resistor RPOR3, transistor NMPOR3, capacitor CPOR5, and non-inverted Schmitt trigger circuit SCHMITT4 to generate PORO3, the circuit is the same as that explained in the other examples of circuits, so the operation of this power on reset circuit will be explained.

Right after the power source VDP5 is turned on, due to the capacitor CPOR5, the input of the SCHMITT4 becomes "H". Due to this, the POR circuit output PORO3 becomes "H". If the potential of VBGR rises, NMPOR3 becomes ON and PORO3 changes to "L". In this way, in the example of the circuit illustrated in FIG. 26 as well, it is possible to generate the POR signal.

Figure 27:
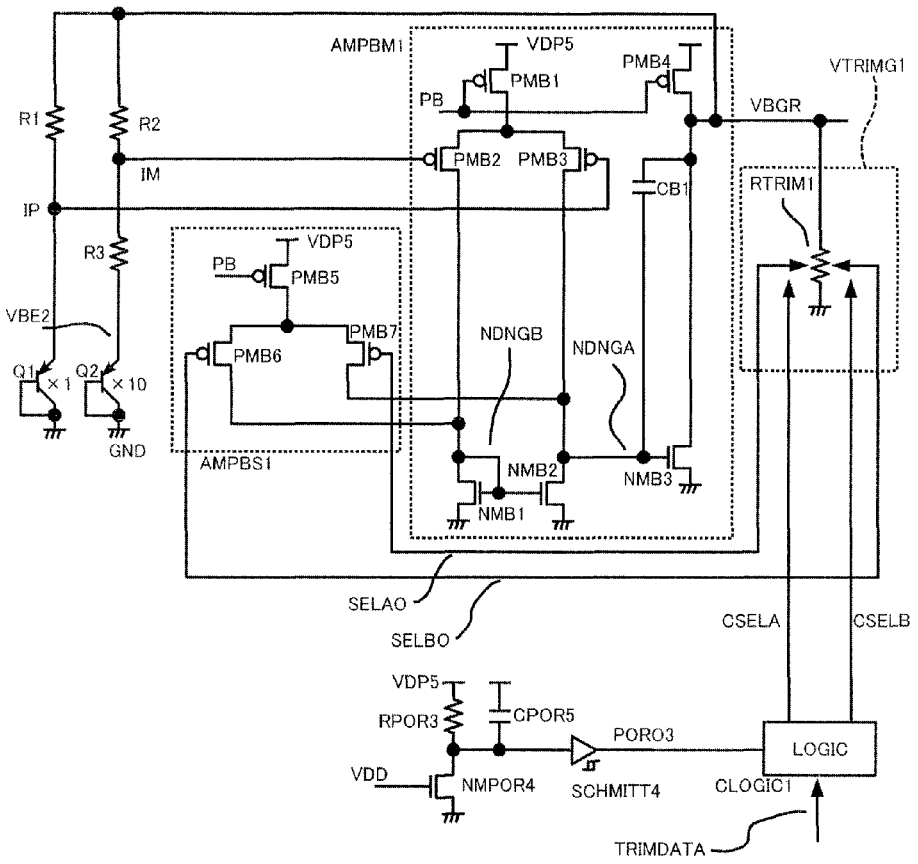
FIG. 27 is a circuit diagram illustrating a bandgap circuit of a 11th embodiment.

FIG. 27 is a circuit diagram illustrating a bandgap circuit of an 11th embodiment and illustrates another example of a circuit of a POR circuit. Here, the circuit of FIG. 27 differs from the POR circuit of FIG. 26 in the point that instead of VBGR being input to the gate of the NMPOR3, the gate input of the NMPOR4 is made VDD. The rest of the parts of the configuration is similar to the circuit of FIG. 26.

Right after the power source VDP5 is turned on, due to the capacitor CPOR5, the input of SCHMITT4 becomes "H". Due to this, the POR circuit output PORO3 becomes "H". After the power source, if the BGR circuit operates and the potential of VBGR rises, the regulator circuit also operates and the potential of VDD also rises. NMPOR4 becomes ON and PORO3 changes to "L".

In this way, even in the example of the circuit illustrated in FIG. 27, it is possible to generate a POR signal. That is, the power on reset circuit in the bandgap circuit illustrated in FIG. 26 and FIG. 27 may also be applied to various bandgap circuits. Here, for example, compared with the power on reset circuit illustrated in FIG. 24, when desiring to reduce the occupied area of the circuit, it is preferable to employ a configuration such as in FIG. 26 or FIG. 27.

Figure 28:
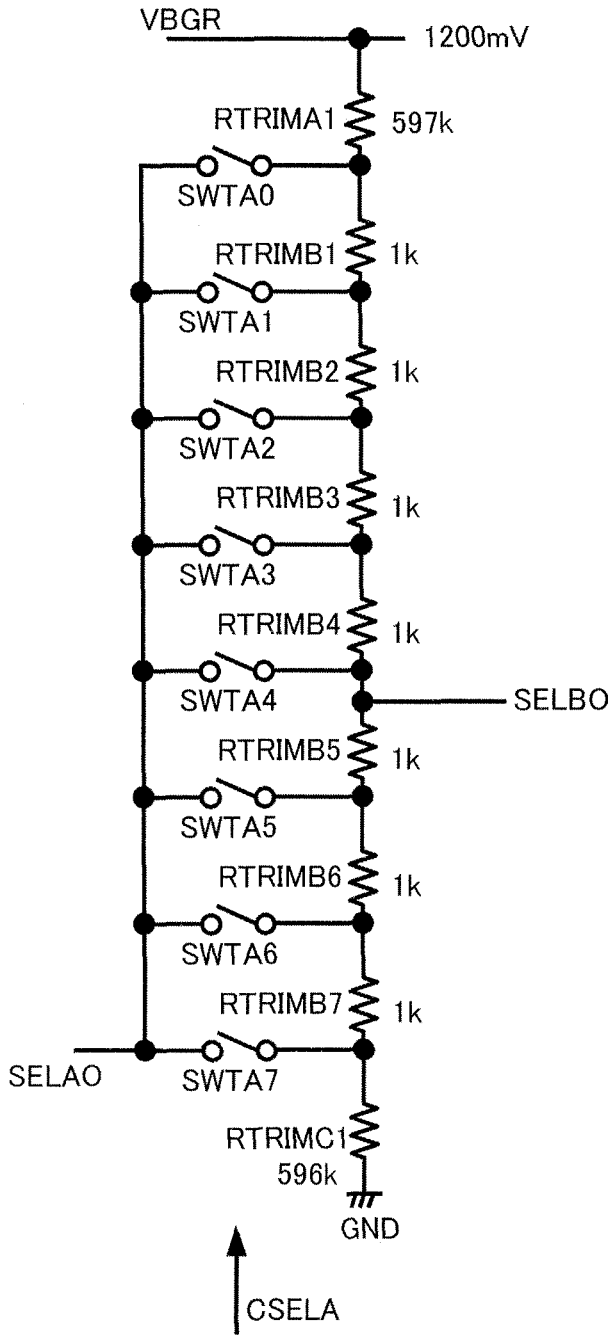
FIG. 28 is a circuit diagram illustrating another example of an offset adjustment voltage generation circuit.

FIG. 28 is a circuit diagram illustrating another example of the offset adjustment voltage generation circuit. Note that the names of the circuit devices correspond to those of FIG. 8. Further, the circuitry is almost the same as in FIG. 8, so different parts will be explained.

The offset adjustment voltage generation circuit of FIG. 8 was a circuit which used a switch to select potentials for both the input signals SELAO and SELBO of the auxiliary amplifier. For offset adjustment, the difference of the differential gate input potentials of the auxiliary amplifier is important, so, for example, SELBO may also be made the fixed potential and SELAO may be made variable.

In the offset adjustment voltage generation circuit of FIG. 28, SELBO is made a fixed potential, SELAO is selected by the switches SWTA0 to SWTA7 (first switch group), and control is performed by CSELA.

Here, in the circuit of FIG. 8, the configurations of SELAO and SELBO are symmetric, so the parasitic capacitances etc. are the same. At the time of turning on the power or other transitory periods, there is the advantage that no unbalance occurs. On the other hand, in the circuit of FIG. 28, one potential is made the fixed potential, so there is the advantage that it is possible to reduce the number of devices. Furthermore, it is also possible to use a circuit such as in the later explained FIG. 31 to generate the auxiliary amplifier input potential.

Figure 29:
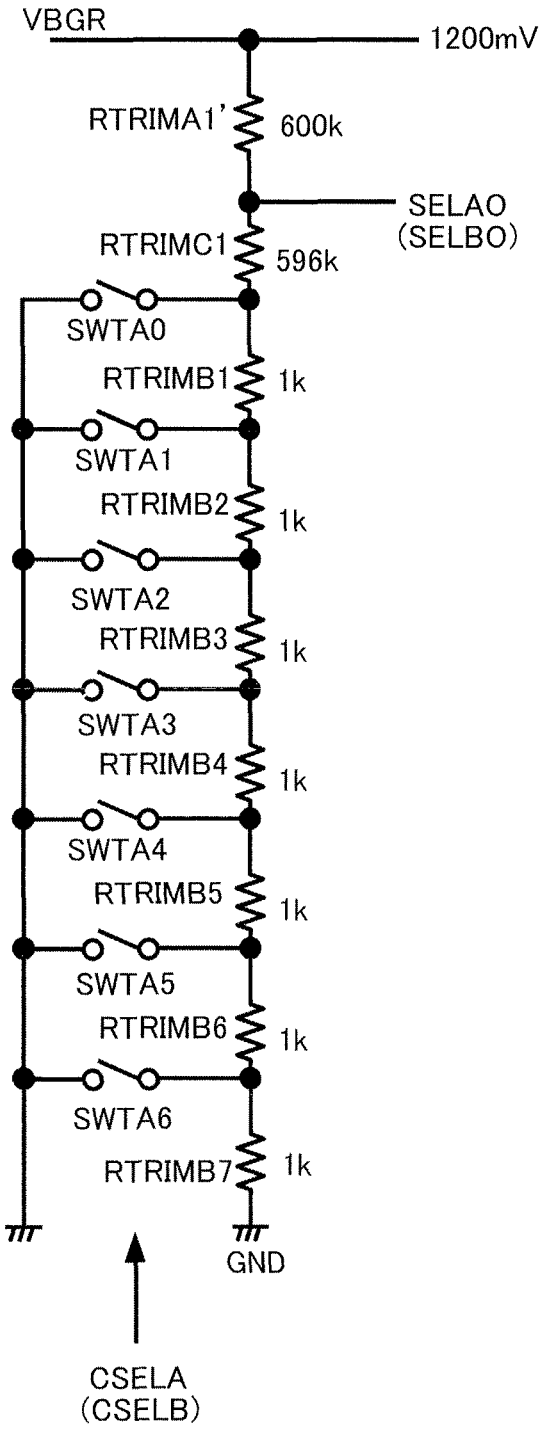
FIG. 29 is a circuit diagram illustrating still another example of an offset adjustment voltage generation circuit.

FIG. 29 is a circuit diagram illustrating still another example of an offset adjustment voltage generation circuit. In FIG. 29, the devices starting from R of the reference notation RTRIMA1' etc. show the resistors. Further, the method of assigning reference notations is almost the same as in FIG. 8, so just the thinking and points of difference of the circuit of FIG. 29 will be explained.

With the offset adjustment voltage generation circuit of FIG. 8 and FIG. 28, by obtaining the potential from a given point of the resistor ladder, for example, 1 mV different potential was made the selector output (auxiliary amplifier input signal) SELAO.

The circuit of FIG. 29 is designed to change the voltage division ratio of the resistors to change the divided voltage SELAO. That is, by any one of the switches SWTA0 to SWTA6 being turned ON, the resistance value between SELAO and GND changes. For example, the lowest potential which was used for selection of SWTA7 by the circuit of FIG. 8 may be generated in the circuit of FIG. 29 by turning the SWTA0 ON.

In the circuit of FIG. 29, it is also possible to generate slightly different SELAO potentials. In this case, unlike the circuit of FIG. 8 or FIG. 28, it is no longer possible to simultaneously generate the SELAO potential and SELBO potential by the same resistor ladder, so it is preferable to prepare two circuits of FIG. 29 for SELAO use and SELBO use.

In this way, the offset adjustment voltage generation circuit of FIG. 29 means an increase in the number of devices, but the switches SWTA0 to SWTA6 operate using GND as the source potential, so there is the advantage that the minimum operating voltage of this part is lowered.

Figure 30:
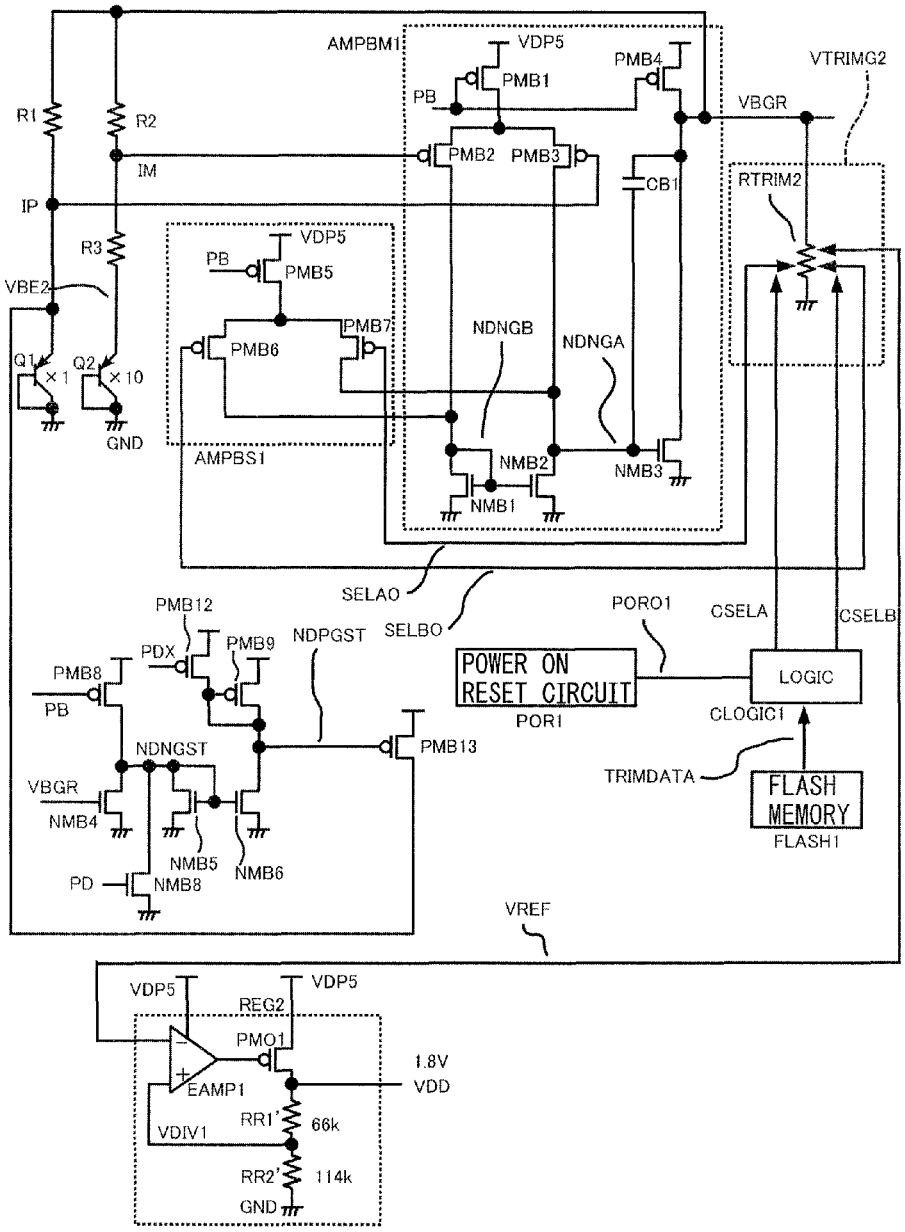
FIG. 30 is a circuit diagram illustrating a bandgap circuit of a 12th embodiment.

FIG. 30 is a circuit diagram illustrating a bandgap circuit of a 12th embodiment. In the circuit of the above-mentioned FIG. 7 or FIG. 13 etc., to generate the input signals of the auxiliary amplifier for offset adjustment, RTRIM1 was used to divide VBGR to obtain SELAO and SELBO.

In this regard, it is possible to configure the regulator circuit so as to make the output voltage VDD of the regulator circuit (REG2) a plurality of voltage settings and, for example, enable selection from 1.9V, 1.8V, 1.7V, 1.2V, and other voltages.

In this case, the voltage division circuit of VBGR not generates the gate voltages SELAO and SELBO for offset adjustment, but may also be utilized for selecting the output voltage of the regulator circuit from a plurality of voltages.

The bandgap circuit of the 12th embodiment of FIG. 30 illustrates an example of the circuit in this case. The circuit of FIG. 30 differs from the other examples of the circuits in that the offset adjustment-use input signal generation circuit becomes VTRIMG2 and the voltage division resistor is shown by RTRIM2. Furthermore, the reference voltage of the regulator circuit REG2 is not VBGR such as in the above-mentioned FIG. 9, but becomes VREF obtained by division of VBGR.

Next, the parts of the bandgap circuit of the 12th embodiment which are different from the other examples of the circuits will be explained. In FIG. 29, the circuit devices and nodes etc. corresponding to the other circuits are illustrated assigned the same device names and node names. The functions and operations of the parts assigned the same names are already explained, so explanations of these parts will be omitted.

First, the regulator circuit REG2 in FIG. 30 will be explained. Here, the voltage of VDD generated at the regulator circuit REG2 is not limited to 1.8V. That is, for example, sometimes, it is desired to generate 1.9V and operate an internal circuit at a higher speed, to lower the VDD to a voltage of about 1.2V and cut the sub threshold leak current at the time of standby, etc.

In FIG. 30, for example, the example of a regulator circuit which may select four voltages of 1.9V, 1.8V, 1.7V, and 1.2V for generation. For example, when VREF is 1.2V, the resistors RR1' and RR2' forming the voltage division circuit at REG2 become 66 kohm and 114 kohm, so the potential of VDD becomes (180 k/114 k)×1.2V=1.89V.

Further, for example, when generating 1.8V, it is sufficient to divide the potential of VREF by the voltage division resistor RTRIM2 and supply a VREF potential so that 1.8V is output from the relationship of VREF, determined by the resistors RR1' and RR2', and VDD.

Specifically, (180 k/114 k)×1.14V=1.8V, so when using RTRIM2 to divide the VBGR and supplying 1.14V to the REG2, it is possible to make the output of the REG2 1.8V by the same RR1' and RR2' as when generating 1.9V.

Similarly, when desiring to make VDD 1.7V, it is possible to make VREF=1.7V×(114 k/180 k)=1.077V.

Further, when desiring to make VDD 1.2V, it is possible to make VREF=1.2V×(114 k/180 k)=0.76V.

In this way, when preparing a plurality of output voltage settings of VDD, the resistor ladder dividing the VBGR may not be used for generation of the input signal of the auxiliary amplifier AMPBS1, but also may be used for setting the potential of the VDD. Due to this, compared with when preparing these individually, it is possible to cut the circuit area. Further, the advantageous effect is obtained that the current consumed at the voltage division circuit of VBGR will not increase.

Figure 31:
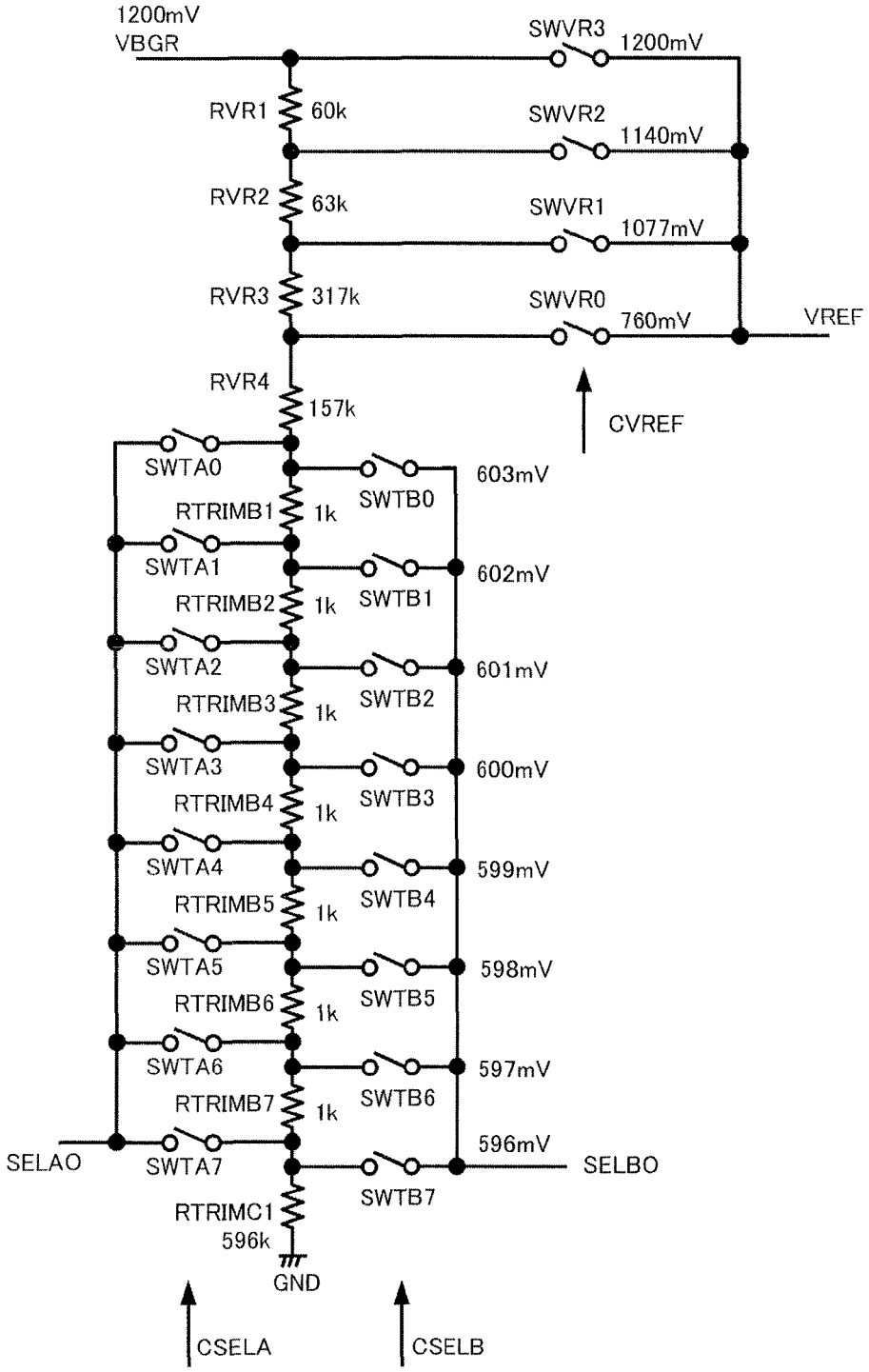
FIG. 31 is a circuit diagram illustrating still another example of an offset adjustment voltage generation circuit.

FIG. 31 is a circuit diagram illustrating still another example of an offset adjustment voltage generation circuit and illustrates a more specific example of the circuit of the VTRIMG2 of the above-mentioned FIG. 30. Note that, in the circuit of FIG. 31 as well, in the same way as the above-mentioned FIG. 8, the potentials of SELAO and SELBO are output in eight ways in 1 mV increments near 600 mV. Further, the same is true for the selection of the potentials of SELAO and SELBO by the control signals CSELA and CSELB.

Furthermore, in FIG. 31, the output potentials 1.2V, 1.14V, 1.077V, and 0.76V used for the above-mentioned VREF are generated at the same resistor ladder. Specifically, as illustrated in FIG. 31, by setting the resistance values of the resistor devices, it is possible to generate the preferable VREF voltage (1.2V, 1.14V, 1.077V, and 0.76V).

That is, it is possible to design the divided voltage like the resistors RVR1, RVR2, RVR3, and RVR4 and generate the used VREF by the switches SWVR3, SWVR2, SWVR1, and SWVR0.

Note that, for selection of the switches SWVR0 to SWVR3, it is sufficient to use the control signal CVREF to turn just one switch among these ON. Further, it is clear that it is possible to generate any 1.2V or less voltage by a resistor ladder which divides VBGR, so it is clear that it is possible to generate the potential of SELAO, generate the potential of SELBO, and generate the potential of VREF by a single resistor ladder.

In the above, the resistance values of the resistor devices in FIG. 31 are just examples. The values may be changed in various ways.

In this way, by employing a circuit such as in FIG. 30 and FIG. 31, in addition to the advantageous effects of the bandgap circuits of the above-mentioned embodiments, it is possible to realize voltage settings of the regulator circuit without increasing the area of the voltage division resistors.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A reference voltage circuit, comprising:

a first amplifier, including first and second input terminals and provided between a first power source line and a second power source line, configured to output a reference voltage;

a second amplifier coupled to the first amplifier, including third and fourth input terminals and provided between the first power source line and the second power source line;

an offset adjustment voltage generation circuit configured to generate first and second voltages which are input to the third and fourth input terminals of the second amplifier, and reduce an offset voltage between the first and second input terminals of the first amplifier through the second amplifier;

a first load device and a first pn junction device, coupled in series between a reference voltage line to which the reference voltage is applied and the second power source line; and second and third load devices and a second pn junction device, coupled in series between the reference voltage line and the second power source line, wherein the first input terminal is coupled to a coupling node of the first load device and the first pn junction device, and the second input terminal is coupled to a coupling node of the second load device and the third load device, and the offset adjustment voltage generation circuit comprises:

a resistor group including a plurality of resistors which are coupled in series between the reference voltage line and the second power source line; and a switch group including a plurality of switches which are coupled to nodes between resistors of the resistor group, wherein the first voltage which is input to the third input terminal is taken out from a fixed node in the nodes between the resistors, and the second voltage which is input to the fourth input terminal is taken out from any node in the nodes between the resistors which is selected by the switch group.

2. The reference voltage circuit as claimed in claim 1, wherein the first amplifier includes a two-stage configuration of a first amplification circuit and a second amplification circuit, the first amplification circuit includes an input differential circuit and a fourth load device configured to convert two current outputs of the input differential circuit to voltage, the second amplifier includes a one-stage configuration of a third amplification circuit, and the current output of the third amplification circuit is added to the two current outputs of the input differential circuit of the first amplification circuit.

3. The reference voltage circuit as claimed in claim 2, wherein the first pn junction device is a first PNP transistor, the second pn junction device is a second PNP transistor, the first load device is a first resistor, the second load device is a second resistor, the third load device is a third resistor, and the fourth load device is a load transistor, the first PNP transistor and the second PNP transistor are biased to different current densities, and the offset adjustment voltage generation circuit generates a voltage which is input to the third and fourth input terminals so that an offset voltage between the first and second input terminals is cancelled out.

4. The reference voltage circuit as claimed in claim 3, wherein the offset adjustment voltage generation circuit comprises:

a second switch group which includes a plurality of switches which are coupled to the nodes between resistors of the resistor group, wherein the first voltage which is input to the third input terminal is taken out from any first node in the nodes between the resistors selected by the switch group, and the second voltage which is input to the fourth input terminal is taken out from any second node in the nodes between the resistors which is selected by the second switch group.

5. The reference voltage circuit as claimed in claim 3, wherein the offset adjustment voltage generation circuit comprises:

a second resistor group including a plurality of resistors which are coupled in series between the reference voltage line and the second power source line; and a second switch group including a plurality of switches which are coupled to the nodes between resistors of the second resistor group, wherein the first voltage which is input to the third input terminal is taken out from any first node in the nodes between the resistors selected by the switch group, and the second voltage which is input to the fourth input terminal is taken out from any second node in the nodes between the resistors which is selected by the second switch group.

6. The reference voltage circuit as claimed in claim 1, wherein the offset adjustment voltage generation circuit makes a potential difference of input voltages to the third and fourth input terminals of the second amplifier zero or a given fixed value when turning on a power, and when an access of a nonvolatile memory, which stores data for controlling the switches to adjust the first and second voltages of the third and fourth input terminals, is enabled, the offset voltage between the first and second input terminals of the first amplifier is controlled to zero.

7. The reference voltage circuit as claimed in claim 6, wherein, when turning on a power, the potential difference of the first and second voltages to the third and fourth input terminals of the second amplifier is controlled to zero or a given fixed value by using an output of a power on reset circuit.

8. A semiconductor integrated circuit comprising:

a reference voltage circuit including a first amplifier, including first and second input terminals and provided between a first power source line and a second power source line, configured to output a reference voltage;

a low voltage detection circuit configured to monitor a first power source voltage of the first power source line;

a power on reset circuit configured to generate a given signal when turning on a power;

an internal circuit; and a regulator circuit configured to generate an internal voltage which makes the internal circuit operate from the first power source voltage of the first power source line which is supplied from an outside, wherein the reference voltage circuit further comprises:

a second amplifier coupled to the first amplifier, including third and fourth input terminals and provided between the first power source line and the second power source line;

an offset adjustment voltage generation circuit configured to generate avoltage first and second voltages which are input to the third and fourth input terminals of the second amplifier, and reduce the offset voltage between the first and second input terminals of the first amplifier through the second amplifier;

a first load device and a first pn junction device, coupled in series between a reference voltage line to which the reference voltage is applied and the second power source line;

second and third load devices and a second pn junction device, coupled inseries between the reference voltage line and the second power source line; and a nonvolatile memory configured to store data which controls the switches in the offset adjustment voltage generation circuit, adjust the first and second voltages which are input to the third and fourth input terminals, and make the offset voltage between the first and second input terminals of the first amplifier zero, wherein the first input terminal is coupled to a coupling node of the first load device and the first pn junction device, and the second input terminal is coupled to a coupling node of the second load device and the third load device.

9. The semiconductor integrated circuit as claimed in claim 8, wherein the nonvolatile memory is a flash memory, the flash memory is supplied with the internal voltage generated at the regulator circuit, and a reference voltage of the regulator circuit is an output voltage of the reference voltage circuit.

10. The semiconductor integrated circuit as claimed in claim 9, the semiconductor integrated circuit further comprising:

a power on reset circuit configured to make a potential difference of the first and second voltages to the third and fourth input terminals of the second amplifier in the reference voltage circuit zero or a given fixed value when turning on a power.

11. The semiconductor integrated circuit as claimed in claim 10, wherein the power on reset circuit uses a signal of a startup circuit which performs control so that an emitter potential of the first PNP transistor in the reference voltage circuit does not stop at OV when turning on a power.

12. The semiconductor integrated circuit as claimed in claim 11, wherein the power on reset circuit uses the internal voltage generated by the regulator circuit based on an output voltage of the reference voltage circuit.

13. The semiconductor integrated circuit as claimed in claim 8, wherein the regulator circuit uses voltage from the offset adjustment voltage generation circuit at the reference voltage circuit.

14. A reference voltage circuit comprising:

a first amplifier, including first and second input terminals and configured to output a reference voltage;

a second amplifier coupled to the first amplifier, such that the second amplifier and the first amplifier share a same node, the second amplifier including third and fourth input terminals;

a feedback circuit configured to receive the reference voltage and provide a first and second voltage to the first and second input terminals respectively; and a voltage generation circuit comprising a plurality of resistors and a plurality of switches, wherein the voltage generation circuit is configured to provide a third and fourth voltage to the third and fourth input terminals, respectively, based at least on the reference voltage and on one or more switching states of the plurality of switches.

15. The reference voltage circuit of claim 14, wherein the feedback circuit comprises:

a first load device and a first pn junction device, coupled to a reference voltage line to which the reference voltage is applied; and second and third load devices and a second pn junction device, coupled to the reference voltage line.

16. The reference voltage circuit of claim 15, wherein the first input terminal is coupled to a node between the first load device and the first pn junction device, and the second input terminal is coupled to a node between the second load device and the third load device.

17. The reference voltage circuit of claim 14, wherein the plurality of resistors are coupled in series and further coupled to a reference voltage line to which the reference voltage is applied.

18. The reference voltage circuit of claim 15, wherein each of the plurality of switches is coupled to a node between two resistors of the plurality of resistors.

19. The reference voltage circuit of claim 14, wherein the one or more switching states are determined based on control signals associated with a memory.

20. The reference voltage circuit of claim 14, wherein the voltage generation circuit is further configured to reduce an offset between the first voltage and the second voltage via the second amplifier.

* * * * *